US007278249B2

(12) United States Patent
Kari

(10) Patent No.: US 7,278,249 B2
(45) **Date of Patent: *Oct. 9, 2007**

(54) INSERT FOR RECEIVING AND PROTECTING A PRODUCT AND A METHOD OF FORMING THE INSERT

(75) Inventor: David F. Kari, Carol Stream, IL (US)

(73) Assignee: Fidelity Container Corporation, Elk Grove Village, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/299,443

(22) Filed: Dec. 12, 2005

(65) Prior Publication Data

US 2006/0086635 A1 Apr. 27, 2006

Related U.S. Application Data

(63) Continuation-in-part of application No. 10/689,802, filed on Oct. 21, 2003, now Pat. No. 7,021,024, which is a continuation-in-part of application No. 09/921,091, filed on Aug. 2, 2001, now Pat. No. 6,685,025.

(51) Int. Cl.
*B65B 23/00* (2006.01)
*B65B 11/00* (2006.01)
*B65D 85/30* (2006.01)

(52) U.S. Cl. ..... 53/397; 53/472; 206/485; 206/583; 206/588; 206/590; 206/592; 229/120.37; 493/55; 493/68; 493/137

(58) Field of Classification Search ..... 53/397, 53/472; 206/485, 588, 590–592, 586, 583, 206/594, 521, 525.1; 229/120.37; 493/55, 493/68, 69, 79, 116, 136, 137, 397, 405
See application file for complete search history.

(56) References Cited

U.S. PATENT DOCUMENTS

| | | | | |
|---|---|---|---|---|
| 1,039,026 | A | 9/1912 | Carter | |
| 3,240,417 | A | 3/1966 | Andreini | |
| 3,291,365 | A | 12/1966 | Koene | |
| 3,330,465 | A | 7/1967 | Davidson et al. | |
| 3,446,413 | A * | 5/1969 | Sherrill et al. | 229/122.27 |
| 3,764,004 | A | 10/1973 | Forbes, Jr. | |

(Continued)

*Primary Examiner*—Stephen F Gerrity
(74) *Attorney, Agent, or Firm*—Trexler, Bushnell, Giangiorgi, Blackstone & Marr, Ltd.

(57) ABSTRACT

An integral, generally rectangular corrugated fibreboard blank folds to form an insert having three air cells for cradling and protecting a product. Two of the air cells stand vertically generally on top of the third air cell at ends thereof. A product rests on the third air cell and is received and captured between the two vertical air cells. The insert, with the product in place, fits into a box where tabs projecting from the insert cooperate with the box to form two more air cells at the opposite ends of the insert.

25 Claims, 31 Drawing Sheets

U.S. PATENT DOCUMENTS 3,921,890 A 11/1975 Reihm
4,320,839 A 3/1982 Skaggs
5,322,168 A 6/1994 Kataoka
5,398,808 A * 3/1995 Chen et al. ..... 206/591
5,458,237 A 10/1995 Kataoka
5,467,875 A 11/1995 Sato
5,772,025 A 6/1998 Chen et al.
5,871,147 A 2/1999 Smith et al.
5,979,659 A 11/1999 Kataoka
6,199,700 B1 3/2001 Yamamoto et al.
6,257,412 B1 7/2001 Yamamoto et al.
6,308,828 B1 10/2001 Jones
6,685,025 B1 2/2004 Kari
6,685,026 B1 2/2004 Hanna
7,021,024 B2 * 4/2006 Kari ..... 53/397
2004/0084349 A1 5/2004 Kari

* cited by examiner 420
433
435
427a
460
458
426
424
422
425
427
483
468
468a
490
441
444
494
466
466a
440
432
494c
496
492
498
428
494b
434
430
494a
438
436
456
454
476
478
480
472
474
470
462
462a
464
464a
421
443
442
427b

INSERT FOR RECEIVING AND PROTECTING A PRODUCT AND A METHOD OF FORMING THE INSERT

CROSS-REFERENCE AND INCORPORATION BY REFERENCE

This application is a Continuation-in-Part of U.S. patent application Ser. No. 10/689,802, entitled "Cartridge Insert Which Fits Into A Box", filed Oct. 21, 2003, which issued as U.S. Pat. No. 7,021,024 on Apr. 4, 2006, which, in turn, is a Continuation-in-Part of U.S. patent application Ser. No. 09/921,091, entitled "Cartridge Insert Which Fits Into A Box" and filed on Aug. 2, 2001, which issued as U.S. Pat. No. 6,685,025 on Feb. 3, 2004. U.S. patent application Ser. Nos. 09/921,091 and 10/689,802 are hereby incorporated by reference.

BACKGROUND OF THE INVENTION

This invention relates to corrugated fibreboard inserts which fit into a carton to receive and protect an elongated or generally rectangular product and more particularly—but not exclusively—to inserts which can accommodate toner or similar cartridges having any of a number of different configurations.

In general, the invention is directed to packaging elongated or generally rectangular products, such as a VCR cartridge, a glass ornament, a work of art, a portable radio, or the like. For convenience of description, all of these and other objects will hereinafter be included in the term "toner cartridge" for a computer printer.

Some fields of a product have parts which are very similar and yet are also different in detail. This means that the manufacturer of that product has often been required to inventory a different packaging system for each product in the field. This need not only increases costs for warehousing, handling, and the like, but also creates inefficiencies because the correct box may not always be available or may be in the wrong place at the wrong time.

A toner cartridge is an example of such a product. There are many manufacturers of printers which use toners in cartridges of its own design. Each manufacturer may also have a variety of toner cartridges which have evolved with improvements over the years. The same toner manufacturer may supply toner for most, if not all of these cartridges, for printers of different manufacturers. Therefore, that toner manufacturer will want to minimize the types and styles of packaging materials which it must keep in inventory, despite the fact that each printer manufacturer has its own design. The problem is further complicated since a toner cartridge does not have the smooth configuration of a rectangular box, such as a VCR cartridge.

Another consideration is the type of packaging material insofar as its bulk, ease of use, disposition and the like. For example, one type of packaging material is either molded pulp or polystyrene foam that is molded in a shape which receives and cradles a toner cartridge. Also, this requires mold tooling. It is particularly inefficient since the molded shape may not receive essentially the same cartridge if this surface contour is changed without altering the overall outer dimensions. This type of molded packaging is bulky and is costly to store and transport since it amounts to storing and shipping air. Further, it creates bulky trash for the customer to discard. In the case of polystyrene, the material is not recyclable or environment friendly.

A desirable form of packaging is a corrugated fibreboard insert because it is inexpensive, and can be stored flat to take up a minimum amount of room. It is recyclable and environmentally friendly. Such an insert should be simple, easy to fold, and to interlock into place with a minimum amount of effort. Also, it should be easy for the customer to unfold and to discard it after it has done its job. Further, it should be versatile and equally easy to form and use any blank for any of many types of cartridge that may be fitted therein.

When the corrugated fibreboard blank is designed, it should use as small an amount of fibreboard as possible considering the need to physically protect the product. It should have reliable interlocking parts or other means to keep it in an assembled condition.

OBJECTS AND SUMMARY OF THE INVENTION

A primary object of the invention is to provide a multipurpose environmental friendly, insert which may receive and protect any one of a plurality of toner or other cartridges—or similar products—with equal protection and ease of use.

It is a primary object of the invention to provide a blank formed of corrugated fibreboard which can be folded into an insert which is designed to secure a variety of types of toner cartridges therein.

It is an object of the invention to provide an insert which can be positioned within a shipping container for shipping the insert and the product secured therein.

It is another object of the invention to provide an insert which provides protection for the products secured therein through layers of corrugated fibreboard formed into air cells for cushioning.

Yet another object of the invention is to provide an insert which is efficient in terms of labor, size, and its ability to contain multiple products.

Still another object of the invention is to provide a blank for forming the insert which is space-saving as it can ship and store flat.

Another object of the invention is to provide a blank for forming the insert which is environmentally friendly and recyclable.

Another object of the invention is to provide an insert which is extremely inexpensive to manufacture.

Yet another object of the invention is to provide an insert which lends itself to being assembled manually and/or automatically.

Briefly, and in accordance with the foregoing, the present invention discloses a corrugated fibreboard blank for receiving and protecting products, such as a toner cartridge, which is designed to securely receive the products in an upright position. The product may be either wrapped or unwrapped. Different types and sizes of product may be received and protected by the way that the blank is folded before or during an insertion of the product.

BRIEF DESCRIPTION OF THE DRAWINGS

The organization and manner of the structure and operation of the invention, together with further objects and advantages thereof, may best be understood by reference to the following description, taken in connection with the accompanying drawings, wherein like reference numerals identify like elements in which.

DETAILED DESCRIPTION OF THE PREFERRED EMBODIMENTS

Figure 1:
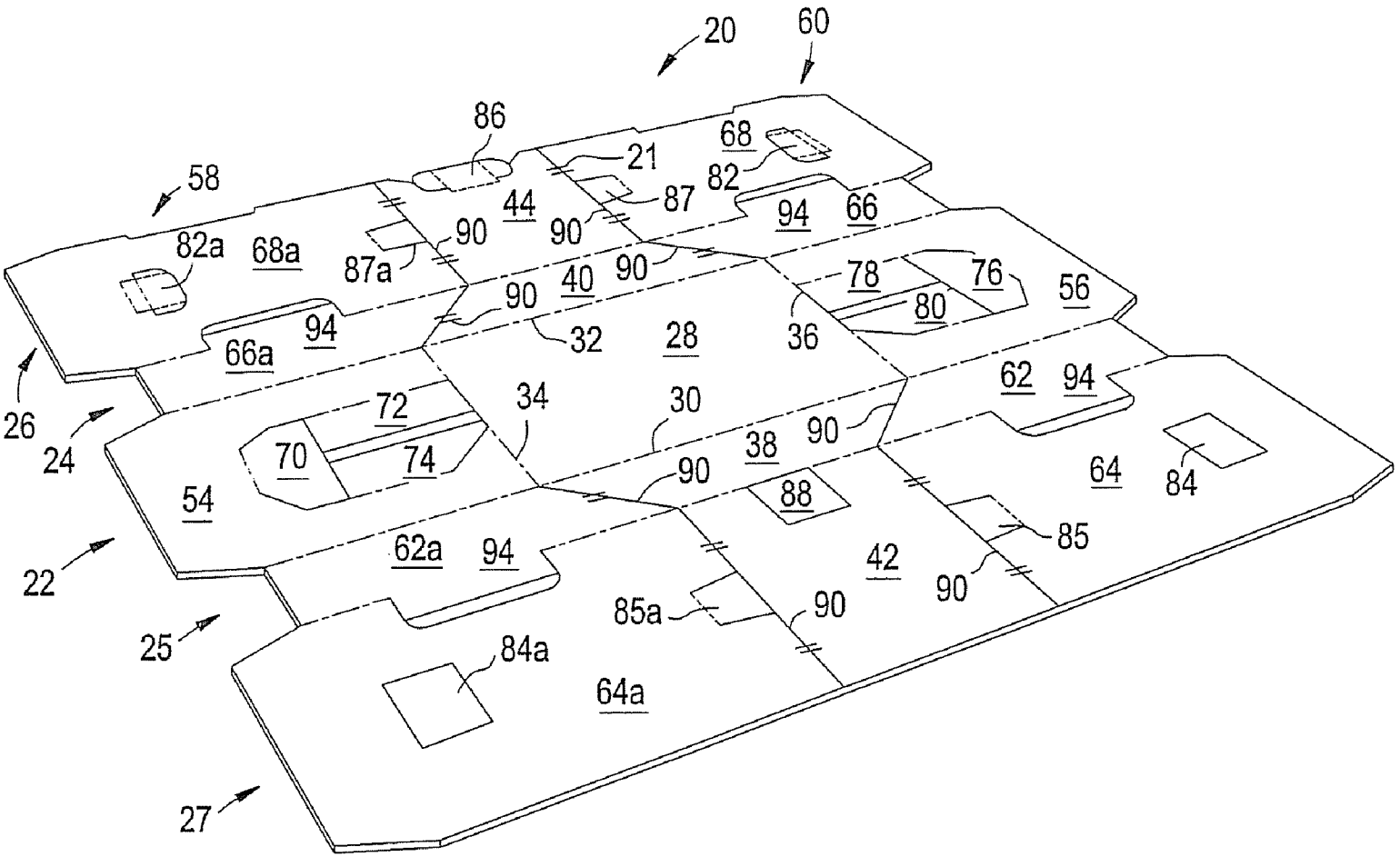
FIG. 1 is a perspective view of a corrugated fibreboard blank which is used for the formation of the insert of a first embodiment of the invention.

While the invention may be susceptible to embodiment in different forms, there is shown in the drawings, and herein will be described in detail, specific embodiments with the understanding that the present disclosure is to be considered an exemplification of the principles of the invention, and is not intended to limit the invention to that as illustrated and described herein.

A first embodiment of the invention is illustrated in FIGS. 1-8. A second embodiment of the invention is illustrated in FIGS. 9A-9F. A third embodiment of the invention is illustrated in FIGS. 10A-10E. A fourth embodiment of the invention is illustrated in FIGS. 11-22. Like elements are denoted with like reference numerals with regard to the first, second and third embodiments. Like elements with regard to the fourth embodiment may or may not be denoted with like reference numerals. Reference numerals for the first embodiment are in the tens and one hundreds. Reference numerals for the second embodiment are in the two and three hundreds. Reference numerals for the third embodiment are in the four and five hundreds. Reference numerals for the fourth embodiment are in the six, seven, eight, nine and ten hundreds.

Attention is invited to the first embodiment of the invention which is directed to a corrugated fibreboard blank 20 (FIG. 1) which may be folded to form an insert for receiving and protecting a product. Dot-dashed lines show where the blank 20 folds. Solid lines show where the blank 20 is cut. Hash marks, such as shown at 21, identify lines which are partially or almost cut through, as by knicked knives, so that they will initially fold as a unit, but will break apart when the blank 20 reaches a final fold. These partially cut lines 21 divide the blank 20 into three parts which will become a central air cell having a cradle air cell on each end.

A generally rectangular and integrally formed blank 20 is divided longitudinally into a bottom panel 22 flanked by side panels 24, 25 joined to outer panels 26, 27. The bottom panel 22 has a rectangular central bottom panel 28 with opposite sides at fold lines 30, 32 and ends 34, 36. The side panels 24, 25 have splayed panels 38, 40 joined to central bottom panel 28.

The side panels 24, 25 are joined to outer panels 26, 27 which have bottom air cell panels 42, 44 joined to splayed panels 38, 40. The splayed panels 38, 40 and bottom air cell panels 42, 44 will fold to form an air cell below central bottom panel 28.

A central cradle panel 54, 56 is formed at each end of the central bottom panel 28. The side panels 24, 25 and the outer panels 26, 27 have intermediate and outer cradle panels 62, 64 and 66, 68, respectively, which fold to form an air cell behind the central cradle panels 54, 56. Similar cradle panels (identified by the suffix (a)) are formed on the opposite ends of outer panels 26, 27. Therefore, air cells are formed on each end and at the bottom of the insert formed by blank 20. Product anchoring tabs 70, 72, 74, 76, 78, 80 are formed on the central cradle panels 54, 56.

The intermediate cradle panels 62, 66 and the outer cradle panels 64, 68 will fold to form an air cell behind the central cradle panels 54, 56. In greater detail, outer cradle panels 64, 68 fold and are positioned parallel to, behind, and spaced from central cradle panel 56. Outer cradle panels 64 and 68 are in face to face contact at which time, they are locked together when tab 82 is pushed through hole 84 and when somewhat keystone shaped tabs 85, 87 are bent into the air cell. The tab 82 has a somewhat mushroom shape to provide a handle for two fingers after it is pushed into hole 84.

The splayed panels 38, 40 and their bottom air cell panels 42, 44 are separated from intermediate cradle panels 62, 66 and from their outer cradle panels 64, 68 by lines 90 which are partially cut by knicked knives, as indicated by twin hash marks such as those shown at 21. That is to say, the corrugated fibreboard is almost, but not quite, cut through.

Three product anchor flaps 70, 72, 74 and 76, 78, 80 are formed in the central cradle panels 54, 56 on opposite ends 58, 60 of the bottom panel 22. Preferably, these anchor flaps 70, 72, 74, 76, 78, 80 have irregular shape in order to accommodate different end profiles of the product packaged in the cartridge insert. In greater detail, these flaps 70, 72, 74, 76, 78, 80 push out to receive and hold lower corners of the product. The opposite ends of the outer panel 26 have locking tabs 82, 82*a* which fit into holes 84, 84*a*, respectively, of the outer panel 27 in order to lock the formed air cell in place. By a selection of these irregular shapes, it is possible to design one insert to receive, for instance, three different cartridges.

Figure 2:
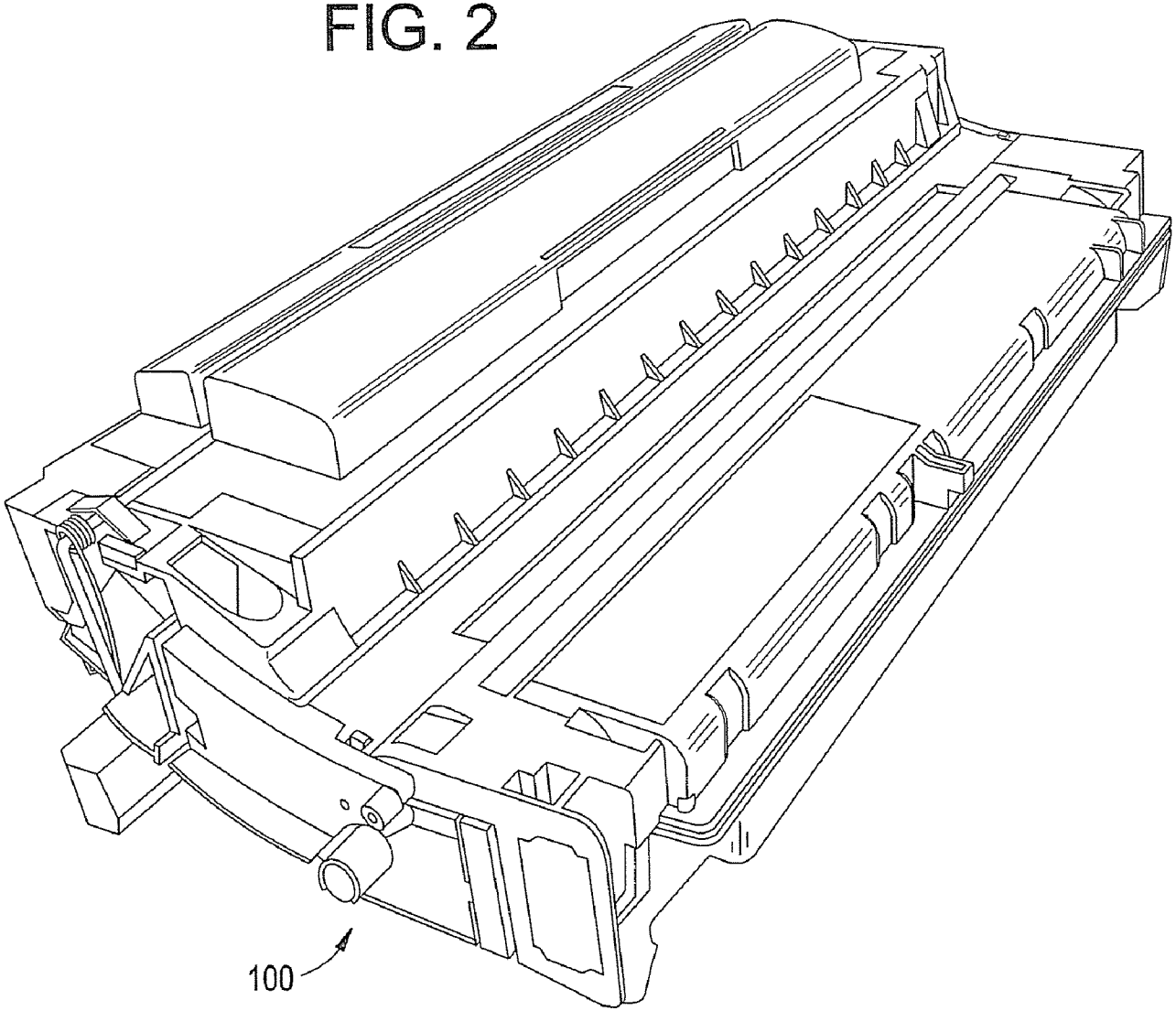
FIG. 2 is a perspective view of a toner cartridge.

FIG. 2 shows a product 100 (here shown by way of example as a toner cartridge). However, any product having a similar corner configuration may be cradled by the inventive cartridge insert. This is different from packing the product in a molded pulp or foam cradle which depends upon a cavity having the surface configuration of the product. The important feature in showing FIG. 2 is that the product 100 has complex outside contours which can be protected without reference to these contours. The outside dimensions of the product 100, not the surface configuration, determines the characteristics which enable a use of the inventive insert.

Figure 3C:
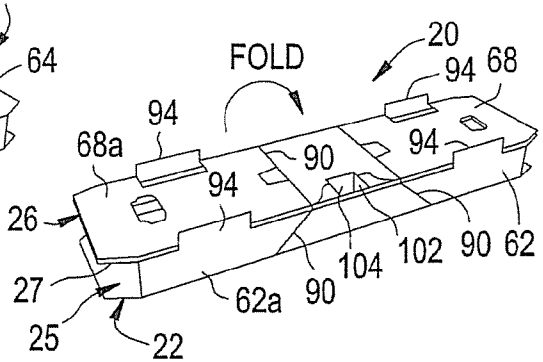
FIGS. 3A-3F are stop motion illustrating how the corrugated fibreboard blank of FIG. 1 is folded to form the insert of the first embodiment of the invention.
Figure 3B:
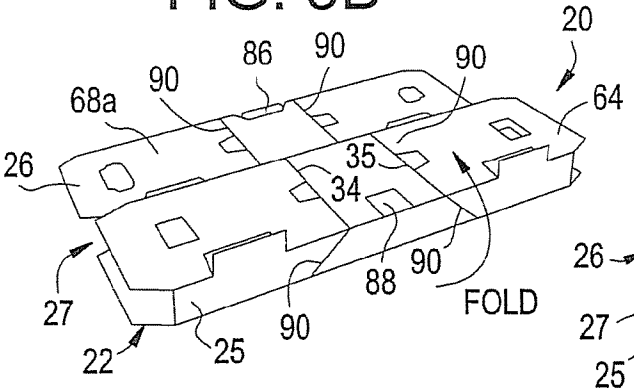
Figure 3A:
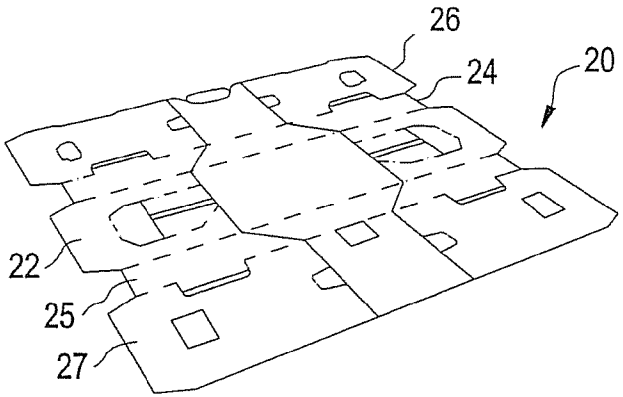

The use of blank 20 (FIG. 3A) begins with FIG. 3B which is a first step where side panel 25 is folded to stand perpendicular to bottom panel 22. Then, outer panel 27 is folded to be parallel to bottom panel 22 and perpendicular to side panel 25.

In FIG. 3C, the side panel 24 (not seen in FIG. 3C) is folded to stand perpendicular to bottom panel 22. Outer panel 26 is folded to be perpendicular to side panel 24, parallel to and in face-to-face contact with outer panel 27 (see also FIG. 3B). Locking tab 86 is pushed into locking hole 88 to secure the blank 20 in the folded configuration of FIG. 3C. The resulting structure is a generally tubular shaped structure.

It should be noted that the spacer tabs 94 are upstanding and have not folded over with the folding of the center panels 26, 27. It should also be noted that the lines 90 which were cut partially through by a knicked knife have held together so that the panels 22-27 folded as a unit and did not break apart through the folding of FIGS. 3B and 3C.

Figure 3F:
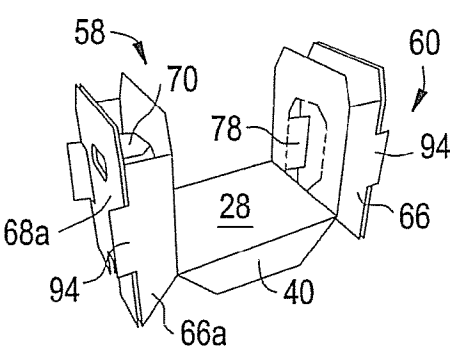
Figure 3E:
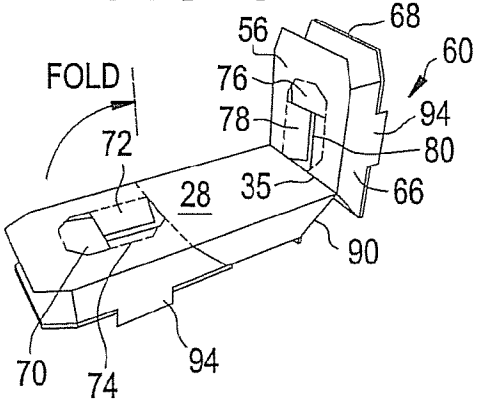
Figure 3D:
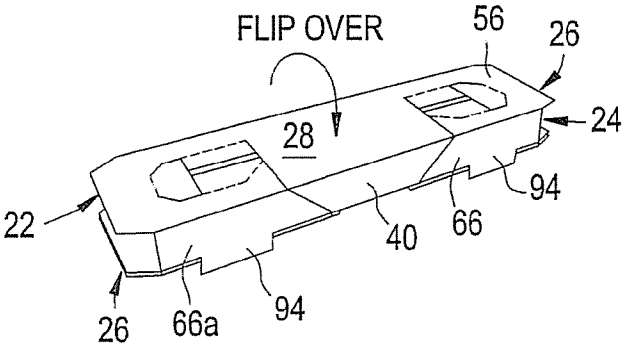

In FIG. 3D, the blank folded in FIG. 3C is flipped over so that bottom panel 22 is on top and outer panel 26 is on the bottom. Then (FIG. 3E), the end 60 is folded up. The lines 90 partially cut by knicked knives were strong enough to remain intact during the folding and flipping of FIGS. 3B-3D, but are not strong enough to resist the folding of the air cell at end 60.

Figure 4:
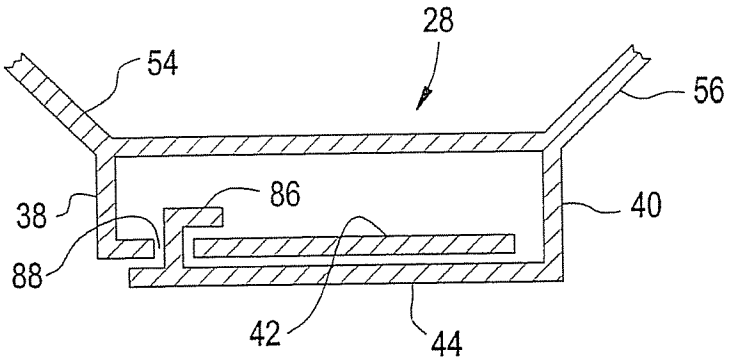
FIG. 4 is a cross section of an air cell at a bottom of the insert of the first embodiment of the invention.

In FIG. 3F, the folding is complete when the air cell at end 58 is folded and standing approximately perpendicular to center bottom panel 28 and parallel to the air cell at end 60. As can be seen in FIG. 3F, the insert is a generally U-shaped structure when in its final form. The product anchor tabs 70-80 are pushed in, and ready to receive the product. FIG. 4 is a cross-section of the air cell beneath the center bottom panel 28 which shows the locking tab 86 pressed through locking hole 88 in order to lock panels 42, 44 in an assembled position.

Figure 5:
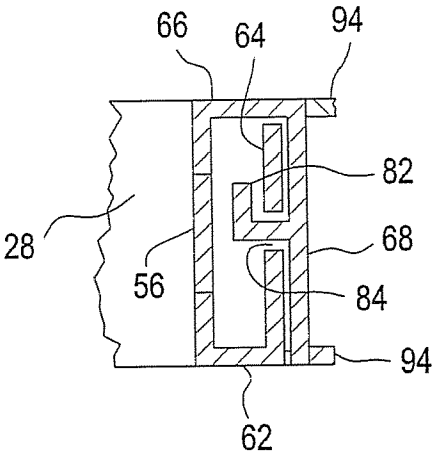
FIG. 5 is a cross section of an air cell at an end of the insert of the first embodiment of the invention.

FIG. 5 is a cross section of the air cell formed between central cradle cell 56 and outer cradle panel 68 which shows locking tab 82 pressed through locking hole 84 to lock panels 64, 68 together.

Figure 6:
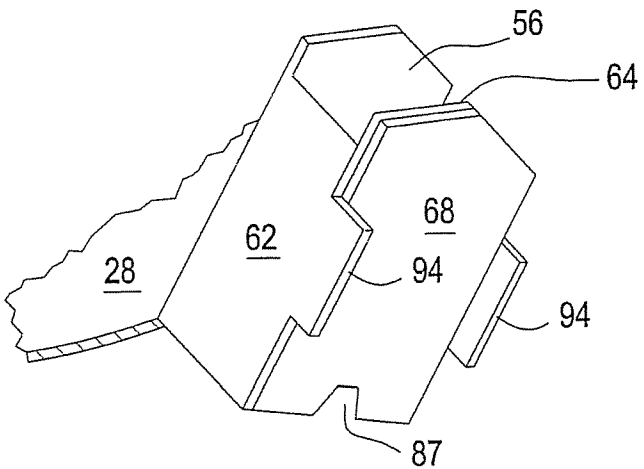
FIG. 6 is a perspective view showing an end air cell of the insert of the first embodiment of the invention.

An air cell (FIG. 6) is formed on each end of the insert formed by folded blank 20. The bottom edges of panels 68, 64 and 68*a*, 64*a* are locked together by pushing somewhat keystone shaped panels 85, 87 and 85*a*, 87*a* inwardly (FIG. 6).

After the air cells are formed on each of the opposite ends and the bottom of the insert, the product 100 (FIG. 7) is placed on the bottom panel 28 and between the product anchor flaps 70, 72, 74 and 76, 78, 80. As the end air cells are brought together, the lower corners of the product 100 are captured as they force the anchor flaps 70-74 and 76-80 outwardly.

For toner cartridges, enclosure within a plastic bag is required by the cartridge manufacturers to avoid problems relating to the possibility of spilling ink. A plastic bag is not necessary for packaging a different type of product, which has no spillage possible.

Preferably, the toner cartridge is placed inside a plastic bag 130 (FIG. 7) when the packaging is complete. The assembled insert and product 100 is now ready to be slid or placed in an outer box or carton.

Figure 8:
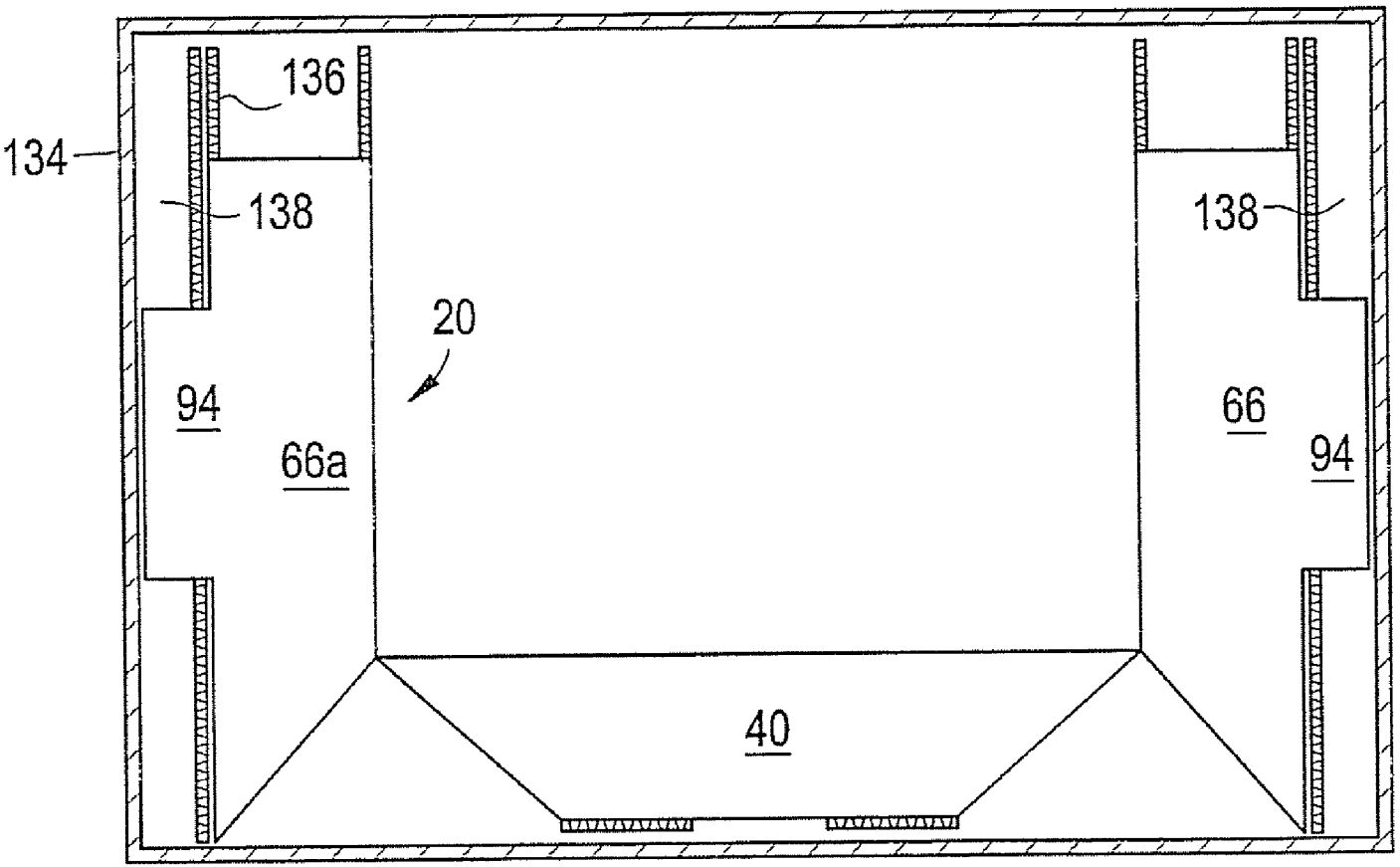
FIG. 8 is a cross section of the insert of the first embodiment of the invention inside a box.

It should be apparent from a study of FIG. 8 that cartridges having different configurations may be accommodated since there is nothing dedicating the cartridge to specific surface shapes. Therefore, one insert may serve a family of different cartridges. In an acceptable size, the insert will be held in place by the carton or box in which the insert is used.

FIG. 8 shows a completely folded insert 20 inside an outer box or carton 134. Edges where flutes of the corrugated fibreboard may be seen are indicated, as at 136, for example. As the panels 64, 68 fold to be perpendicular to panels 62, 66, a spacer tab 94 projects outwardly as shown on panels 62, 62*a* (FIG. 3C), for example, on each side and each end of the air cell. When the insert is placed inside a box 116 or carton 134, these spacer tabs 94 rest against the inside end surfaces of the box 134, thereby forming another air cell 138 to protect the product. The splayed panel 40 of the bottom air cell is in the nature of a bridge suspended between the vertical cradle air cells identified by their side panels 66*a*, 66.

Figure 7:
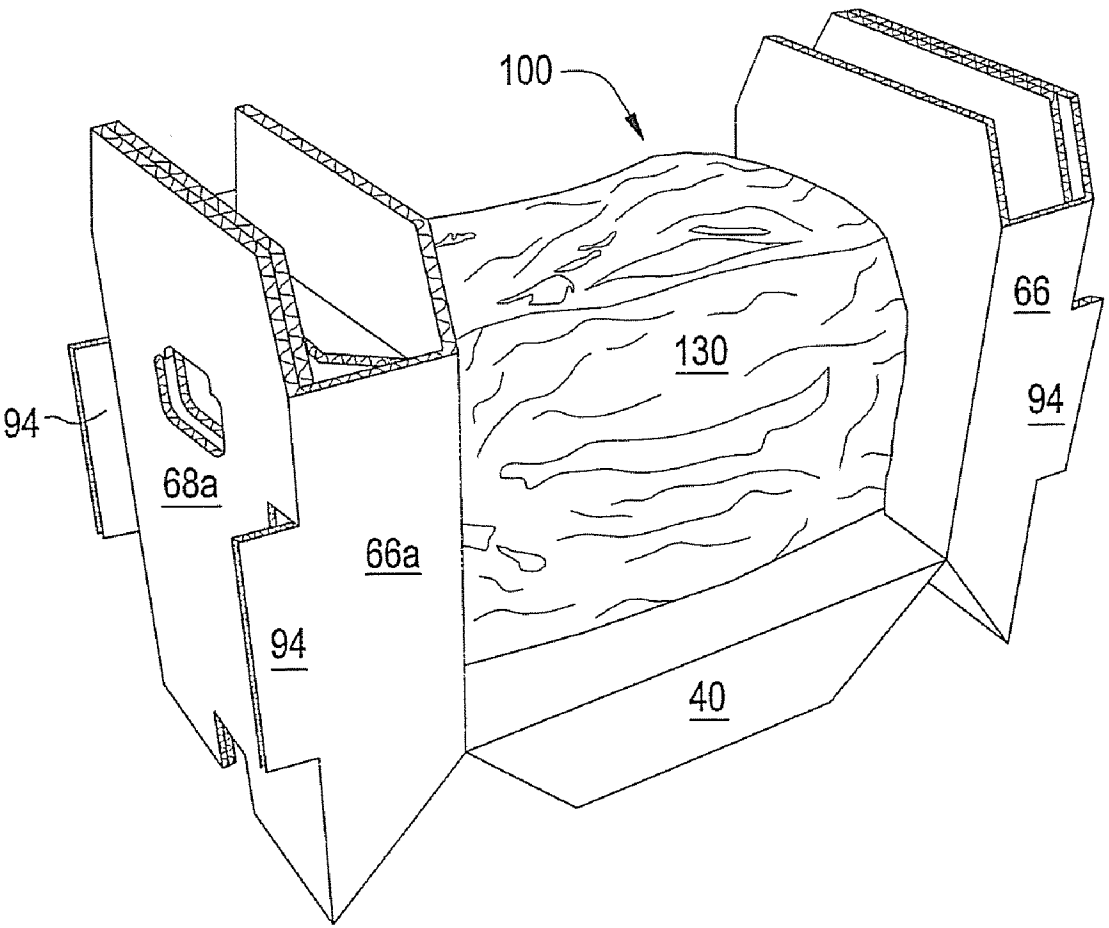
FIG. 7 is a perspective drawing of a complete insert of the first embodiment of the invention with a plastic wrapped cartridge in place in the insert.

As shown in FIGS. 6, 7 and 8, the insert 20 is positioned to receive and cradle a product of a medium length. This particular insert fits three different cartridges of similar length, but different profiles. If the cartridge is longer or shorter, it requires a longer or shorter insert. Normally, cartridges come grouped in similar lengths.

The product anchoring tabs 70-80 (FIG. 1) provide enough relief at the bottom of the product 100 to accept a product of any suitable length which the insert can accommodate.

Attention is invited to the second embodiment of the invention which is directed to a corrugated fibreboard blank 220 (FIG. 9A) which may be folded to form an insert 310 for receiving and protecting a product 100. Dot-dashed lines show where the blank 220 folds. Solid lines show where the blank 220 is cut. Hash marks, such as shown at 221, identify lines which are partially or almost cut through, as by knicked knives, so that they will initially fold as a unit, but will break apart when the blank 220 reaches a final fold. These partially cut lines 221 divide the blank 220 into three parts which will become a central air cell having a cradle air cell on each end.

A generally rectangular and integrally formed blank 220 is divided longitudinally into a bottom panel 222 flanked by side panels 224, 225 joined to outer panels 226, 227. The bottom panel 222 has a rectangular central bottom panel 228 with opposite sides at fold lines 230, 232 and ends 234, 236. The side panels 224, 225 have splayed panels 238, 240 joined to the central bottom panel 228.

The central bottom panel 228 has a panel 292 provided therein which is defined by solid lines 294*a*, 294*b*, 294*c*, which as defined above is where the blank 220 is cut, and by a dot-dashed line 296, which as defined above is where the blank 220 is folded. The solid line 294*a* is provided along a portion of the fold line 230 and solid line 294*c* is provided along a portion of the fold line 232. The solid line 294*b* extends from one end of the solid line 294*a* to one end of the solid line 294*c*. The dot-dashed line 296 extends from an opposite end of the solid line 294*a* to an opposite end of the solid line 294*c*. The solid line 294*b* further defines a tab portion 298 of the panel 292. The purpose of the panel 292 and of the tab portion 298 of the panel 292 will be discussed further herein in connection with the formation of the insert 310 of the second embodiment from the blank 220.

The side panels 224, 225 are joined to the outer panels 226, 227 which have bottom air cell panels 242, 244 joined to the splayed panels 238, 240. The splayed panels 238, 240 and the bottom air cell panels 242, 244 will fold to form an air cell below the central bottom panel 228. The bottom air cell panel 242 has a hole 243 provided therethrough. The hole 243 is sized and positioned such that upon formation of the insert 310 of the second embodiment, the hole 243 can receive and lock the tab portion 298 of the panel 292 therein in order to hold the panel 292 in place, as will be discussed further herein.

A central cradle panel 254, 256 is formed at each end of the central bottom panel 228. The side panels 224, 225 and the outer panel 226, 227 have intermediate and outer cradle panels 262, 264 and 266, 268, respectively, which fold to form an air cell behind the central cradle panels 254, 256. Similar cradle panels (identified by the suffix (a)) are formed on the opposite ends of the outer panels 226, 227. Therefore, air cells are formed on each end and at the bottom of the insert formed by blank 220. Product anchoring tabs or flaps 270, 272, 274, 276, 278, 280 are formed on the central cradle panels 254, 256.

The intermediate cradle panels 262, 266 and the outer cradle panels 264, 268 will fold to form an air cell behind the central cradle panels 254, 256. In greater detail, the outer cradle panels 264, 268 fold and are positioned parallel to, behind, and spaced from the central cradle panel 256. The outer cradle panels 264, 268 are in face to face contact at which time, they are locked together when tab 282 is pushed through hole 284 and when somewhat keystone shaped tabs 285, 287 are bent into the air cell. The tab 282 has a somewhat mushroom shape to provide a handle for two fingers after it is pushed into hole 284.

The splayed panels 238, 240 and their bottom air cell panels 242, 244 are separated from the intermediate cradle panels 262, 266 and from their outer cradle panels 264, 268 by lines 290 which are partially cut by knicked knives, as indicated by twin hash marks such as those shown at 221. That is to say, the corrugated fibreboard is almost, but not quite, cut through.

Three product anchor flaps or tabs 270, 272, 274 and 276, 278, 280 are formed in the central cradle panels 254, 256 on opposite ends 258, 260 of the bottom panel 222. Preferably, these anchor flaps 270, 272, 274, 276, 278, 280 have an irregular shape in order to accommodate different end profiles of the product packaged in the cartridge insert. In greater detail, these flaps 270, 272, 274, 276, 278, 280 push out to receive and hold lower corners of the product 100. The opposite ends of the outer panel 226 have locking tabs 282, 282*a* which fit into holes 284, 284*a*, respectively, of the outer panel 227 in order to lock the formed air cell in place. By a selection of these irregular shapes, it is possible to design one insert to receive, for instance, three different cartridges.

Figure 9A:
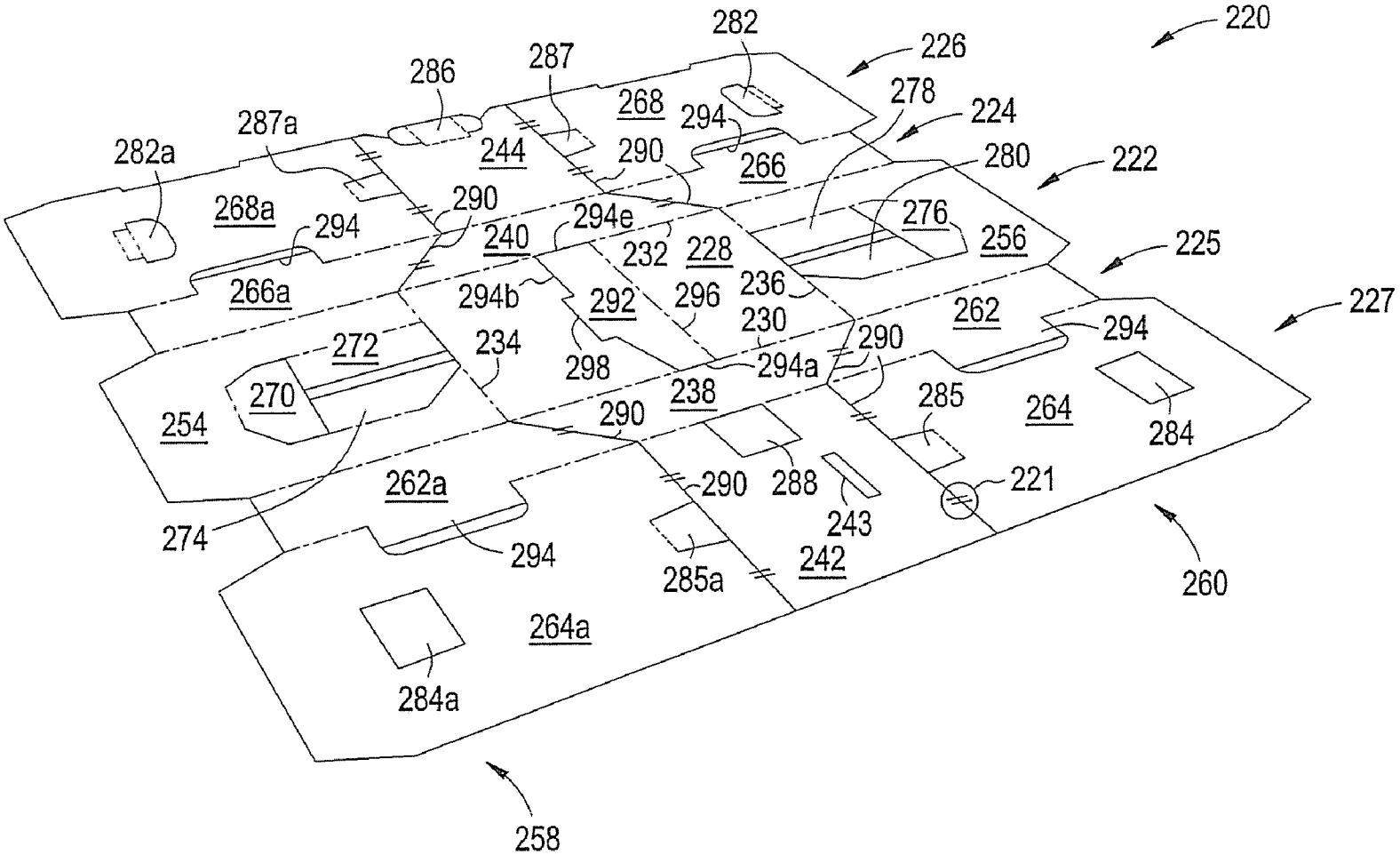
FIG. 9A is a perspective view of a corrugated fibreboard blank which is used for the formation of the insert of a second embodiment of the invention.
Figure 9B:
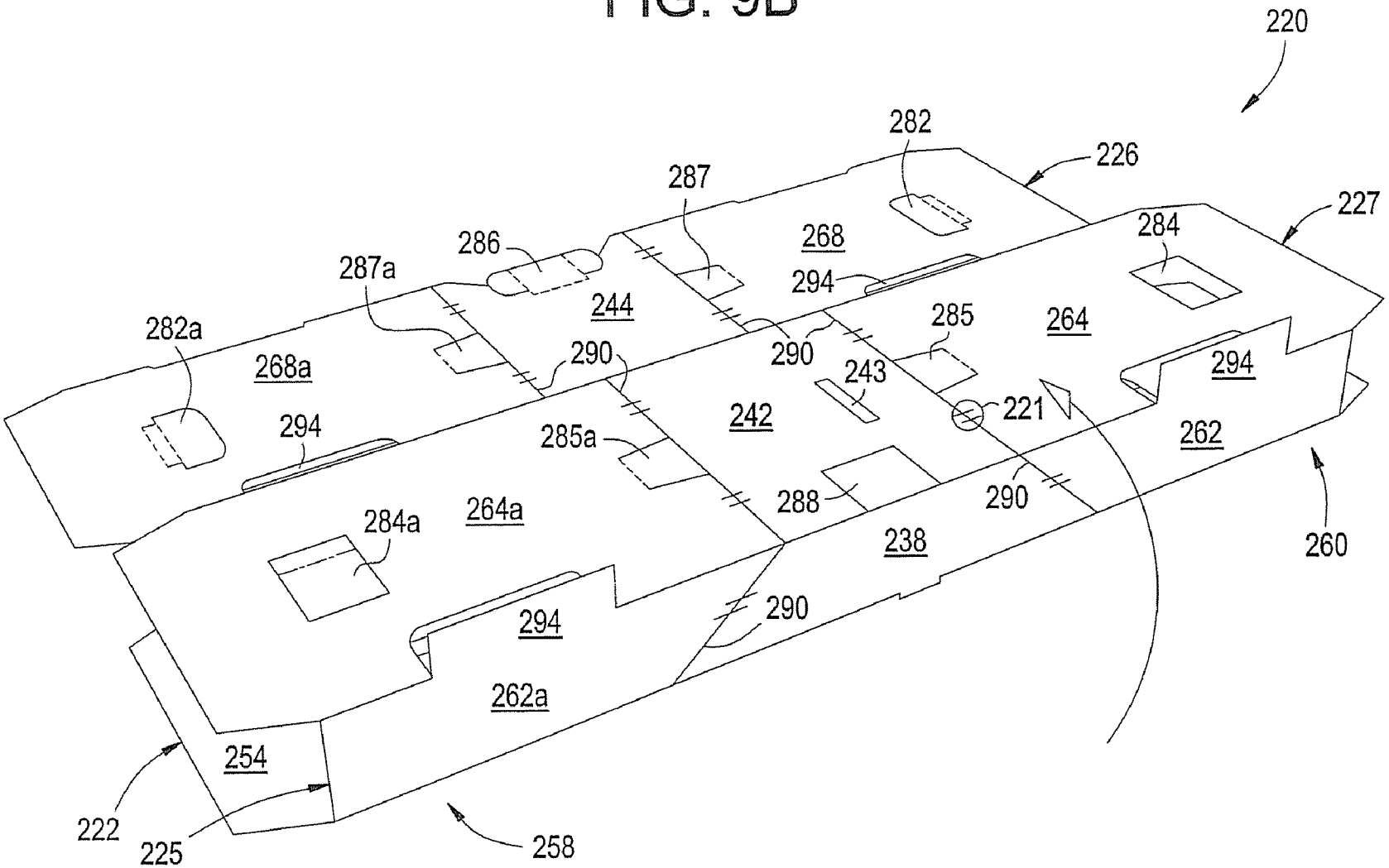
FIGS. 9B-9F are stop motion illustrating how the corrugated fibreboard blank of FIG. 9A is folded to form the insert of the second embodiment of the invention.

The use of the blank 220 (FIG. 9A) begins with FIG. 9B which is a first step where the side panel 225 is folded to stand perpendicular to the bottom panel 222. Then, the outer panel 227 is folded to be parallel to the bottom panel 222 and perpendicular to the side panel 225.

Figure 9C:
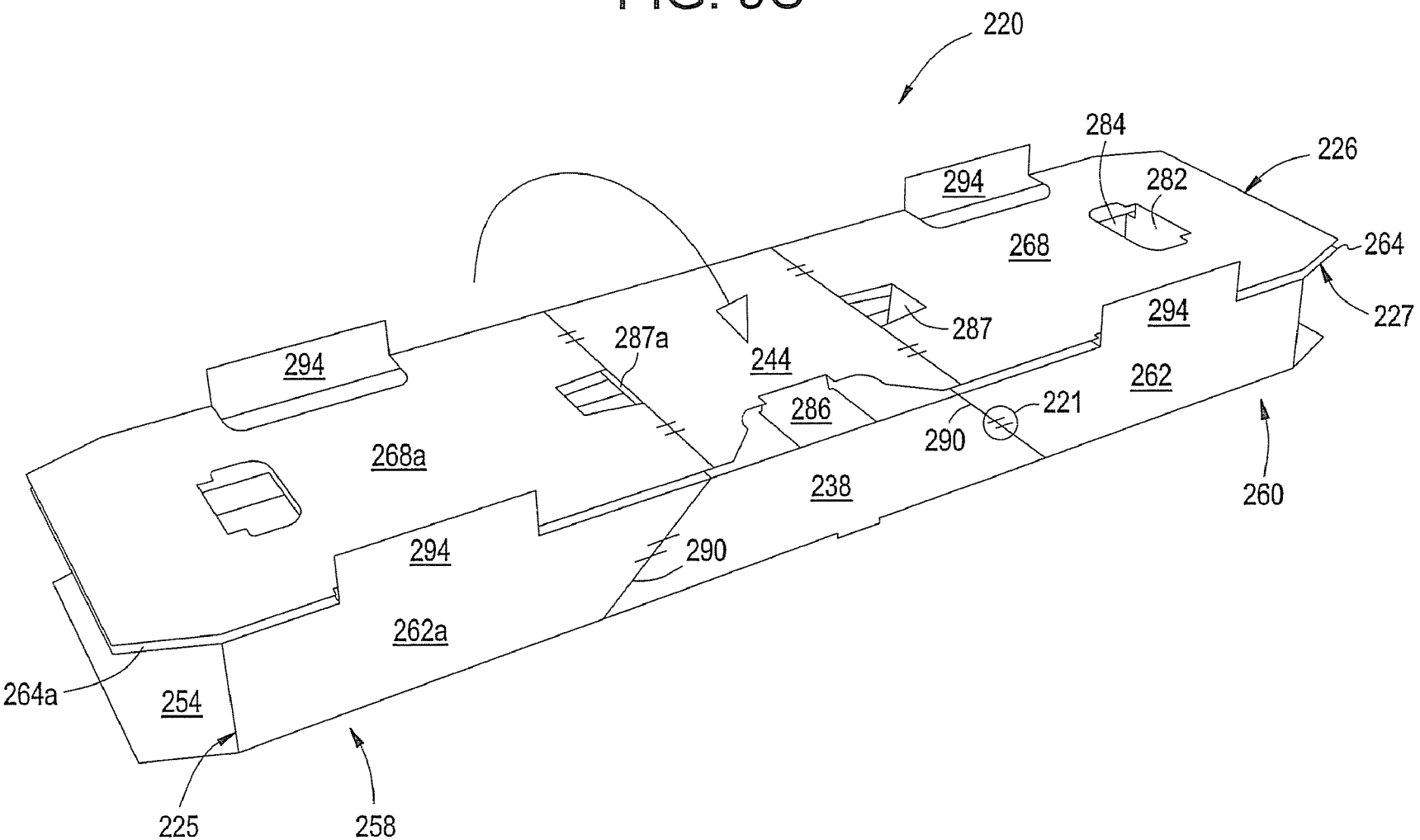

In FIG. 9C, the side panel 224 (not seen in FIG. 9C) is folded to stand perpendicular to the bottom panel 222. The outer panel 226 is folded to be perpendicular to the side panel 224, parallel to and in face-to-face contact with the outer panel 227 (see also FIG. 9B). The locking tab 286 is pushed into the locking hole 288 to secure the blank 220 in the folded configuration of FIG. 9C. The resulting structure is a generally tubular shaped structure.

It should be noted that the spacer tabs 294 are upstanding and have not folded over with the folding of the center panels 226, 227. It should also be noted that the lines 290 which were cut partially through by a knicked knife have held together so that the panels 222-227 folded as a unit and did not break apart through the folding of FIGS. 9B and 9C.

Figure 9D:
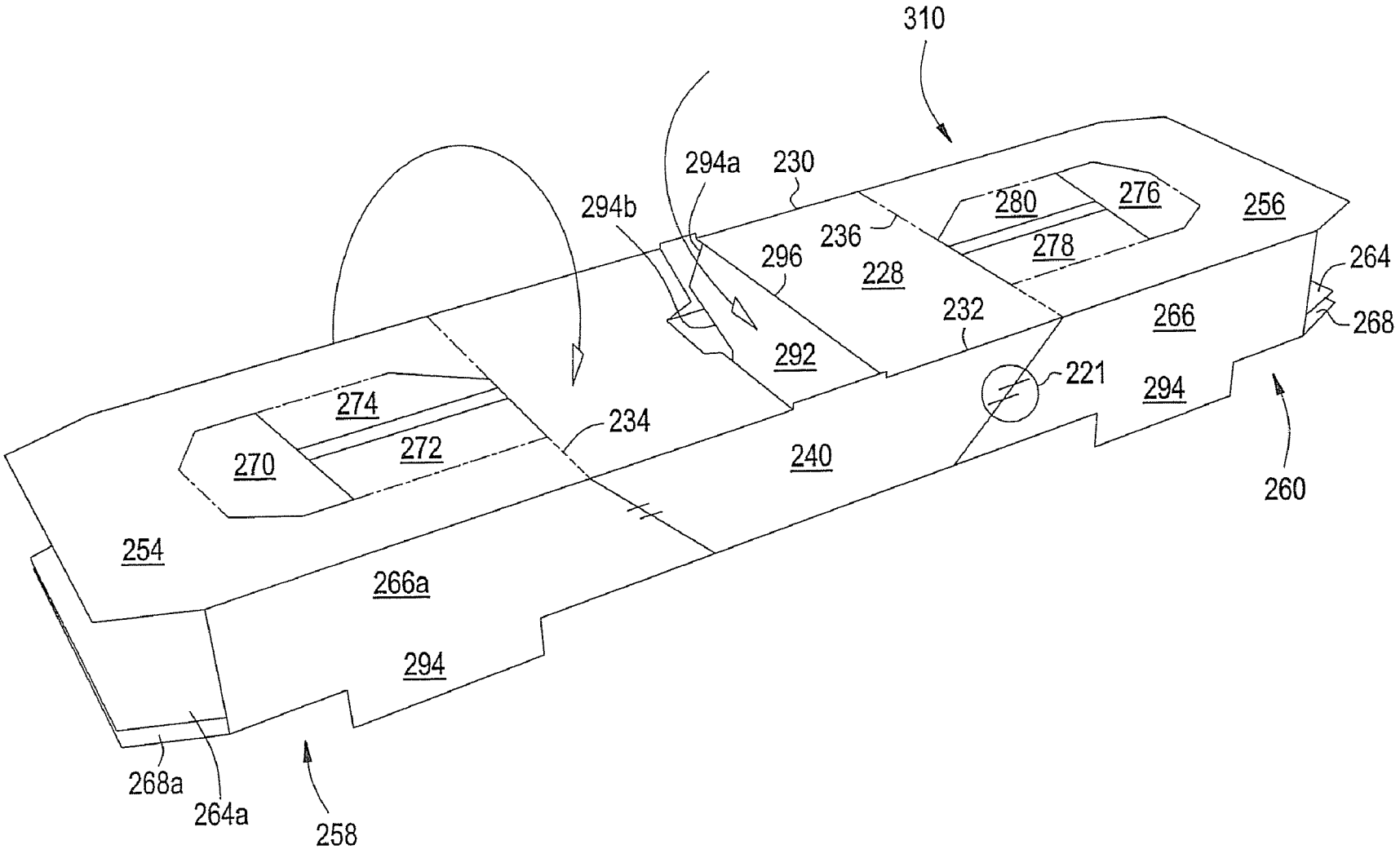
Figure 9E:
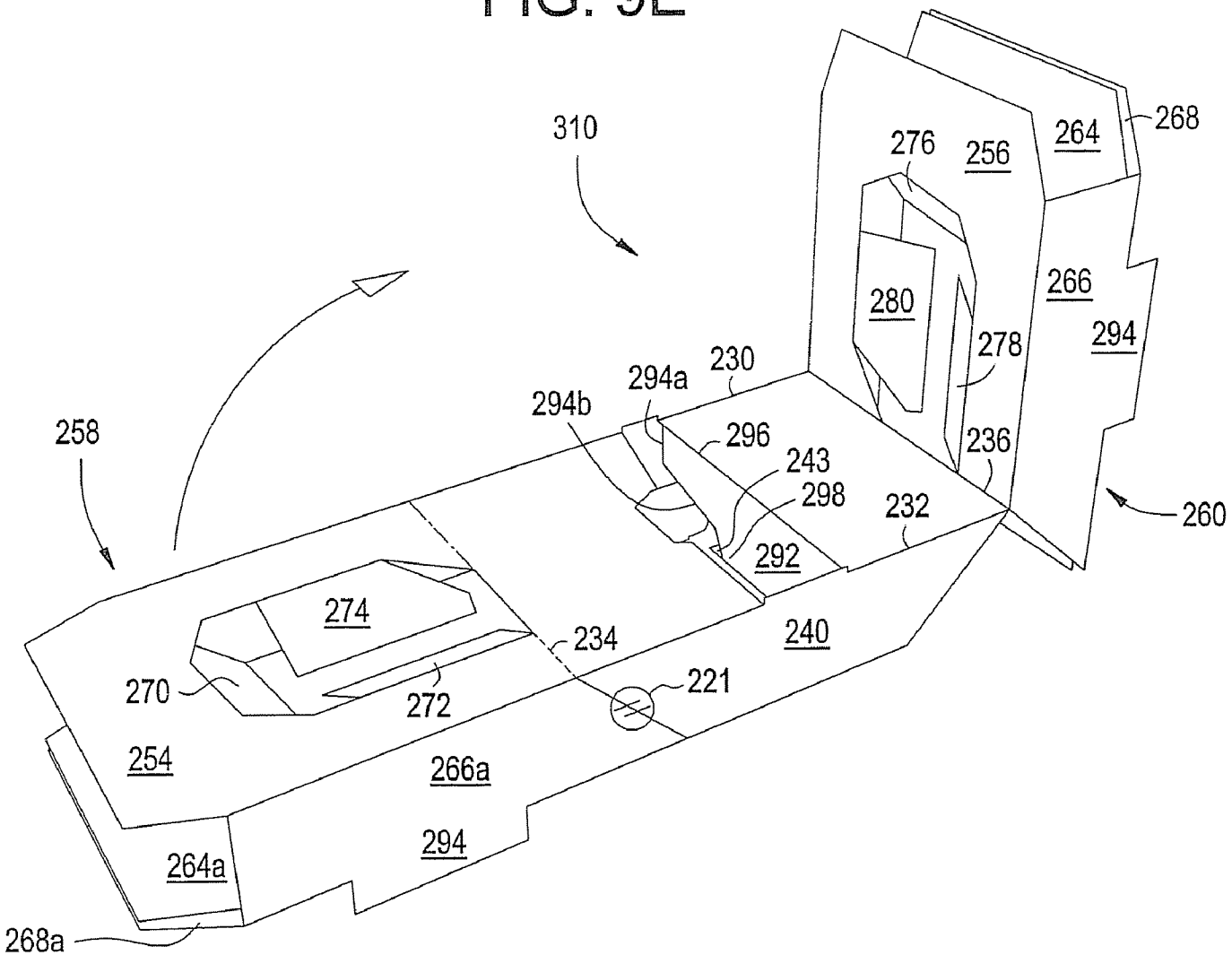

In FIG. 9D, the blank folded in FIG. 9C is flipped over so that the bottom panel 222 is on top and the outer panel 226 is on the bottom. The panel 292 is also pushed down toward the bottom air cell panel 242 until the tab portion 298 of the panel 292 is inserted into and locked within the hole 243 of the bottom air cell panel 242. The purpose of the panel 292 being locked within the hole 243 is to stabilize the bottom air cell to ensure that the bottom air cell of the insert 310 maintains its shape, preventing the insert 310 from swaying from side to side. If the panel 292 is not locked into the hole 243, the bottom air cell panel 242 and the bottom air cell, which is provided between the bottom air cell panel 242 and the bottom panel 228, has a tendency to collapse.

Then (FIG. 9E), the end 260 is folded up. The lines 290 partially cut by knicked knives were strong enough to remain intact during the folding and flipping of FIGS. 9B-9D, but are not strong enough to resist the folding of the air cell at end 260.

Figure 9F:
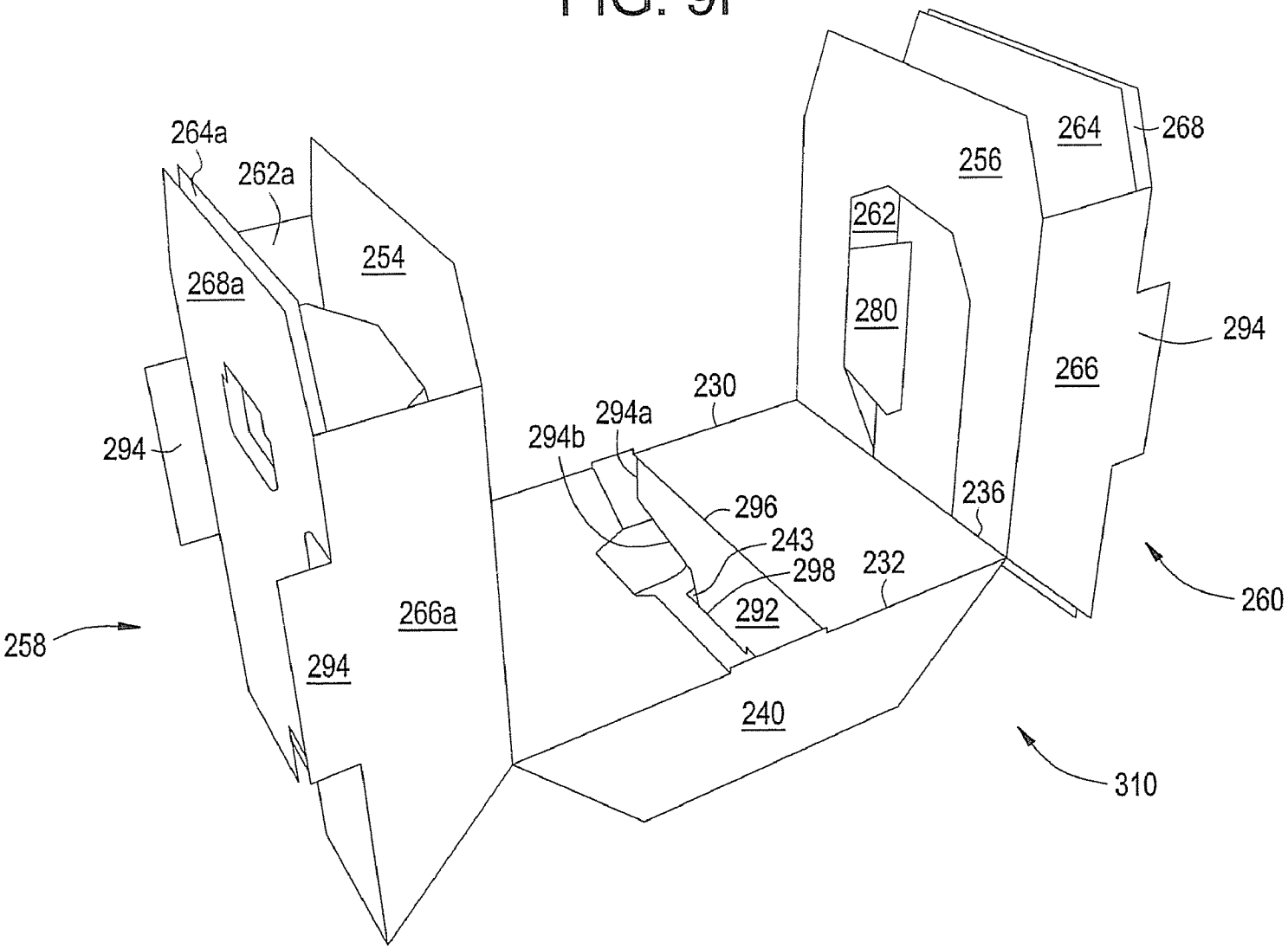

In FIG. 9F, the folding is complete when the air cell at end 258 is folded and standing approximately perpendicular to the center bottom panel 228 and parallel to the air cell at end 260. As can be seen in FIG. 9F, the insert 310 is a generally U-shaped structure when in its final form. The product anchoring tabs 270-280 are pushed in, and ready to receive the product 100. The locking tab 286 is pressed through the locking hole 288 in the same manner as the locking tab 86 is pressed through the locking hole 88 of the first embodiment of the insert, as illustrated in FIG. 4. The locking tab 286 being pressed through the locking hole 288 thus lock the panels 242, 244 in an assembled position.

Locking tab 282 is pressed through locking hole 284 to lock panels 264, 268 together in the same manner in which locking tab 82 is pressed through locking hole 84 to lock panels 64, 68 together in the first embodiment of the insert, as illustrated in FIG. 5.

An air cell is formed on each end 258, 260 of the insert 310 formed by folded blank 220. The bottom edges of panels 268, 264 and 268*a*, 264*a* are locked together by pushing somewhat keystone shaped panels 285, 287 and 285*a*, 287*a* inwardly. This is done in identical fashion as in the first embodiment of the insert as illustrated in FIG. 6.

After the air cells are formed on each of the opposite ends and the bottom of the insert 310, the product 100 is placed on the bottom panel 228 and between the product anchor flaps 270, 272, 274 and 276, 278, 280. As the end air cells are brought together, the lower corners of the product 100 are captured as they force the anchor flaps 270-274 and 276-280 outwardly. While this is not illustrated in the drawings, it is identical to that as shown in FIG. 7 with regard to the first embodiment of the insert.

Preferably, the toner cartridge is placed inside a plastic bag 130 when the packaging is complete. The assembled insert 310 and product 100 is now ready to be slid or placed in an outer box or carton in the same manner described in connection with the insert of the first embodiment of the invention, and as illustrated in FIG. 8, and therefore this discussion with not be repeated and reillustrated for brevity purposes.

Attention is invited to the third embodiment of the invention which is directed to a corrugated fibreboard blank 420 (FIG. 10A) which may be folded and adhered together to form an insert 510 for receiving and protecting a product 100. Dot-dashed lines show where the blank 420 folds. Solid lines show where the blank 420 is cut. Hash marks, such as shown at 421, identify lines which are partially or almost cut through, as by knicked knives, so that they will initially fold as a unit, but will break apart when the blank 420 reaches a final fold. These partially cut lines 421 divide the blank 420 into three parts which will become a central air cell having a cradle air cell on each end.

A generally rectangular and integrally formed blank 420 is divided longitudinally into a bottom panel 422 flanked by side panels 424, 425 joined to outer panels 426, 427. The bottom panel 422 has a rectangular central bottom panel 428 with opposite sides at fold lines 430, 432 and ends 434, 436. The side panels 424, 425 have splayed panels 438, 440 joined to the central bottom panel 428.

The central bottom panel 428 has a panel 492 provided therein which is defined by solid lines 494*a*, 494*b*, 494*c*, which as defined above is where the blank 420 is cut, and by a dot-dashed line 496, which as defined above is where the blank 420 is folded. The solid line 494*a* is provided along a portion of the fold line 430 and solid line 494*c* is provided along a portion of the fold line 432. The solid line 494*b* extends from one end of the solid line 494*a* to one end of the solid line 494*c*. The dot-dashed line 496 extends from an opposite end of the solid line 494*a* to an opposite end of the solid line 494*c*. The solid line 494*b* further defines a tab portion 498 of the panel 492. The purpose of the panel 492 and of the tab portion 498 of the panel 492 will be discussed further herein in connection with the formation of the insert 510 of the third embodiment from the blank 420.

The side panels 424, 425 are joined to the outer panels 426, 427 which have bottom air cell panels 442, 444 joined to the splayed panels 438, 440. The splayed panels 438, 440 and the bottom air cell panels 442, 444 will fold to form an air cell below the central bottom panel 428. The bottom air cell panel 442 has a hole 443 provided therethrough. The bottom air cell panel 440 has a notch 441 provided therethrough. The hole 443 and the notch 441 are sized and positioned such that upon formation of the insert 510 of the third embodiment, the hole 443 and the notch 441 can receive and lock the tab portion 498 of the panel 492 therein in order to hold the panel 492 in place, as will be discussed further herein.

A central cradle panel 454, 456 is formed at each end of the central bottom panel 428. The side panels 424, 425 and the outer panel 426, 427 have intermediate and outer cradle panels 462, 464 and 466, 468, respectively, which fold to form an air cell behind the central cradle panels 454, 456. Similar cradle panels (identified by the suffix (a)) are formed on the opposite ends of the outer panels 426, 427. Therefore, air cells are formed on each end and at the bottom of the insert formed by blank 420. Product anchoring tabs or flaps 470, 472, 474, 476, 478, 480 are formed on the central cradle panels 454, 456.

A fold line 433 is provided on the bottom panel 422 equidistantly from the fold lines 430 and 432. The fold line 433 extends through the central cradle panel 454, through the product anchoring tab 470, through the bottom panel 428, through the panel 492, through the product anchoring tab 476, and through the central cradle panel 456.

A fold line 435 is provided at the middle of the outer panel 427. The fold line 435 extends through the outer cradle panel 464*a*, the bottom air cell panel 442, and the outer cradle panel 464.

The outer panel 426 has a adhesive 483, such as a glue strip, provided thereon which extends over the middle of the outer panel 426. The adhesive 483 extends over the outer cradle panel 468*a*, through the bottom air cell panel 444, and through the outer cradle panel 468.

The intermediate cradle panels 462, 466 and the outer cradle panels 464, 468 will fold to form an air cell behind the central cradle panels 454, 456. In greater detail, the outer cradle panels 464, 468 fold and are positioned parallel to, behind, and spaced from the central cradle panel 456. The outer cradle panels 464, 468 are in face to face contact. Prior thereto, they are locked together when the blank 420 is folded along the fold lines 433, 435 such that the adhesive 483 secures the outer panel 426 to the outer panel 427.

The splayed panels 438, 440 and their bottom air cell panels 442, 444 are separated from the intermediate cradle panels 462, 466 and from their outer cradle panels 464, 468 by lines 490 which are partially cut by knicked knives, as indicated by twin hash marks such as those shown at 421. That is to say, the corrugated fibreboard is almost, but not quite, cut through.

Three product anchor flaps or tabs 470, 472, 474 and 476, 478, 480 are formed in the central cradle panels 454, 456 on opposite ends 458, 460 of the bottom panel 422. Preferably, these anchor flaps 470, 472, 474, 476, 478, 480 have an irregular shape in order to accommodate different end profiles of the product packaged in the cartridge insert. In greater detail, these flaps 470, 472, 474, 476, 478, 480 push out to receive and hold lower corners of the product 100. By a selection of these irregular shapes, it is possible to design one insert to receive, for instance, three different cartridges.

Figures 10A, 10B:
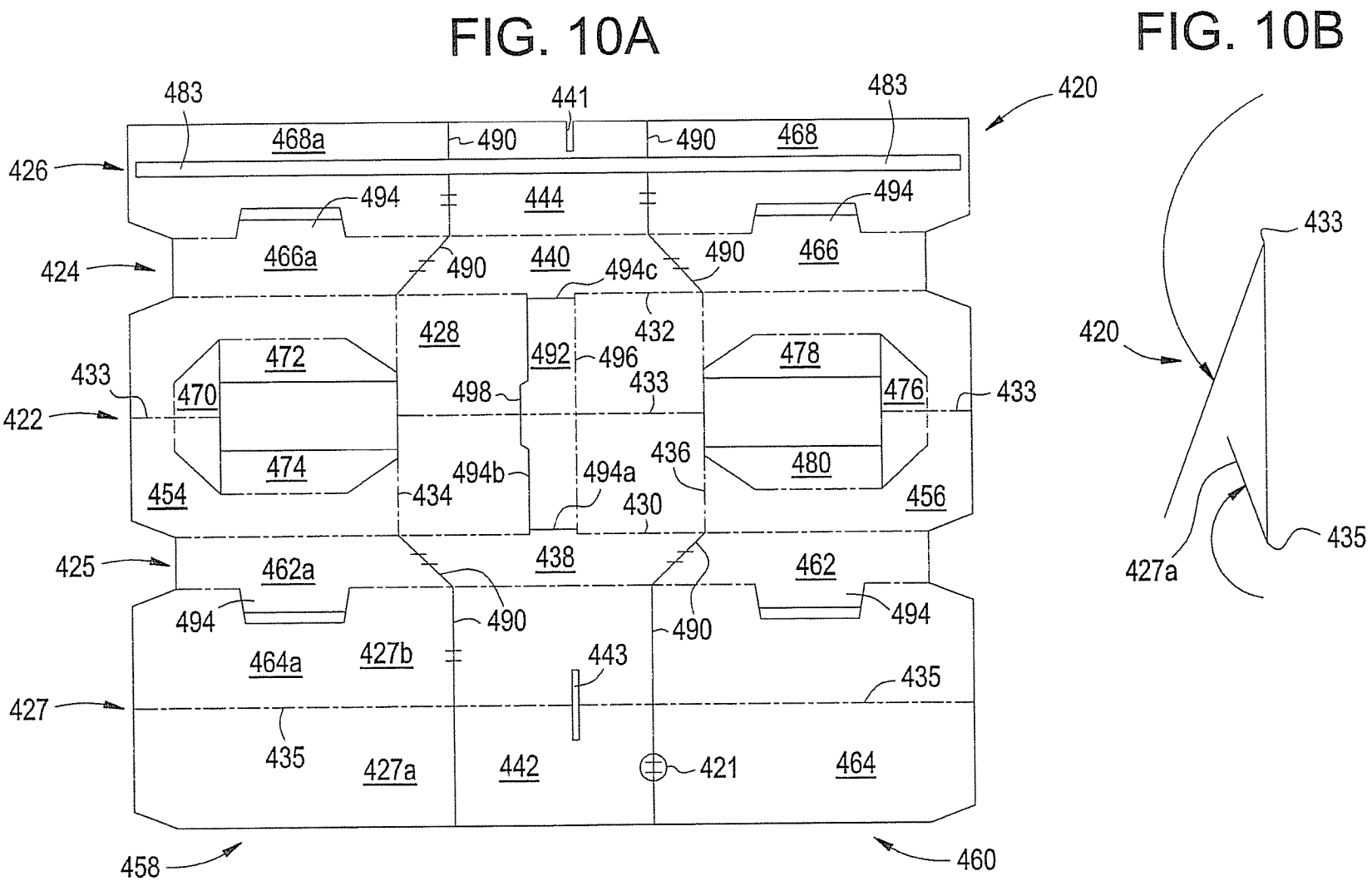
FIG. 10A is a perspective view of a corrugated fibreboard blank which is used for the formation of the insert of a third embodiment of the invention.
FIGS. 10B-10F are stop motion illustrating how the corrugated fibreboard blank of FIG. 10A is folded to form the insert of the third embodiment of the invention.

The use of the blank 420 (FIG. 10A) begins with folding the blank 420, as illustrated in FIG. 10B, along the fold line 435 such that the outer panel 427 is folded into two parts 427*a*, 427*b* with part 427*a* being folded over on top of part 427*b*. The blank 420 is then folded along the fold line 433 such that the outer panel 426 having the adhesive 483 thereon comes into contact with the part 427*a* of the outer panel 427, and such that the notch 441 is in communication with the hole 443. The adhesive 483 thus secures the outer panel 426 to the part 427*a* of the outer panel 427*a*. The blank 420 is thus formed into the flat configuration illustrated in FIG. 10C.

Figure 10C:
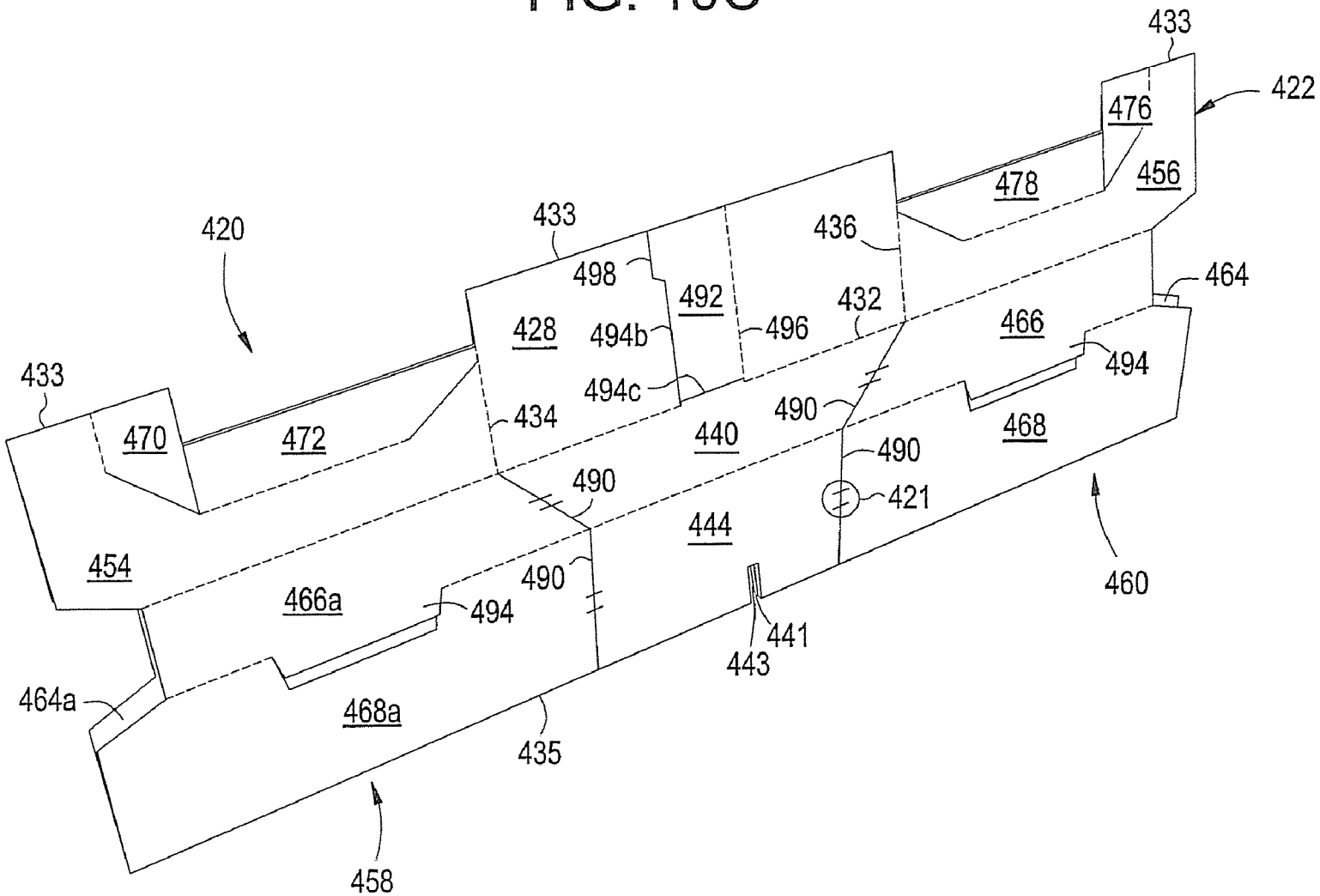
Figure 10D:
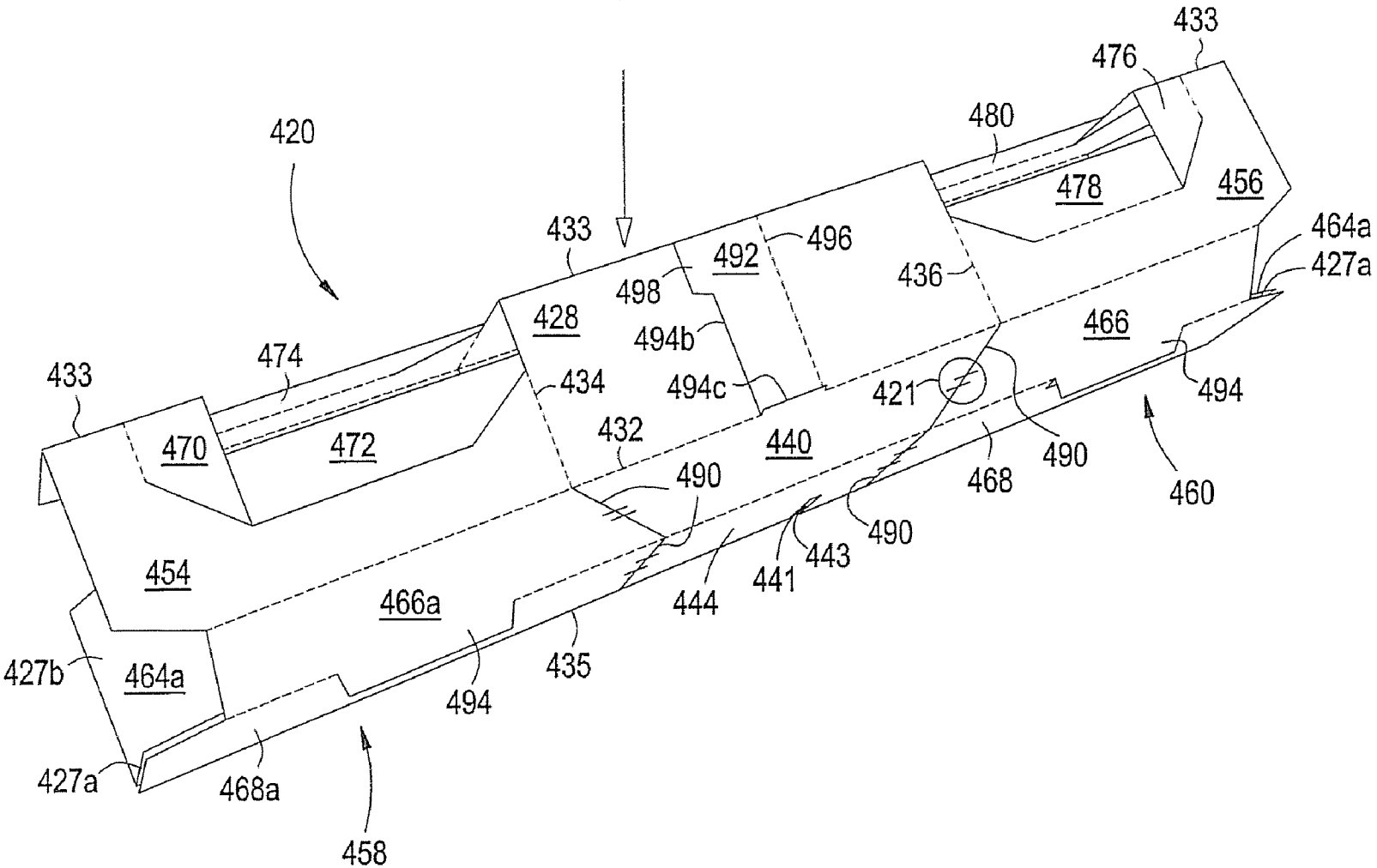

In FIG. 10D, the blank 420 is pushed downwardly along the fold line 433 such that the tubular insert 510 is formed by the blank 420 being folded along the fold lines 430, 432, and the fold lines separating the outer panels 426, 427 from the side panels 424, 425, respectively. Thus, the side panel 424 (not seen in FIG. 10D) is folded to stand perpendicular to the bottom panel 422. The outer panel 426 is folded to be perpendicular to the side panel 424, parallel to and in face-to-face contact with the outer panel 427. The blank 420 is secured in the folded configuration of FIG. 10D because of the adhesive 483 of the outer panel 426 being secured to the part 427*a* of the outer panel 427. The resulting structure is a generally tubular shaped structure.

It should be noted that the spacer tabs 494 are upstanding and have not folded over with the folding of the center panels 426, 427. It should also be noted that the lines 490 which were cut partially through by a knicked knife have held together so that the panels 422-427 folded as a unit and did not break apart through the folding of FIGS. 10C and 10D.

Figure 10E:
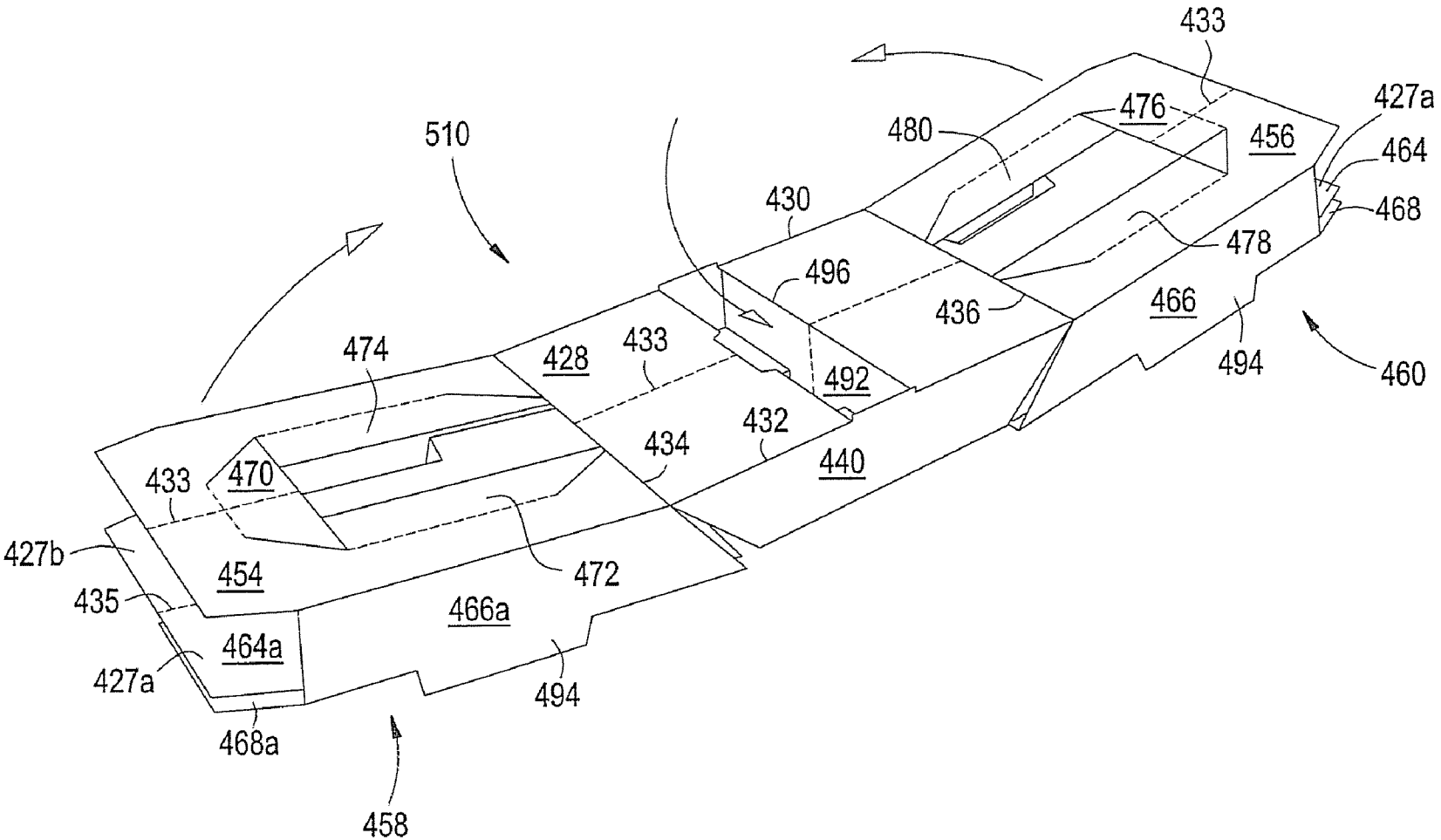

In FIG. 10E, the panel 492 is pushed down toward the bottom air cell panel 442 until the tab portion 498 of the panel 492 is inserted into and locked within the hole 443 of the bottom air cell panel 442 and the notch 441 of the bottom air cell panel 444. The purpose of the panel 492 being locked within the hole 443 and the notch 441 is to ensure that the bottom air cell of the insert 510 maintains its shape, preventing the insert 510 from swaying from side to side. If the panel 492 is not locked into the hole 443 and the notch 441, the bottom air cell panel 442 and the bottom air cell, which is provided between the bottom air cell panel 442 and the bottom panel 428, has a tendency to collapse.

As illustrated in FIG. 10E, the ends 458, 460 are also folded up. The lines 490 partially cut by knicked knives were strong enough to remain intact during the folding and flipping of FIGS. 10C-10D, but are not strong enough to resist the folding of the air cell at ends 458, 460.

Figure 10F:
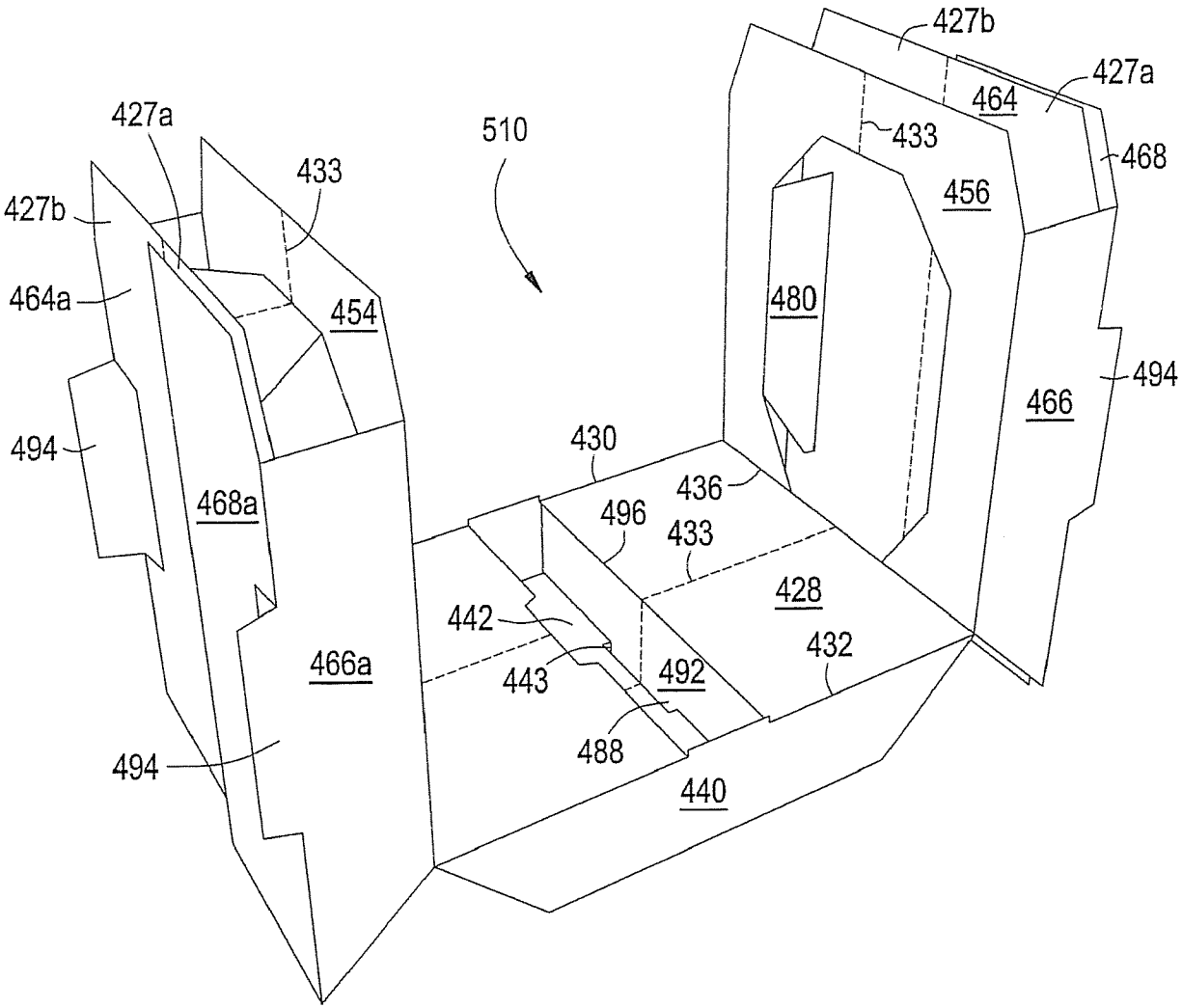

In FIG. 10F, the folding is complete when the air cell at end 458 is folded and standing approximately perpendicular to center bottom panel 428 and parallel to the air cell at end 460. As can be seen in FIG. 10F, the insert 510 is a generally U-shaped structure when in its final form. The product anchoring tabs 470-480 are pushed in, and ready to receive the product 100. An air cell is formed on each end of the insert 510 formed by the folded blank 420.

After the air cells are formed on each of the opposite ends 458, 460 and the bottom of the insert 510, the product 100 is placed on the bottom panel 428 and between the product anchor flaps 470, 472, 474 and 476, 478, 480. As the end air cells are brought together, the lower corners of the product 100 are captured as they force the anchor flaps 470-474 and 476-480 outwardly. While this is not illustrated in the drawings, it is identical to that as shown in FIG. 7 with regard to the first embodiment of the insert.

Preferably, the toner cartridge is placed inside a plastic bag 130 when the packaging is complete. The assembled insert 510 and product 100 is now ready to be slid or placed in an outer box or carton in the same manner described in connection with the insert of the first embodiment of the invention, and as illustrated in FIG. 8, and therefore this discussion with not be repeated and reillustrated for brevity purposes.

It should be noted that the blank 420 which forms the insert 510 of the third embodiment of the invention, could be formed without the panel 492 in the bottom panel 428, similar to the insert of the first embodiment of the invention.

It should further be noted that the blank 420 has the advantage of being shipped to a customer in an already partially formed insert. The blank 420 can be prepared by the manufacturer of the blank 420 to the configuration of the blank 420 as illustrated in FIG. 10C. Thus, the blank 420 can still be shipped flat to the customer and the customer does not need to do as many assembly steps prior to securing the product 100 into the insert 510 of the third embodiment. The gluing of the blank 20 also saves the manufacturer from extra costs involved in manually securing the anchoring tabs or flaps in the anchoring holes. In other words, once the customer receives the blank 420, the customer need only perform the steps illustrated in FIGS. 10D-10F.

Figure 11:
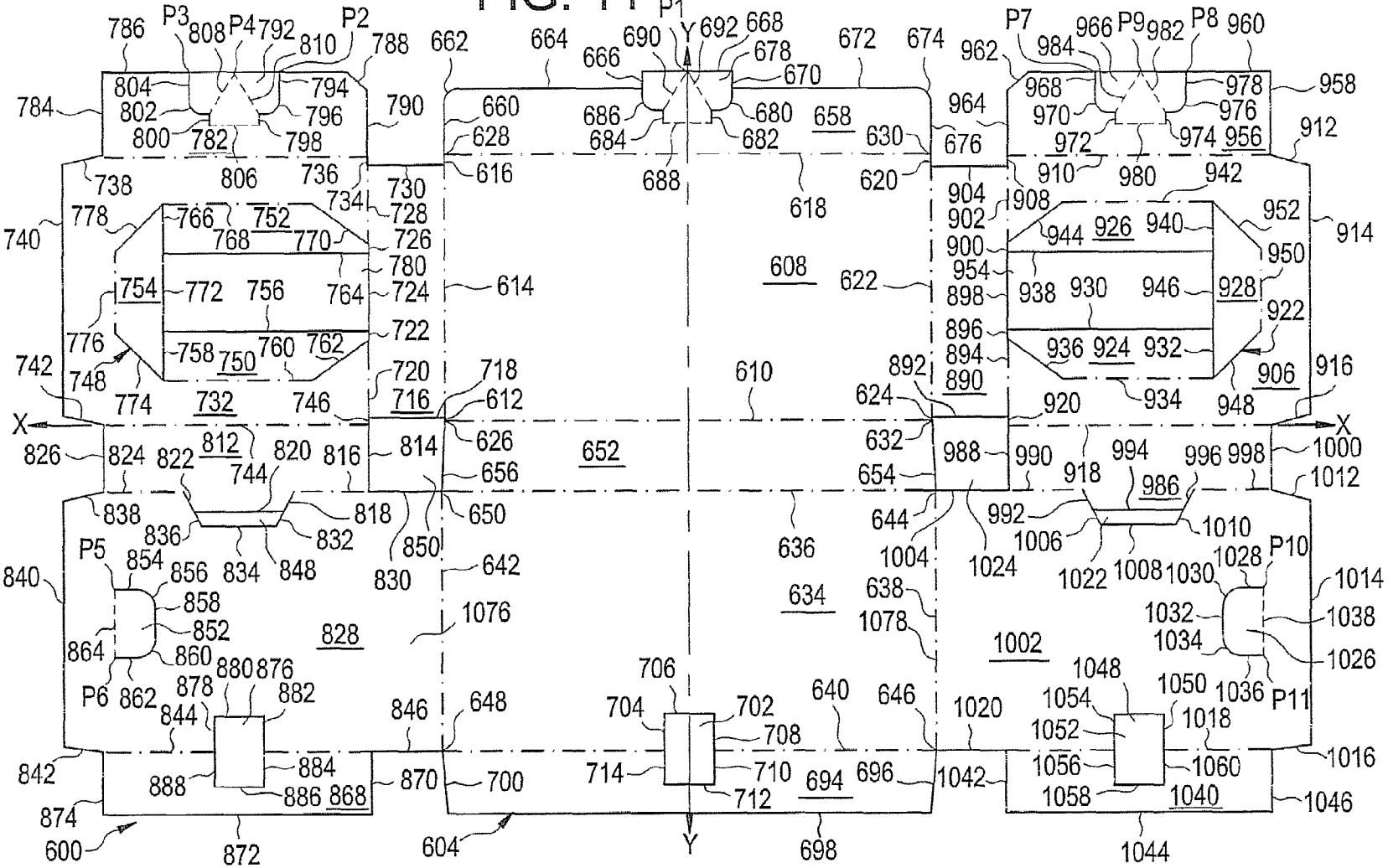
FIG. 11 is a top plan view of a corrugated fibreboard blank which is used for the formation of the insert of the fourth embodiment of the invention.
Figure 12:
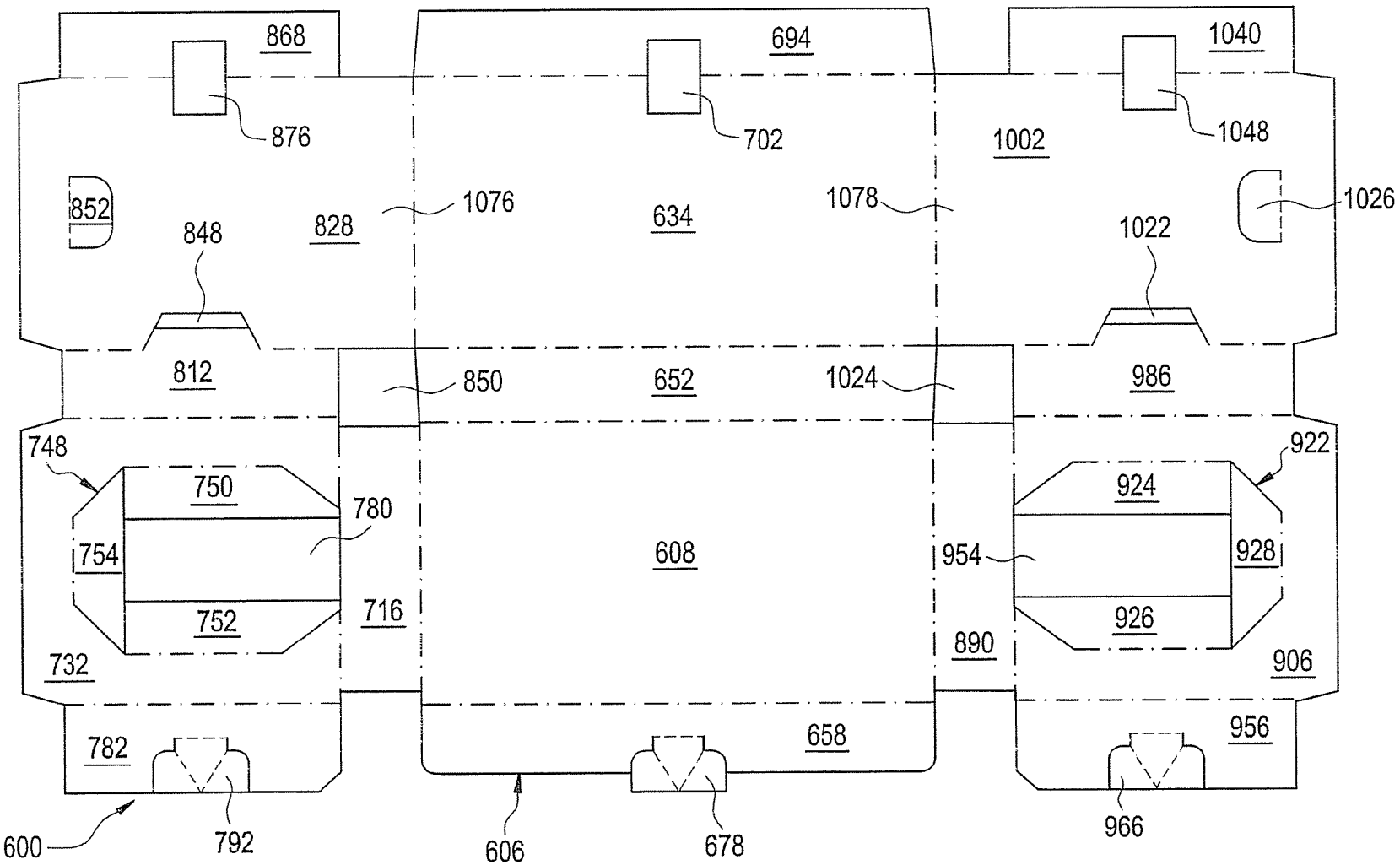
FIG. 12 is a bottom plan view of the corrugated fibreboard blank illustrated in FIG. 11.
Figure 13:
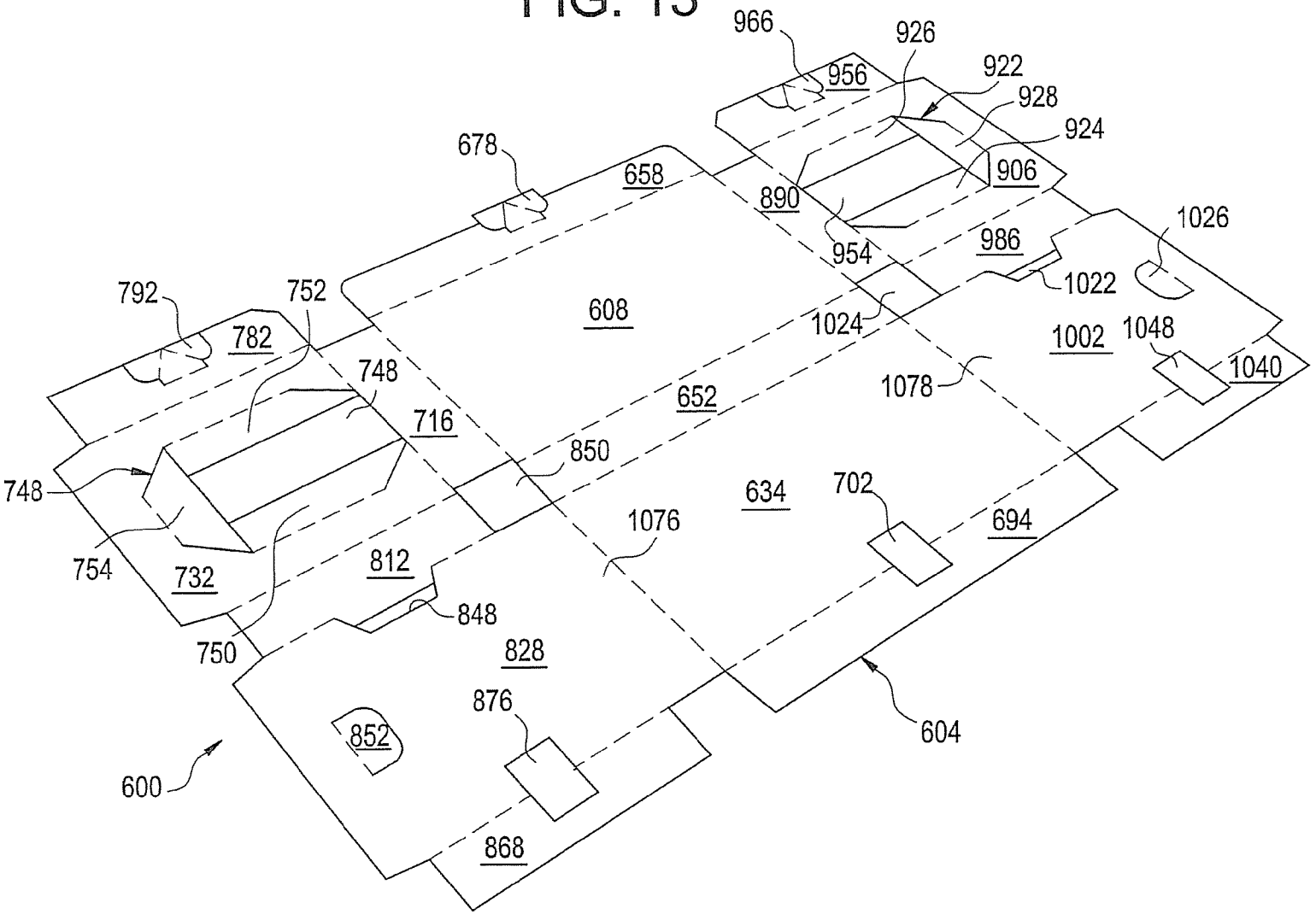
FIG. 13 is a perspective view of the corrugated fibreboard blank illustrated in FIG. 11.

Attention is invited to the fourth embodiment of the invention and FIGS. 11-22. FIGS. 11-13 illustrate a blank 600 which may be folded to form an insert 602 for receiving, protecting and securing a product 100, such as a toner cartridge. The insert 602 with the product 100 secured therein, can then be inserted into a carton or box (not shown, but similar to the box 134 illustrated in FIG. 8) for shipping and storage. The blank 600 is preferably formed of corrugated fibreboard. The blank 600 has a top surface 604, which is illustrated in FIG. 11, and a bottom surface 606, which is illustrated in FIG. 12.

A horizontal reference line X-X is provided in FIG. 11. It is to be understood that hereinafter in the description of the blank 600, which is provided below the horizontal reference line X-X as viewed in FIG. 11, that the terms "upward" and/or "upwardly" will be used to describe elements, such as fold lines, cut lines and edges, which extend toward the horizontal reference line X-X, and that the terms "downward" and/or "downwardly" will be used to describe elements, such as fold lines, cut line and edges, which extend away from the horizontal reference line X-X. It is further to be understood that hereinafter in the description of the blank 600, which is provided above the horizontal reference line X-X as viewed in FIG. 11, that the terms "upward" and/or "upwardly" will be used to describe elements, such as fold lines, cut lines and edges, which extend away from the horizontal reference line X-X, and that the terms "downward" and/or "downwardly" will be used to describe elements, such as fold lines, cut lines and edges, which extend toward the horizontal reference line X-X.

A vertical reference line Y-Y is provided in FIG. 11. It is to be understood that hereinafter in the description of the blank 600 that the terms "outward" and/or "outwardly" will be used to describe elements, such as fold lines, cut lines and edges, which extend away from the vertical reference line Y-Y. It is further to be understood that hereinafter in the description of the blank 600 that the terms "inward" and/or "inwardly" will be used to describe elements, such as fold lines, cut lines and edges, which extend toward the vertical reference line Y-Y.

The blank 600 has a first bottom panel 608 which is generally rectangular in configuration. The first bottom panel 608 is defined by fold line 610, cut line 612, fold line 614, edge 616, fold line 618, edge 620, fold line 622, and cut line 624. Fold line 610 extends a distance of twelve and one-quarter (12.25) inches. Cut line 612 extends a distance of three-sixteenths (0.1875) inches. Fold line 614 extends a distance of six and seven-sixteenths (6.4375) inches. Edge 616 extends a distance of five-sixteenths (0.3125) inches. Fold line 618 extends a distance of twelve and one-quarter (12.25) inches. Edge 620 extends a distance of five-sixteenths (0.3125) inches. Fold line 622 extends a distance of six and seven-sixteenths (6.4375) inches. Cut line 624 extends a distance of three-sixteenths (0.1875) inches.

Fold line 610 is generally perpendicular to cut line 612. Fold line 610 and cut line 612 meet to define a first corner 626 of the first bottom panel 608. Cut line 612 is connected to, and planar with, fold line 614. Fold line 614 is connected to, and planar with, edge 616. Edge 616 is generally perpendicular to fold line 618. Edge 616 and fold line 618 meet to define a second corner 628 of the first bottom panel 608. Fold line 618 is generally perpendicular to edge 620. Fold line 618 and edge 620 meet to define a third corner 630 of the first bottom panel 608. Edge 620 is connected to, and planar with, fold line 622. Fold line 622 is connected to, and planar with, cut line 624. Cut line 624 is generally perpendicular to fold line 610. Cut line 624 and fold line 610 meet to define a fourth corner 632 of the first bottom panel 608. Fold lines 610, 618 are generally opposite and parallel to one another. Fold lines 614, 622 are generally opposite and parallel to one another. Cut lines 612, 624 are generally opposite and parallel to one another. Edges 616, 620 are generally opposite and parallel to one another.

The blank 600 has a second bottom panel 634 which is generally rectangular in configuration. The second bottom panel 634 is defined by fold line 636, fold line 638, fold line 640, and fold line 642. Fold line 636 extends a distance of twelve and one-half (12.5) inches. Fold line 638 extends a distance of six and thirteen-sixteenths (6.8125) inches. Fold line 640 extends a distance of twelve and one-half (12.5) inches. Fold line 642 extends a distance of six and thirteen-sixteenths (6.8125) inches.

Fold line 636 is generally perpendicular to fold line 638. Fold line 636 and fold line 638 meet to define a first corner 644 of the second bottom panel 634. Fold line 638 is generally perpendicular to fold line 640. Fold line 638 and fold line 640 meet to define a second corner 646 of the second bottom panel 634. Fold line 640 is generally perpendicular to fold line 642. Fold line 640 and fold line 642 meet to define a third corner 648 of the second bottom panel 634. Fold line 642 is generally perpendicular to fold line 636. Fold line 642 and fold line 636 meet to define a fourth corner 650 of the second bottom panel 634. Fold lines 636, 640 are generally opposite and parallel to one another. Fold lines 638, 642 are generally opposite and parallel to one another.

The first bottom panel 608 and the second bottom panel 634 are connected to one another by a bottom, intermediate connecting panel 652. The bottom, intermediate connecting panel 652 is generally trapezoidal in configuration. The bottom, intermediate connecting panel 652 is defined by fold line 610, cut line 654, fold line 636, and cut line 656. Fold lines 620, 636 are generally opposite and parallel to one another. Cut lines 654, 656 are generally opposite one another.

Cut line 654 extends downwardly and outwardly, at an angle, from the fourth corner 632 of the first bottom panel 608 to the first corner 644 of the second bottom panel 634, as the first corner 644 of the second bottom panel 634 is positioned outwardly from the fourth corner 632 of the first bottom panel 608 by one-eighth (0.125) inches. Cut line 632 is connected to, and may be planar or non-planar, with cut line 654.

Cut line 656 extends downwardly and outwardly, at an angle, from the first corner 626 of the first bottom panel 608 to the fourth corner 650 of the second bottom panel 634, as the fourth corner 650 of the second bottom panel 634 is positioned outwardly from the first corner 626 of the first bottom panel 608 by one-eighth (0.125) inches. Cut line 612 is connected to, and may be planar or non-planar with, cut line 656.

The blank 600 has a first, bottom outer panel 658 connected to the first bottom panel 608. The first, bottom outer panel 658 is defined by fold line 618, edge 660, edge 662, edge 664, edge 666, edge 668, edge 670, edge 672, edge 674, and edge 676. Edge 660 extends a distance of one and one-quarter (1.25) inches. Edge 662 curves at a radius of one-half (0.5) inches. Edge 664 extends a distance of four and a one-half (4.5) inches. Edge 666 extends a distance of seven-sixteenths (0.4375) inches. Edge 668 extends a distance of two and one-quarter (2.25) inches. Edge 670 extends a distance of seven-sixteenths (0.4375) inches. Edge 672 extends a distance of four and one-half (4.5) inches. Edge 674 curves at a radius of one-half (0.5) inches. Edge 676 extends a distance of one and one-quarter (1.25) inches.

Edge 660 is generally perpendicular to fold line 618, extends upwardly from the second corner 628 of the first bottom panel 608, and is connected to, and co-planar with, edge 616. Edge 662 curves upwardly and inwardly from edge 660 to connect to edge 664. Edge 664 extends generally opposite and parallel to fold line 618. Edge 666 extends upwardly from edge 664 and is generally perpendicular thereto. Edge 668 extends inwardly from edge 666 to edge 670. Edge 670 extends downwardly from edge 668. Edge 668 is generally perpendicular to edges 666, 670 and edges 666, 670 are generally opposite and parallel to one another. Edge 672 extends outwardly from edge 670 and is generally perpendicular thereto. Edge 674 curves downwardly and outwardly from edge 672 to edge 676. Edge 676 extends downwardly from edge 674 to the third corner 630 of the first bottom panel 608. Edge 676 is generally opposite and parallel to edge 660, and is connected to, and co-planar with, edge 620.

The first bottom outer panel 658 is provided with a tab member 678. The tab member 678 is defined by the edges 666, 668, 670, cut line 680, cut line 682, cut line 684, and cut line 686. A fold line 688 may also be provided to define tab member 678. Cut lines 680, 686 curve at a radius of three-eighths (0.375) inches. Cut lines 682, 684 extend a distance of five-sixteenths (0.3125) inches.

Cut line 680 curves downwardly and inwardly from the connection of edges 670, 672 to cut line 682. Cut line 682 extends downwardly from cut line 680 and is generally parallel to edge 670. Cut line 686 curves downwardly and inwardly from the connection of edges 664, 666 to cut line 684. Cut line 684 extends downwardly from cut line 686 and is generally parallel to edge 666, and is generally opposite and parallel to cut line 682. A fold line 688 may be provided which extends completely or partially between cut lines 682, 684, as illustrated in FIG. 11.

A point P1 is provided along edge 668 which is equidistant from both edge 666 and edge 670, such that the point P1 is distanced two and one-quarter (2.25) inches from edge 666 and from edge 670. A fold line 690 is provided on the tab member 678 which extends angularly downwardly and outwardly from point P1 to the connection of cut lines 684, 686. A fold line 692 is provided on the tab member 678 which extends angularly downwardly and outwardly from point P1 to the connection of cut lines 680, 682.

The blank 600 has a second, bottom outer panel 694 connected to the second bottom panel 634, which is generally trapezoidal in configuration. The second, bottom outer panel 694 is defined by fold line 640, edge 696, edge 698, and edge 690. Edge 698 extends a distance of twelve and one-quarter (12.25) inches. Edge 698 is generally opposite and parallel to fold line 640.

Edge 696 extends downwardly and inwardly, at an angle, from the second corner 646 of the second bottom panel 634 to the edge 698, as the second corner 646 of the second bottom panel 634 is positioned outwardly from the connection of the edges 696, 698 by one-eighth (0.125) inches.

Edge 700 extends downwardly and inwardly, at an angle, from the third corner 648 of the second bottom panel 634 to the edge 698, as the third corner 648 of the second bottom panel 634 is positioned outwardly from the connection of the edges 698, 700 by one-eighth (0.125) inches. Edges 696, 700 are generally opposite one another.

An aperture 702 is provided through the second bottom panel 634 and the second bottom outer panel 694. The aperture 702 is generally rectangular in configuration and is defined by cut lines 704, 706, 708, 710, 712, and 714. Cut line 704 extends upwardly from fold line 640 at a distance of five and five-eighths (5.625) inches from the third corner 648 of the second bottom panel 634. Cut line 704 extends a distance of one (1) inch. Cut line 706 extends inwardly from cut line 704 to cut line 708 a distance of one and one-quarter (1.25) inches. Cut line 706 is generally perpendicular to cut line 704 and is generally parallel to fold line 640. Cut line 708 extends downwardly from cut line 706 to fold line 640, at a distance of five and five-eighths (5.625) inches from the second corner 646 of the second bottom panel 634. Cut line 708 extends a distance of one (1) inch and is generally perpendicular to cut line 706 and is generally opposite and parallel to cut line 704. Cut line 710 is connected to, and is generally planar with, cut line 708, and extends downwardly from cut line 708 a distance of twenty-seven thirty-seconds (0.84375) inches to cut line 712. Cut line 712 extends generally inwardly from cut line 710 to cut line 714 a distance of one and one-quarter (1.25) inches. Cut line 712 is generally perpendicular to cut line 710 and is generally opposite and parallel to cut line 706. Cut line 714 extends upwardly from cut line 712 to fold line 640 a distance of twenty-seven thirty-seconds (0.84375) inches. Cut line 714 is generally perpendicular to cut line 712, is connected to and is generally planar with cut line 704, and is generally opposite and parallel with cut line 710.

The blank 600 has a first upper intermediate connecting panel 716 which is generally rectangular in configuration. The first upper intermediate connecting panel 716 is defined by fold line 614, cut line 718, fold line 720, cut lines 722, 724, 726, fold line 728, and edge 730. Cut line 718 extends a distance of one and seven-eighths (1.875) inches. Fold line 720 extends a distance of two and one-sixteenth (2.0625) inches. Cut line 722 extends a distance of one-quarter (0.25) inches. Cut line 724 extends a distance of two (2.0) inches. Cut line 726 extends a distance of one-quarter (0.25) inches. Fold line 728 extends a distance of one and fifteen-sixteenths (1.9375) inches. Edge 730 extends a distance of one and seven-eighths (1.875) inches. Thus, the first upper intermediate connecting panel 716 has a width (six and nine-sixteenths (6.5625) inches) which is smaller than a width (six and fifteen-sixteenths (6.9375) inches) of the first bottom panel 608.

Cut line 718 is generally perpendicular to fold line 614 and extends outwardly from the connection of fold line 614 and cut line 612. Fold line 720 is generally perpendicular to cut line 718 and is generally opposite and parallel to fold line 614. Cut line 722 is connected to, and planar with, fold line 720. Cut line 724 is connected to, and planar with, cut line 722. Cut line 726 is connected to, and planar with, cut line 724. Fold line 728 is connected to, and generally planar with, cut line 726 and, further, is generally opposite and parallel to fold line 614. Edge 730 is generally perpendicular to both fold line 728 and fold line 614, and is generally opposite and parallel to cut line 718.

The blank 600 has a first side panel 732 which is defined by fold line 720, cut lines 722, 724, 726, fold line 728, edge 734, fold line 736, edges 738, 740, 742, fold line 744, and cut line 746. Edge 734 extends a distance of five-sixteenths (0.3125) inches. Fold line 736 extends a distance of six and five-eighths (6.625) inches. Edge 740 extends a distance of six and one-half (6.5) inches. Fold line 744 extends a distance of six and five-eighths (6.625) inches. Cut line 746 extends a distance of three-sixteenths (0.1875) inches. Thus, the first upper intermediate connecting panel 716 has a width (six and nine-sixteenths (6.5625) inches) which is smaller than a width (six and fifteen-sixteenths (6.9375) inches) of the first side panel 732.

Edge 734 extends upwardly from the connection of fold line 728 and edge 730 such that edge 734 is connected to, and co-planar with, fold line 728, and perpendicular to edge 730. Fold line 736 is perpendicular to edge 734 and extends outwardly from an end of edge 734. Edge 738 extends angularly downwardly and outwardly from fold line 736 to edge 740. Edge 740 extends downwardly from the edge 738 to edge 742. Edge 740 is generally perpendicular to fold line 736 and is generally opposite and parallel to fold lines 720, 728. Edge 742 extends angularly downwardly and inwardly from edge 740 to fold line 744. Fold line 744 extends inwardly from the edge 742 to cut line 746. Fold line 744 is generally perpendicular to edge 740 and is generally opposite and parallel to fold line 736. Cut line 746 is perpendicular to fold line 744 and is connected to, and is co-planar with, fold line 720, such that cut line 746 extends to where cut line 718 and fold line 720 meet.

The first side panel 732 has a product anchor flap assembly 748 provided therein which includes a first anchor flap 750, a second anchor flap 752, and a third anchor flap 754.

The first anchor flap 750 is defined by cut line 722, cut line 756, cut line 758, fold line 760, and cut line 762. Cut line 756 extends a distance of five and one-eighth (5.125) inches. Cut line 758 extends a distance of one and one-quarter (1.25) inches. Cut line 760 extends a distance of three and three-quarter (3.75) inches. Cut line 756 extends outwardly from where cut lines 722, 724 meet and is generally perpendicular to cut lines 722, 724. Cut line 758 extends downwardly from an outward end of cut line 756 and is generally perpendicular to cut line 756 and generally parallel to cut line 724. Fold line 760 extends inwardly from a downward end of cut line 758 and is generally perpendicular to cut line 758 and generally parallel to cut line 756. Cut line 762 extends angularly upwardly and inwardly from an inner end of fold line 760 to where fold line 720 and cut line 722 meet.

The second anchor flap 752 is defined by cut line 726, cut line 764, cut line 766, fold line 768, and cut line 770. Cut line 764 extends a distance of five and one-eighth (5.125) inches. Cut line 766 extends a distance of one and one-quarter (1.25) inches. Cut line 768 extends a distance of three and three-quarter (3.75) inches. Cut line 764 extends outwardly from where cut lines 724, 726 meet and is generally perpendicular to cut lines 724, 726, and is generally opposite and parallel to cut line 756. Cut line 766 extends upwardly from an outward end of cut line 764 and is generally perpendicular to cut line 764 and generally parallel to cut line 724 and generally co-planar with cut line 758. Fold line 768 extends inwardly from an upper end of cut line 766 and is generally perpendicular to cut line 766 and generally parallel to cut line 764. Cut line 770 extends angularly downwardly and inwardly from an inner end of fold line 768 to where fold line 728 and cut line 726 meet.

The third anchor flap 754 is defined by cut line 766, cut line 772, cut line 758, cut line 774, fold line 776, and cut line 778. Cut line 772 extends a distance of two (2) inches. Fold line 776 extends a distance of two (2) inches. Cut line 772 extends from the connection of cut lines 756, 758 to the connection of cut lines 764, 766. Cut line 772 is thus co-planar with cut lines 758, 766 and is generally opposite and parallel to cut line 724. Cut line 774 extends angularly upwardly and outwardly from the connection of cut line 758 and fold line 760. Fold line 776 extends upwardly from cut line 774 to cut line 778 and is generally opposite and parallel to cut line 772. Cut line 778 extends angularly upwardly and inwardly from fold line 776 to the connection of cut line 766 and fold line 768.

Cut lines 724, 756, 772, 764 define an aperture 780 through the first side panel 732.

The blank 600 has a first outer side panel 782 which is defined by fold line 736, edge 784, edge 786, edge 788, and edge 790. Edge 784 extends a distance of two and three-sixteenths (2.1875) inches. Edge 786 extends a distance of six and one-eighth (6.125) inches. Edge 790 extends a distance of one and eleven-sixteenths (1.6875) inches.

Edge 784 extends upwardly from the connection of fold line 736 and edge 738 such that edge 784 is generally perpendicular to fold line 736. Edge 786 extends inwardly from an upper end of edge 784 to edge 788 such that edge 786 is generally perpendicular to edge 784 and generally opposite and parallel to fold line 736. Edge 788 extends angularly downwardly and inwardly from an inner end of edge 786 to edge 790. Edge 790 extends downwardly from edge 788 to the connection of edge 734 and fold line 736 such that edge 790 is generally perpendicular to fold line 736 and edge 786, generally opposite and parallel to edge 784, and co-planar with edge 734.

The first outer side panel 782 is provided with a tab member 792. The tab member 792 is defined by the edge 786 and cut lines 794, 796, 798, 800, 802, 804. A fold line 806 may also be provided to define tab member 792. Cut lines 794, 804 extend a distance of seven-sixteenths (0.4375) inches. Cut lines 796, 802 curve at a radius of three-eighths (0.375) inches. Cut lines 798, 800 extend a distance of five-sixteenths (0.3125) inches.

Cut line 794 extends downwardly from edge 786 at a point P2, which is provided one and fifteen-sixteenths (1.9375) inches from the connection of edges 786, 788. Cut line 794 is generally perpendicular to edge 786. Cut line 796 curves outwardly and downwardly from a lower end of cut line 794 to cut line 798. Cut line 798 extends downwardly from cut line 796 and is generally parallel to cut line 794. Cut line 804 extends downwardly from edge 786 at a point P3, which is provided two and three-sixteenths (2.1875) inches from the connection of edges 784, 786. Cut line 804 is generally perpendicular to edge 786 and is generally opposite and parallel to cut line 794. Cut line 802 curves inwardly and downwardly from a lower end of cut line 804 to cut line 800. Cut line 800 extends downwardly from cut line 802 and is generally parallel to cut line 804, and is generally opposite and parallel to cut line 798. A fold line 806 may be provided which extends completely or partially between cut lines 798, 800, as illustrated in FIG. 11.

A point P4 is provided along edge 786 which is equidistant from both the connection of edge 786 and cut line 794 and the connection of edge 786 and cut line 804. A fold line 808 is provided on the tab member 792 which extends angularly downwardly and outwardly from point P4 to the connection of cut lines 800, 802. A fold line 810 is provided on the tab member 792 which extends angularly downwardly and inwardly from point P4 to the connection of cut lines 796, 798.

The blank 600 has a first side, intermediate connecting panel 812. The first side, intermediate connecting panel 812 is defined by fold line 744, cut line 814, fold line 816, cut lines 818, 820, 822, fold line 824, and edge 826. Cut line 814 extends a distance of one and eleven-sixteenths (1.6875) inches. Fold line 816 extends a distance of one and fifteen-sixteenths (1.9375) inches. Cut line 820 extends a distance of two and one-quarter (2.25) inches. Fold line 824 extends a distance of one and fifteen-sixteenths (1.9375) inches. Edge 826 extends a distance of one and eleven-sixteenths (1.6875) inches.

Cut line 814 extends downwardly from the connection of fold line 744 and cut line 746. Cut line 814 is generally perpendicular to fold line 744 and is generally co-planar with cut line 746. Fold line 816 extends outwardly from a lower end of cut line 814 and is generally perpendicular to cut line 814 and is generally opposite and parallel to fold line 744. Cut line 818 extends angularly downwardly and outwardly from an outer end of fold line 816 to cut line 820. Cut line 820 extends outwardly from an outer end of cut line 818 and is generally parallel to fold line 816 and is generally opposite and parallel to fold line 744. Cut line 820 is distanced two and three-sixteenths (2.1875) inches from fold line 744. Cut line 822 extends angularly upwardly and outwardly from an outer end of cut line 820 to fold line 824. Fold line 824 extends outwardly from an outer end of cut line 822. Fold line 824 is parallel to cut line 820, generally opposite and parallel to fold line 744, and generally co-planar with fold line 816. Edge 826 extends upwardly from an outer end of fold line 824 to the connection of edge 742 and fold line 744. Edge 826 is generally perpendicular to fold lines 744, 824 and is generally opposite and parallel to cut line 814.

The blank 600 has a second side panel 828. The second side panel 828 is defined by cut line 830, fold line 816, cut lines 818, 832, 834, 836, 822, fold line 824, edges 838, 840, 842, fold line 844, edge 846, and fold line 642. Cut line 830 extends a distance of one and three-quarter (1.75) inches. Cut line 834 extends a distance of one and seven-eighths (1.875) inches. Edge 840 extends a distance of six and seven-sixteenths (6.4375) inches. Fold line 844 extends a distance of six and five-eighths (6.625) inches. Edge 846 extends a distance of one and three-quarter (1.75) inches.

Cut line 830 extends outwardly from the fourth corner 650 of the second bottom panel 634 to the connection of cut line 814 and fold line 816. Cut line 830 is generally perpendicular to cut line 814 and is generally co-planar with fold line 816. Cut line 832 extends angularly downwardly and outwardly from the connection of cut lines 818, 820, preferably at the same angle at which cut line 818 extends, to cut line 834, such that cut lines 818, 832 are co-planar. Cut line 834 extends outwardly from an outer end of cut line 832 to cut line 836. Cut line 834 is generally opposite and parallel to cut line 820. Cut line 834 is distanced three-eighths (0.375) inches from cut line 820. Cut line 836 extends angularly upwardly and outwardly from an outer end of cut line 834 to the connection of cut lines 820, 822, preferably at the same angle at which cut line 822 extends, such that cut lines 822, 836 are co-planar.

Edge 838 extends angularly outwardly and downwardly from the connection of fold line 824 and edge 826. Edge 840 extends downwardly from an outer end of edge 838 to edge 842. Edge 840 is generally perpendicular to fold line 824 and is generally opposite and parallel to fold line 642. Edge 842 extends angularly downwardly and inwardly from a lower end of edge 840 to fold line 844. Fold line 844 extends inwardly from an inner end of edge 842 to edge 846. Fold line 844 is generally perpendicular to edge 840 and fold line 642, and is generally opposite and parallel to fold lines 816, 824. Edge 846 extends inwardly from an inner end of fold line 844 to the third corner 648 of the second bottom panel 634. Edge 846 is generally co-planar with fold line 844 and is generally perpendicular to fold line 642 and edge 840.

Cut lines 820, 832, 834, 836 provide an aperture 848 through the blank 600.

Cut lines 612, 656, 830, 814, 746, 718 provide an aperture 850 through the blank 600.

The second side panel 828 provides a first finger tab member 852 which is defined by cut lines 854, 856, 858, 860, 862 and fold line 864. Cut lines 854, 862 extend a distance of one-half (0.5) inches. Cut lines 856, 860 curve at a radius of one-half (0.5) inches. Cut line 858 extends a distance of three-quarter (0.75) inches. Points P5 and P6 are provided on the second side panel 828. Point P5 is positioned one and one-quarter (1.25) inches inwardly from edge 840 and two and nine-sixteenth (2.5625) inches downwardly from fold line 824. Point P6 is positioned one and one-quarter (1.25) inches inwardly from edge 840 and four and five-sixteenth (4.3125) inches downwardly from fold line 824.

Cut line 854 extends inwardly from point P5 for a distance of one-half (0.5) inch. Cut line 856 curves inwardly and downwardly from an inner end of cut line 854 to cut line 858. Cut line 858 extends downwardly from a lower end of cut line 856 to cut line 860 and is generally perpendicular to cut line 854. Cut line 860 curves outwardly and downwardly from a lower end of cut line 858 to cut line 862. Cut line 862 extends inwardly from an outer end of cut line 860 to point P6. Cut line 862 is generally perpendicular to cut line 858 and is generally opposite and parallel to cut line 854. Fold line 864 extends upwardly from point P6 to point P5 and is generally perpendicular to cut lines 854, 862 and is generally opposite and parallel to cut line 858.

The blank 600 has a second outer side panel 868 which is generally rectangular in configuration. The second outer side panel 868 is defined by fold line 844 and edges 870, 872, 874. Edge 870 extends a distance of one and five-eighths (1.625) inches. Edge 872 extends a distance of six and five-eighths (6.625) inches. Edge 874 extends a distance of one and five-eighths (1.625) inches.

Edge 870 extends downwardly from the connection of fold line 844 and edge 846 and is generally perpendicular to fold line 844 and edge 846. Edge 872 extends outwardly from a lower end of edge 870 and is generally perpendicular to edge 870. Edge 872 is also generally opposite and parallel to fold line 844 and is generally co-planar with edge 698. Edge 874 extends upwardly from an outer end of edge 872 to the connection of edge 842 and fold line 844. Edge 874 is generally perpendicular to fold line 844 and is generally opposite and parallel to edge 870.

An aperture 876 is provided through the second side panel 828 and the second outer side panel 868. The aperture 876 is generally rectangular in configuration and is defined by cut lines 878, 880, 882, 884, 886, 888. Cut line 878 extends upwardly from fold line 844 at a distance of five and eleven-sixteenths (5.6875) inches from the third corner 648 of the second bottom panel 634. Cut line 878 extends a distance of one (1) inch. Cut line 880 extends inwardly from cut line 878 to cut line 882 a distance of one and one-quarter (1.25) inches. Cut line 880 is generally perpendicular to cut line 878 and is generally parallel to fold line 844. Cut line 882 extends downwardly from cut line 880 to fold line 844, at a distance of four and seven-sixteenths (7.4375) inches from the third corner 648 of the second bottom panel 634. Cut line 882 extends a distance of one (1) inch and is generally perpendicular to cut line 880 and is generally opposite and parallel to cut line 878. Cut line 884 is connected to, and is generally planar with, cut line 882, and extends downwardly from cut line 882 a distance of twenty-seven thirty-seconds (0.84375) inches to cut line 886. Cut line 886 extends generally inwardly from cut line 884 to cut line 888 a distance of one and one-quarter (1.25) inches. Cut line 886 is generally perpendicular to cut line 884 and is generally opposite and parallel to cut line 880. Cut line 888 extends upwardly from cut line 886 to fold line 844 a distance of twenty-seven thirty-seconds (0.84375) inches. Cut line 888 is generally perpendicular to cut line 886, is connected to and is generally planar with cut line 878, and is generally opposite and parallel with cut line 884.

The blank 600 has a second upper intermediate connecting panel 890 which is generally rectangular in configuration. The second upper intermediate connecting panel 890 is defined by fold line 622, cut line 892, fold line 894, cut lines 896, 898, 900, fold line 902, and edge 904. Cut line 892 extends a distance of one and seven-eighths (1.875) inches. Fold line 894 extends a distance of two and one-sixteenth (2.0625) inches. Cut line 896 extends a distance of one-quarter (0.25) inches. Cut line 898 extends a distance of two (2.0) inches. Cut line 900 extends a distance of one-quarter (0.25) inches. Fold line 902 extends a distance of one and fifteen-sixteenths (1.9375) inches. Edge 904 extends a distance of one and seven-eighths (1.875) inches. Thus, the second upper intermediate connecting panel 890 has a width (six and nine-sixteenths (6.5625) inches) which is smaller than a width (six and fifteen-sixteenths (6.9375) inches) of the first bottom panel 608.

Cut line 892 is generally perpendicular to fold line 622 and extends outwardly from the connection of fold line 622 and cut line 624. Fold line 894 is generally perpendicular to cut line 892 and is generally opposite and parallel to fold line 622. Cut line 896 is connected to, and planar with, fold line 894. Cut line 898 is connected to, and planar with, cut line 896. Cut line 900 is connected to, and planar with, cut line 898. Fold line 902 is connected to, and generally planar with, cut line 900 and, further, is generally opposite and parallel to fold line 622. Edge 904 is generally perpendicular to both fold line 902 and fold line 622, and is generally opposite and parallel to cut line 892.

The second upper intermediate connecting panel 890 is thus a mirror image of the first upper intermediate connecting panel 716, but is provided on an opposite side of the blank 600.

The blank 600 has a third side panel 906 which is defined by fold line 894, cut lines 896, 898, 900, fold line 902, edge 908, fold line 910, edges 912, 914, 916, fold line 918, and cut line 920. Edge 908 extends a distance of five-sixteenths (0.3125) inches. Fold line 910 extends a distance of six and five-eighths (6.625) inches. Edge 914 extends a distance of six and one-half (6.5) inches. Fold line 918 extends a distance of six and five-eighths (6.625) inches. Cut line 920 extends a distance of three-sixteenths (0.1875) inches. Thus, the second upper intermediate connecting panel 890 has a width (six and nine-sixteenths (6.5625) inches) which is smaller than a width (six and fifteen-sixteenths (6.9375) inches) of the third side panel 906.

Edge 908 extends upwardly from the connection of fold line 902 and edge 904 such that edge 908 is connected to, and co-planar with, fold line 902, and perpendicular to edge 904. Fold line 910 is perpendicular to edge 908 and extends outwardly from an end of edge 908. Edge 912 extends angularly downwardly and outwardly from fold line 910 to edge 914. Edge 914 extends downwardly from the edge 912 to edge 916. Edge 914 is generally perpendicular to fold line 910 and is generally opposite and parallel to fold lines 894, 902. Edge 916 extends angularly downwardly and inwardly from edge 914 to fold line 918. Fold line 918 extends inwardly from the edge 916 to cut line 920. Fold line 918 is generally perpendicular to edge 914 and is generally opposite and parallel to fold line 910. Cut line 920 is perpendicular to fold line 918 and is connected to, and is co-planar with, fold line 894, such that cut line 920 extends to where cut line 892 and fold line 894 meet.

The third side panel 906 has a product anchor flap assembly 922 provided therein which includes a first anchor flap 924, a second anchor flap 926, and a third anchor flap 928.

The first anchor flap 924 is defined by cut line 896, cut line 930, cut line 932, fold line 934, and cut line 936. Cut line 930 extends a distance of five and one-eighth (5.125) inches. Cut line 932 extends a distance of one and one-quarter (1.25) inches. Cut line 934 extends a distance of three and three-quarter (3.75) inches. Cut line 930 extends outwardly from where cut lines 896, 898 meet and is generally perpendicular to cut lines 896, 898. Cut line 932 extends downwardly from an outward end of cut line 930 and is generally perpendicular to cut line 930 and generally parallel to cut line 898. Fold line 934 extends inwardly from a downward end of cut line 932 and is generally perpendicular to cut line 932 and generally parallel to cut line 930. Cut line 936 extends angularly upwardly and inwardly from an inner end of fold line 934 to where fold line 894 and cut line 896 meet.

The second anchor flap 926 is defined by cut line 900, cut line 938, cut line 940, fold line 942, and cut line 944. Cut line 938 extends a distance of five and one-eighth (5.125) inches. Cut line 940 extends a distance of one and one-quarter (1.25) inches. Cut line 942 extends a distance of three and three-quarter (3.75) inches. Cut line 938 extends outwardly from where cut lines 898, 900 meet and is generally perpendicular to cut lines 898, 900, and is generally opposite and parallel to cut line 930. Cut line 940 extends upwardly from an outward end of cut line 938 and is generally perpendicular to cut line 938 and generally parallel to cut line 898 and generally co-planar with cut line 932. Fold line 942 extends inwardly from an upper end of cut line 940 and is generally perpendicular to cut line 940 and generally parallel to cut line 938. Cut line 944 extends angularly downwardly and inwardly from an inner end of fold line 942 to where fold line 902 and cut line 900 meet.

The third anchor flap 928 is defined by cut line 940, cut line 946, cut line 932, cut line 948, fold line 950, and cut line 952. Cut line 946 extends a distance of two (2) inches. Fold line 950 extends a distance of two (2) inches. Cut line 946 extends from the connection of cut lines 930, 932 to the connection of cut lines 938, 940. Cut line 946 is thus co-planar with cut lines 932, 940 and is generally opposite and parallel to cut line 898. Cut line 948 extends angularly upwardly and outwardly from the connection of cut line 932 and fold line 934. Fold line 950 extends upwardly from cut line 948 to cut line 952 and is generally opposite and parallel to cut line 946. Cut line 952 extends angularly upwardly and inwardly from fold line 950 to the connection of cut line 940 and fold line 942.

Cut lines 898, 930, 946, 938 define an aperture 954 through the third side panel 906.

The third side panel 906 is thus a mirror image of the first side panel 732, but is provided on an opposite side of the blank 600.

The blank 600 has a third outer side panel 956 which is defined by fold line 910, edge 958, edge 960, edge 962, and edge 964. Edge 958 extends a distance of two and three-sixteenths (2.1875) inches. Edge 960 extends a distance of six and one-eighth (6.125) inches. Edge 964 extends a distance of one and eleven-sixteenths (1.6875) inches.

Edge 958 extends upwardly from the connection of fold line 910 and edge 912 such that edge 958 is generally perpendicular to fold line 910. Edge 960 extends inwardly from an upper end of edge 958 to edge 962 such that edge 960 is generally perpendicular to edge 958 and generally opposite and parallel to fold line 910. Edge 962 extends angularly downwardly and inwardly from an inner end of edge 960 to edge 964. Edge 964 extends downwardly from edge 962 to the connection of edge 908 and fold line 910 such that edge 964 is generally perpendicular to fold line 910 and edge 960, generally opposite and parallel to edge 958, and co-planar with edge 908.

The third outer side panel 956 is provided with a tab member 966. The tab member 966 is defined by the edge 960 and cut lines 968, 970, 972, 974, 976, 978. A fold line 980 may also be provided to define tab member 966. Cut lines 968, 978 extend a distance of seven-sixteenths (0.4375) inches. Cut lines 970, 976 curve at a radius of three-eighths (0.375) inches. Cut lines 972, 974 extend a distance of five-sixteenths (0.3125) inches.

Cut line 968 extends downwardly from edge 960 at a point P7, which is provided one and fifteen-sixteenths (1.9375) inches from the connection of edges 960, 962. Cut line 968 is generally perpendicular to edge 960. Cut line 970 curves outwardly and downwardly from a lower end of cut line 968 to cut line 972. Cut line 972 extends downwardly from cut line 970 and is generally parallel to cut line 968. Cut line 978 extends downwardly from edge 960 at a point P8, which is provided two and three-sixteenths (2.1875) inches from the connection of edges 958, 960. Cut line 978 is generally perpendicular to edge 960 and is generally opposite and parallel to cut line 968. Cut line 976 curves inwardly and downwardly from a lower end of cut line 978 to cut line 974. Cut line 974 extends downwardly from cut line 976 and is generally parallel to cut line 978, and is generally opposite and parallel to cut line 972. A fold line 980 may be provided which extends completely or partially between cut lines 972, 974, as illustrated in FIG. 11.

A point P9 is provided along edge 960 which is equidistant from both the connection of edge 960 and cut line 968 and the connection of edge 960 and cut line 978. A fold line 982 is provided on the tab member 966 which extends angularly downwardly and outwardly from point P9 to the connection of cut lines 974, 976. A fold line 984 is provided on the tab member 966 which extends angularly downwardly and inwardly from point P9 to the connection of cut lines 970, 972.

The third outer side panel 956 is thus a mirror image of the first outer side panel 782, but is provided on an opposite side of the blank 600.

The blank 600 has a second side, intermediate connecting panel 986. The second side, intermediate connecting panel 986 is defined by fold line 918, cut line 988, fold line 990, cut lines 992, 994, 996, fold line 998, and edge 1000. Cut line 988 extends a distance of one and eleven-sixteenths (1.6875) inches. Fold line 990 extends a distance of one and fifteen-sixteenths (1.9375) inches. Cut line 994 extends a distance of two and one-quarter (2.25) inches. Fold line 998 extends a distance of one and fifteen-sixteenths (1.9375) inches. Edge 1000 extends a distance of one and eleven-sixteenths (1.6875) inches.

Cut line 988 extends downwardly from the connection of fold line 918 and cut line 920. Cut line 988 is generally perpendicular to fold line 918 and is generally co-planar with cut line 920. Fold line 990 extends outwardly from a lower end of cut line 988 and is generally perpendicular to cut line 988 and is generally opposite and parallel to fold line 918. Cut line 992 extends angularly downwardly and outwardly from an outer end of fold line 990 to cut line 994. Cut line 994 extends outwardly from an outer end of cut line 992 and is generally parallel to fold line 990 and is generally opposite and parallel to fold line 918. Cut line 994 is distanced two and three-sixteenths (2.1875) inches from fold line 918. Cut line 996 extends angularly upwardly and outwardly from an outer end of cut line 994 to fold line 998. Fold line 998 extends outwardly from an outer end of cut line 996. Fold line 998 is parallel to cut line 994, generally opposite and parallel to fold line 918, and generally co-planar with fold line 990. Edge 1000 extends upwardly from an outer end of fold line 998 to the connection of edge 916 and fold line 918. Edge 1000 is generally perpendicular to fold lines 918, 998 and is generally opposite and parallel to cut line 988.

The second side intermediate connecting panel 986 is thus a mirror image of the first side intermediate connecting panel 812, but is provided on an opposite side of the blank 600.

The blank 600 has a fourth side panel 1002. The fourth side panel 1002 is defined by cut line 1004, fold line 990, cut lines 992, 1006, 1008, 1010, 996, fold line 998, edges 1012, 1014, 1016, fold line 1018, edge 1020, and fold line 638. Cut line 1004 extends a distance of one and three-quarter (1.75) inches. Cut line 1008 extends a distance of one and seven-eighths (1.875) inches. Edge 1014 extends a distance of six and seven-sixteenths (6.4375) inches. Fold line 1018 extends a distance of six and five-eighths (6.625) inches. Edge 1020 extends a distance of one and three-quarter (1.75) inches.

Cut line 1004 extends outwardly from the first corner 644 of the second bottom panel 634 to the connection of cut line 988 and fold line 990. Cut line 1004 is generally perpendicular to cut line 988 and is generally co-planar with fold line 990. Cut line 1006 extends angularly downwardly and outwardly from the connection of cut lines 992, 994, preferably at the same angle at which cut line 992 extends, to cut line 1008, such that cut lines 992, 1006 are co-planar. Cut line 1008 extends outwardly from an outer end of cut line 1006 to cut line 1010. Cut line 1008 is generally opposite and parallel to cut line 994. Cut line 1008 is distanced three-eighths (0.375) inches from cut line 994. Cut line 1010 extends angularly upwardly and outwardly from an outer end of cut line 1008 to the connection of cut lines 994, 996, preferably at the same angle at which cut line 996 extends, such that cut lines 996, 1010 are co-planar.

Edge 1012 extends angularly outwardly and downwardly from the connection of fold line 998 and edge 1000. Edge 1014 extends downwardly from an outer end of edge 1012 to edge 1016. Edge 1014 is generally perpendicular to fold line 998 and is generally opposite and parallel to fold line 638. Edge 1016 extends angularly downwardly and inwardly from a lower end of edge 1014 to fold line 1018. Fold line 1018 extends inwardly from an inner end of edge 1016 to edge 1020. Fold line 1018 is generally perpendicular to edge 1014 and fold line 638, and is generally opposite and parallel to fold lines 990, 998. Edge 1020 extends inwardly from an inner end of fold line 1018 to the second corner 646 of the second bottom panel 634. Edge 1020 is generally co-planar with fold line 1018 and is generally perpendicular to fold line 638 and edge 1014.

Cut lines 994, 1006, 1008, 1010 provide an aperture 1022 through the blank 600.

Cut lines 612, 656, 1004, 988, 920, 892 provide an aperture 1024 through the blank 600.

The fourth side panel 1002 provides a first finger tab member 1026 which is defined by cut lines 1028, 1030, 1032, 1034, 1036 and fold line 1038. Cut lines 1028, 1036 extend a distance of one-half (0.5) inches. Cut lines 1030, 1034 curve at a radius of one-half (0.5) inches. Cut line 1032 extends a distance of three-quarter (0.75) inches. Points P10 and P11 are provided on the fourth side panel 1002. Point P10 is positioned one and one-quarter (1.25) inches inwardly from edge 1014 and two and nine-sixteenth (2.5625) inches downwardly from fold line 998. Point P11 is positioned one and one-quarter (1.25) inches inwardly from edge 1014 and four and five-sixteenth (4.3125) inches downwardly from fold line 998.

Cut line 1028 extends inwardly from point P10 for a distance of one-half (0.5) inch. Cut line 1030 curves inwardly and downwardly from an inner end of cut line 1028 to cut line 1032. Cut line 1032 extends downwardly from a lower end of cut line 1030 to cut line 1034 and is generally perpendicular to cut line 1028. Cut line 1034 curves outwardly and downwardly from a lower end of cut line 1032 to cut line 1036. Cut line 1036 extends inwardly from an outer end of cut line 1034 to point P11. Cut line 1036 is generally perpendicular to cut line 1032 and is generally opposite and parallel to cut line 1028. Fold line 1038 extends upwardly from point P11 to point P10 and is generally perpendicular to cut lines 1028, 1036 and is generally opposite and parallel to cut line 1032.

The fourth side panel 1002 is thus a mirror image of the second side panel 828, but is provided on an opposite side of the blank 600.

The blank 600 has a fourth outer side panel 1040 which is generally rectangular in configuration. The fourth outer side panel 1040 is defined by fold line 1018 and edges 1042, 1044, 1046. Edge 1042 extends a distance of one and five-eighths (1.625) inches. Edge 1044 extends a distance of six and five-eighths (6.625) inches. Edge 1046 extends a distance of one and five-eighths (1.625) inches.

Edge 1042 extends downwardly from the connection of fold line 1018 and edge 1020 and is generally perpendicular to fold line 1018 and edge 1020. Edge 1044 extends outwardly from a lower end of edge 1042 and is generally perpendicular to edge 1042. Edge 1044 is also generally opposite and parallel to fold line 1018 and is generally co-planar with edge 698. Edge 1046 extends upwardly from an outer end of edge 1044 to the connection of edge 1016 and fold line 1018. Edge 1046 is generally perpendicular to fold line 1018 and is generally opposite and parallel to edge 1042.

The fourth outer side panel 1040 is thus a mirror image of the second outer side panel 868, but is provided on an opposite side of the blank 600.

An aperture 1048 is provided through the fourth side panel 1002 and the fourth outer side panel 1040. The aperture 1048 is generally rectangular in configuration and is defined by cut lines 1050, 1052, 1054, 1056, 1058, 1060. Cut line 1050 extends upwardly from fold line 1018 at a distance of five and eleven-sixteenths (5.6875) inches from the second corner 646 of the second bottom panel 634. Cut line 1050 extends a distance of one (1) inch. Cut line 1052 extends inwardly from cut line 1050 to cut line 1054 a distance of one and one-quarter (1.25) inches. Cut line 1052 is generally perpendicular to cut line 1050 and is generally parallel to fold line 1018. Cut line 1054 extends downwardly from cut line 1052 to fold line 1018, at a distance of four and seven-sixteenths (7.4375) inches from the second corner 646 of the second bottom panel 634. Cut line 1054 extends a distance of one (1) inch and is generally perpendicular to cut line 1052 and is generally opposite and parallel to cut line 1050. Cut line 1056 is connected to, and is generally planar with, cut line 1054, and extends downwardly from cut line 1054 a distance of twenty-seven thirty-seconds (0.84375) inches to cut line 1058. Cut line 1058 extends generally inwardly from cut line 1056 to cut line 1060 a distance of one and one-quarter (1.25) inches. Cut line 1058 is generally perpendicular to cut line 1056 and is generally opposite and parallel to cut line 1052. Cut line 1060 extends upwardly from cut line 1058 to fold line 1018 a distance of twenty-seven thirty-seconds (0.84375) inches. Cut line 1060 is generally perpendicular to cut line 1058, is connected to and is generally planar with cut line 1050, and is generally opposite and parallel with cut line 1056.

Figure 14:
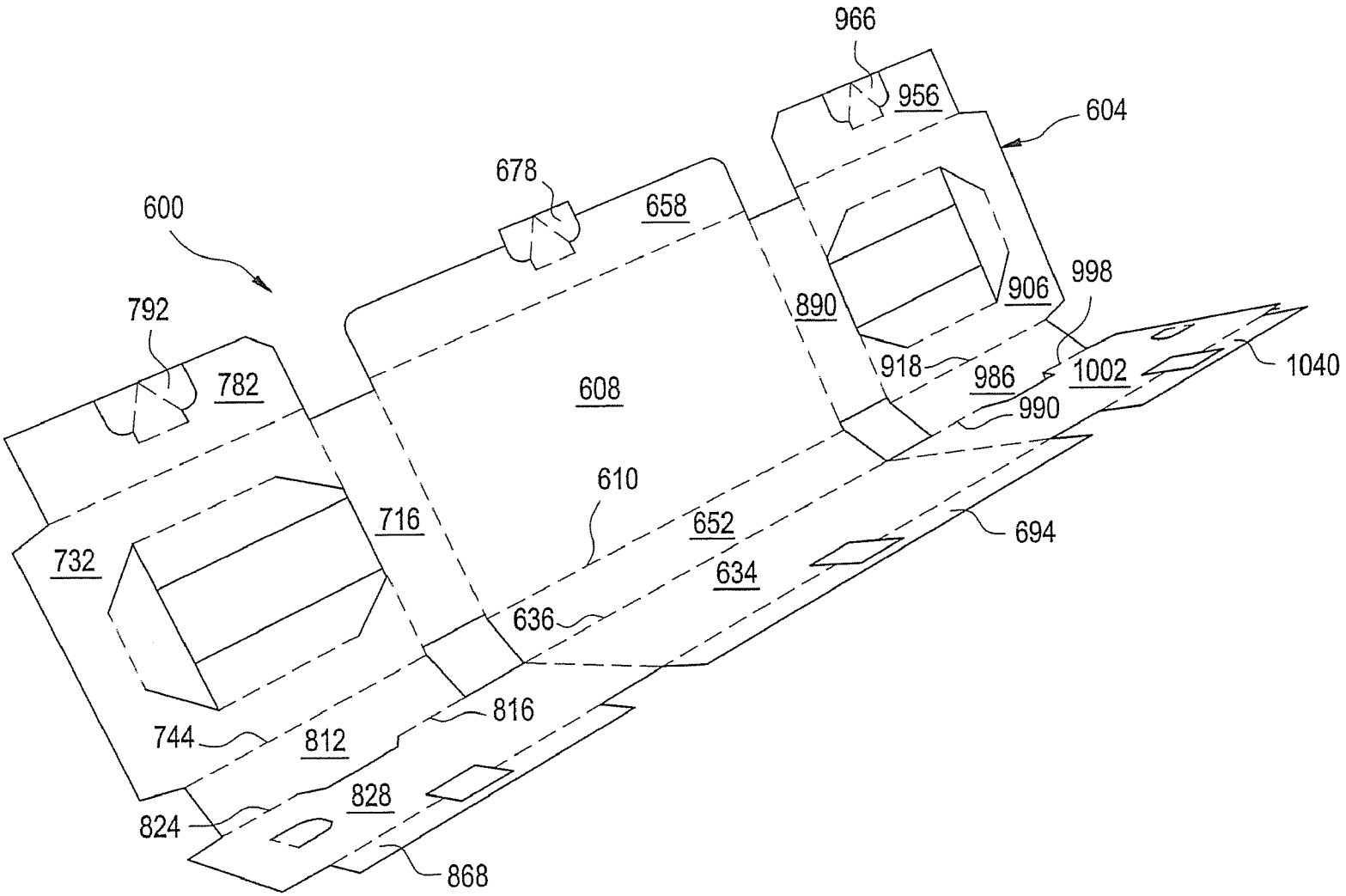
FIGS. 14-22 are stop motion illustrating how the corrugated fibreboard blank of FIG. 13 is folded to form the insert of the fourth embodiment of the invention.

Folding of the blank 600 into the insert 602 is described herein with reference to FIGS. 14-22. As illustrated in FIG. 14, the first side panel 732, the first bottom panel 608, and the third side panel 906 are folded upwardly and inwardly along fold lines 744, 610, 918, respectively. Also, as illustrated in FIG. 14, the second side panel 828, the second bottom panel 634, and the fourth side panel 1002 are folded upwardly and inwardly along fold lines 824 and 816, 636, and 990 and 998, respectively. During the folding of the blank 600 in this manner, the bottom surfaces 606 of the first and second side intermediate connecting panels 812, 986 and the bottom intermediate connecting panel 652 are preferably positioned flat against a working surface (not shown).

The folding of the blank 600 in this manner causes the top surfaces 604 of the first upper intermediate connecting panel 716 and the first side panel 732 to face, and be generally parallel to, the second side panel 828. The folding of the blank 600 in this manner causes the cut lines 818, 820, 822 of the first side intermediate connecting panel 812 to extend to a position beyond the second side panel 828. The folding of the blank 600 in this manner also causes the top surfaces 604 of the second upper intermediate connecting panel 890 and the third side panel 906 to face, and be generally parallel to, the fourth side panel 1002. The folding of the blank 600 in this manner causes the cut lines 992, 994, 996 of the second side intermediate connecting panel 986 to extend to a position beyond the fourth side panel 1002. The folding of the blank 600 in this manner also causes the top surface 604 of the first and second bottom outer panels 658, 694 to face one another and to be generally parallel to one another. The folding of the blank 600 in this manner also causes the top surface 604 of the first and second outer side panels 782, 868 to face one another and to be generally parallel to one another. The folding of the blank 600 in this manner also causes the top surface 604 of the third and fourth outer side panels 956, 1040 to face one another and to be generally parallel to one another.

Figure 15:
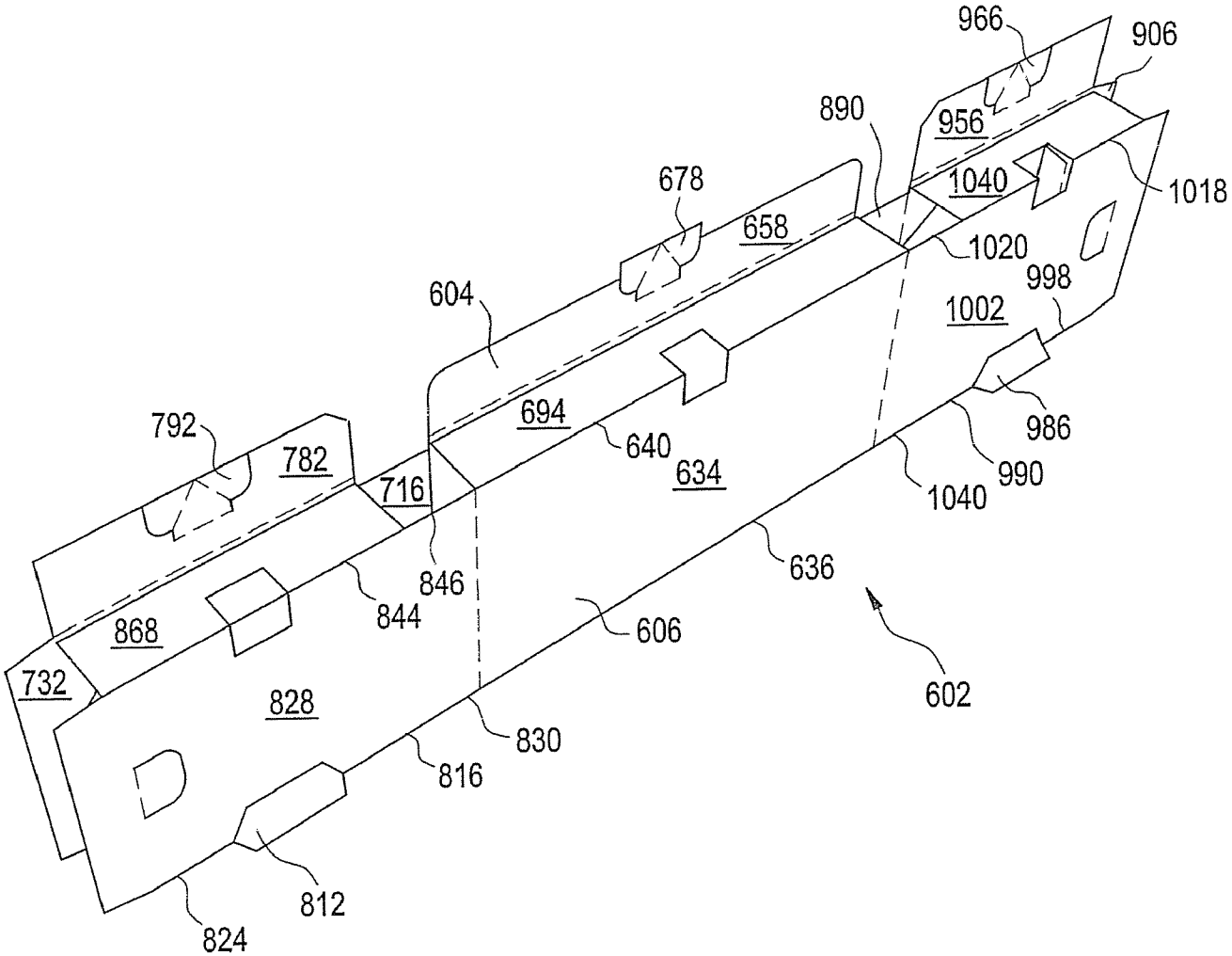

As illustrated in FIG. 15, the second outer side panel 868 is folded downwardly and inwardly along fold line 844 such that the top surface 604 of the second outer side panel 868 faces, and is generally parallel to, the top surface 604 of the first side intermediate connecting panel 812. The second outer side panel 868 is also generally perpendicular to the first and second side panels 732, 828 and the first outer side panel 782.

As illustrated in FIG. 15, the second bottom outer panel 694 is folded downwardly and inwardly along fold line 640 such that the top surface 604 of the second bottom outer panel 694 faces, and is generally parallel to, the top surface 604 of the bottom intermediate connecting panel 652. The second bottom outer panel 694 is also generally perpendicular to the first and second bottom panels 608, 634 and the first bottom outer panel 658.

As illustrated in FIG. 15, the fourth outer side panel 1040 is folded downwardly and inwardly along fold line 1018 such that the top surface 604 of the fourth outer side panel 1040 faces, and is generally parallel to, the top surface 604 of the second side intermediate connecting panel 986. The fourth outer side panel 1040 is also generally perpendicular to the third and fourth side panels 906, 1002 and the third outer side panel 956.

Figure 16:
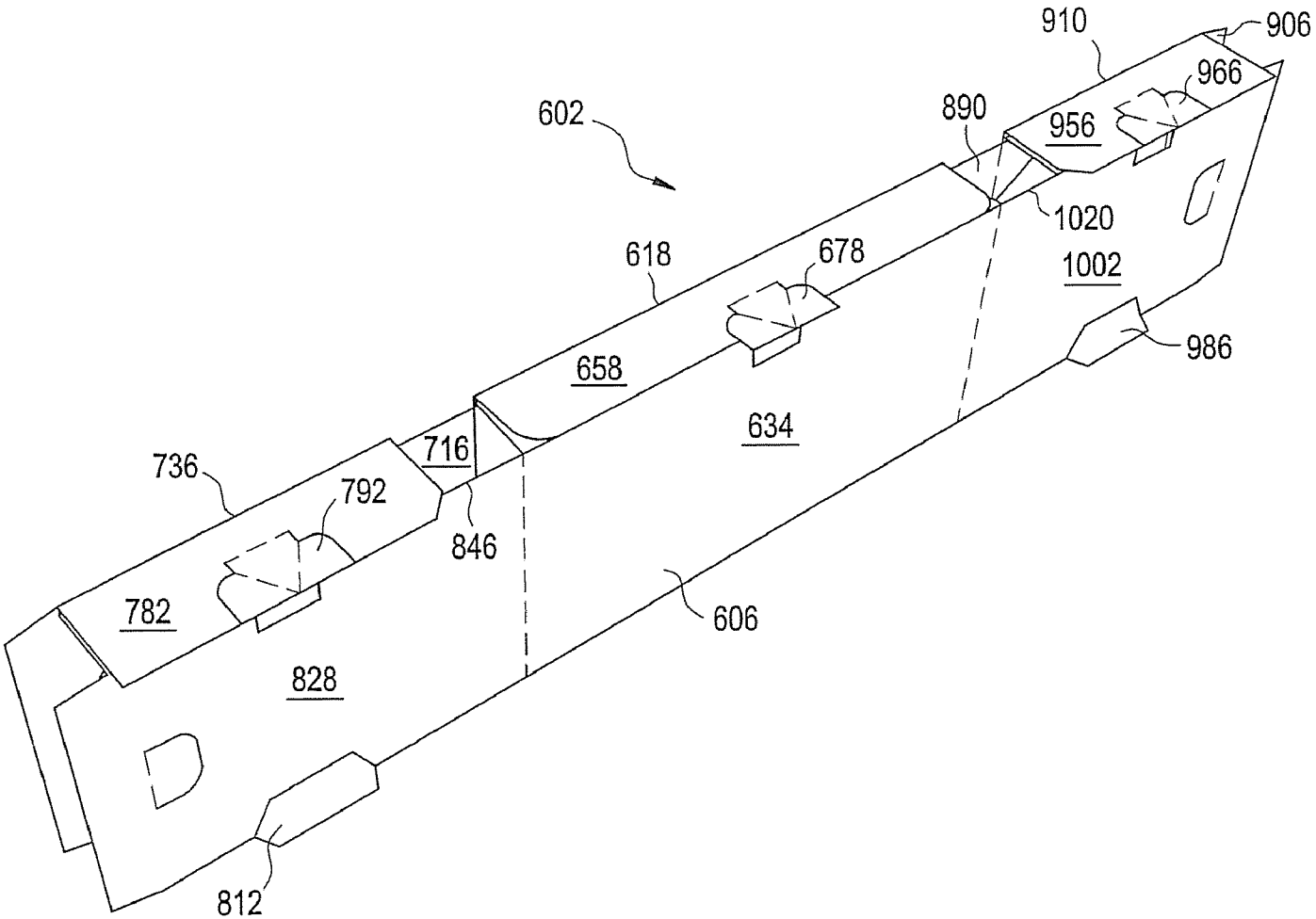

As illustrated in FIG. 16, the first outer side panel 782 is folded downwardly and inwardly along fold line 736 such that the top surface 604 of the first outer side panel 782 faces and preferably abuts, and is generally parallel to, the bottom surface 606 of the second outer side panel 868. The edges 786, 788, and a portion of the edge 784, of the first outer side panel 782 extend to a position beyond the fold line 844 such that the edge 786 is generally planar with the cut line 820.

As illustrated in FIG. 16, the first bottom outer panel 658 is folded downwardly and inwardly along fold line 618 such that the top surface 604 of the first bottom outer panel 658 faces and preferably abuts, and is generally parallel to, the bottom surface 606 of the second bottom outer panel 694. The edges 666, 668, 670 of the first bottom outer panel 658 extend to a position beyond the fold line 640.

As illustrated in FIG. 16, the third outer side panel 956 is folded downwardly and inwardly along fold line 910 such that the top surface 604 of the third outer side panel 956 faces and preferably abuts, and is generally parallel to, the bottom surface 606 of the fourth outer side panel 1040. The edges 960, 962, and a portion of the edge 958, of the third outer side panel 956 extend to a position beyond the fold line 910 such that the edge 960 is generally planar with the cut line 994.

The folding of the first and third outer side panels 782, 956 and the first bottom outer panel 658 causes the blank 600 to folded into a generally tubular structure or configuration, as illustrated in FIG. 16.

Figure 17:
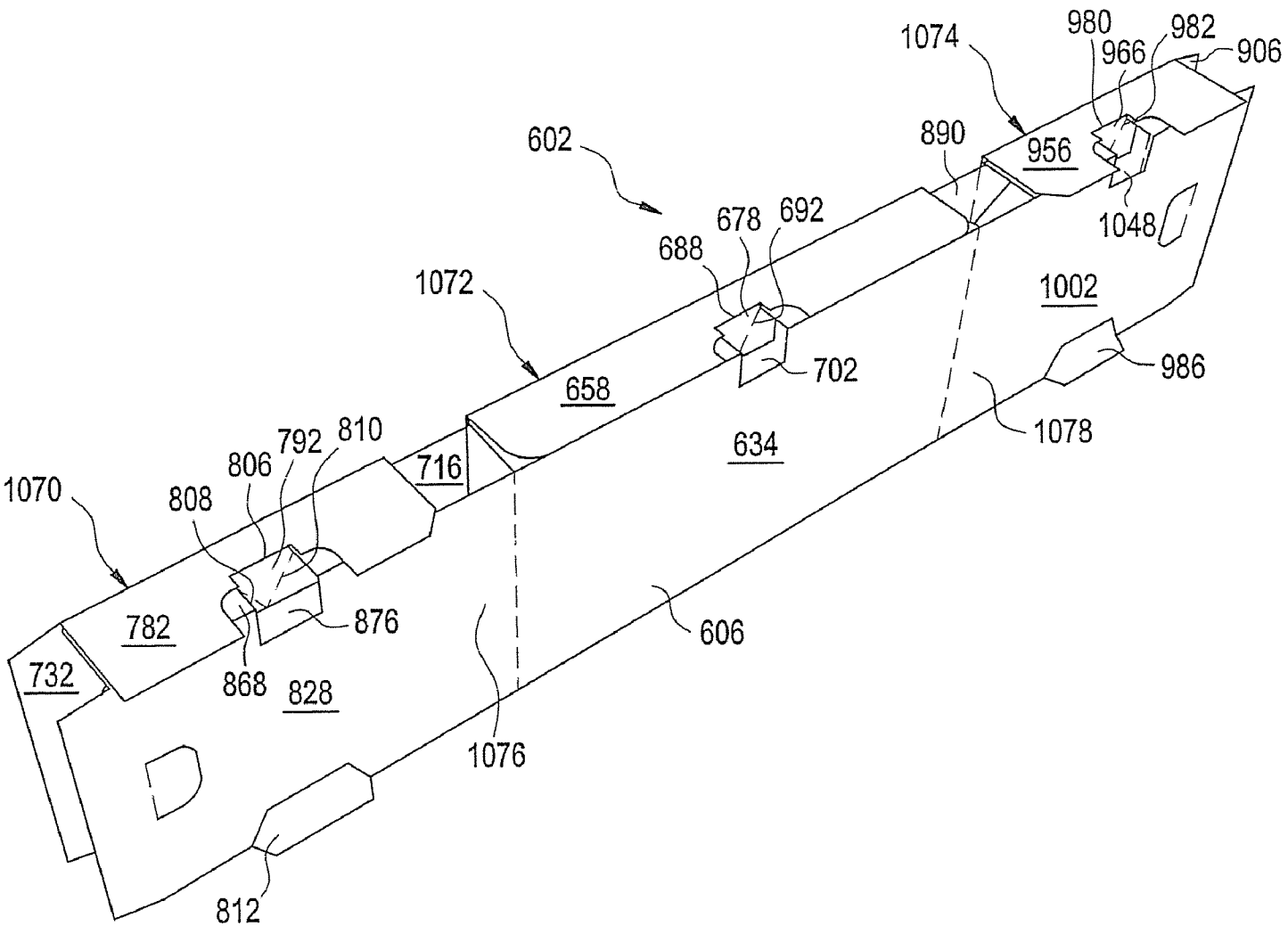

As illustrated in FIG. 17, the tab member 792 of the first outer side panel 782 is folded downwardly along fold line 806 into the aperture 876. While being folded downwardly, the tab member 792 is folded along fold lines 808, 810 in order to allow the tab member 792 to fit through the aperture 876. Once the tab member 792 is through the aperture 876, the tab member 792 is unfolded along fold lines 808, 810 such that the top surface 604 of the tab member 792 generally faces the top surface 604 of the first side panel 732 and such that the bottom surface 606 of the tab member 792 generally faces the top surface 604 of the second side panel 828. The tab member 792 thus locks the first and second outer side panels 782, 868 together such that the first and second side panels 732, 828, the first and second outer side panels 782, 868, and the first side intermediate connecting panel 812 generally form a first air cell 1070 of the insert 602.

As illustrated in FIG. 17, the tab member 678 of the first bottom outer panel 658 is folded downwardly along fold line 688 into the aperture 702. While being folded downwardly, the tab member 678 is folded along fold lines 690, 692 in order to allow the tab member 678 to fit through the aperture 702. Once the tab member 678 is through the aperture 702, the tab member 678 is unfolded along fold lines 690, 692 such that the top surface 604 of the tab member 678 generally faces the top surface 604 of the first bottom panel 608 and such that the bottom surface 606 of the tab member 678 generally faces the top surface 604 of the second bottom panel 634. The tab member 678 thus locks the first and second bottom outer panels 658, 694 together such that the first and second bottom panels 608, 634, the first and second bottom outer panels 658, 694, and the bottom intermediate connecting panel 652 generally form a second air cell 1072 of the insert 602.

As illustrated in FIG. 17, the tab member 966 of the third outer side panel 956 is folded downwardly along fold line 980 into the aperture 1048. While being folded downwardly, the tab member 966 is folded along fold lines 982, 984 in order to allow the tab member 966 to fit through the aperture 1048. Once the tab member 966 is through the aperture 1048, the tab member 966 is unfolded along fold lines 982, 984 such that the top surface 604 of the tab member 966 generally faces the top surface 604 of the third side panel 906 and such that the bottom surface 606 of the tab member 966 generally faces the top surface 604 of the fourth side panel 1002. The tab member 966 thus locks the third and fourth outer side panels 906, 1002 together such that the third and fourth side panels 906, 1002, the third and fourth outer side panels 956, 1040, and the second side intermediate connecting panel 986 generally form a third air cell 1074 of the insert 602.

The first air cell 1070 is connected to the second air cell 1072 by the first upper intermediate connecting panel 716 and a portion 1076 of the second side panel 828 which is parallel to, and facing, the first upper intermediate connecting panel 716. The third air cell 1074 is connected to the second air cell 1072 by the second upper intermediate connecting panel 890 and a portion 1078 of the fourth side panel 1002 which is parallel to, and facing, the second upper intermediate connecting panel 890.

Figure 18:
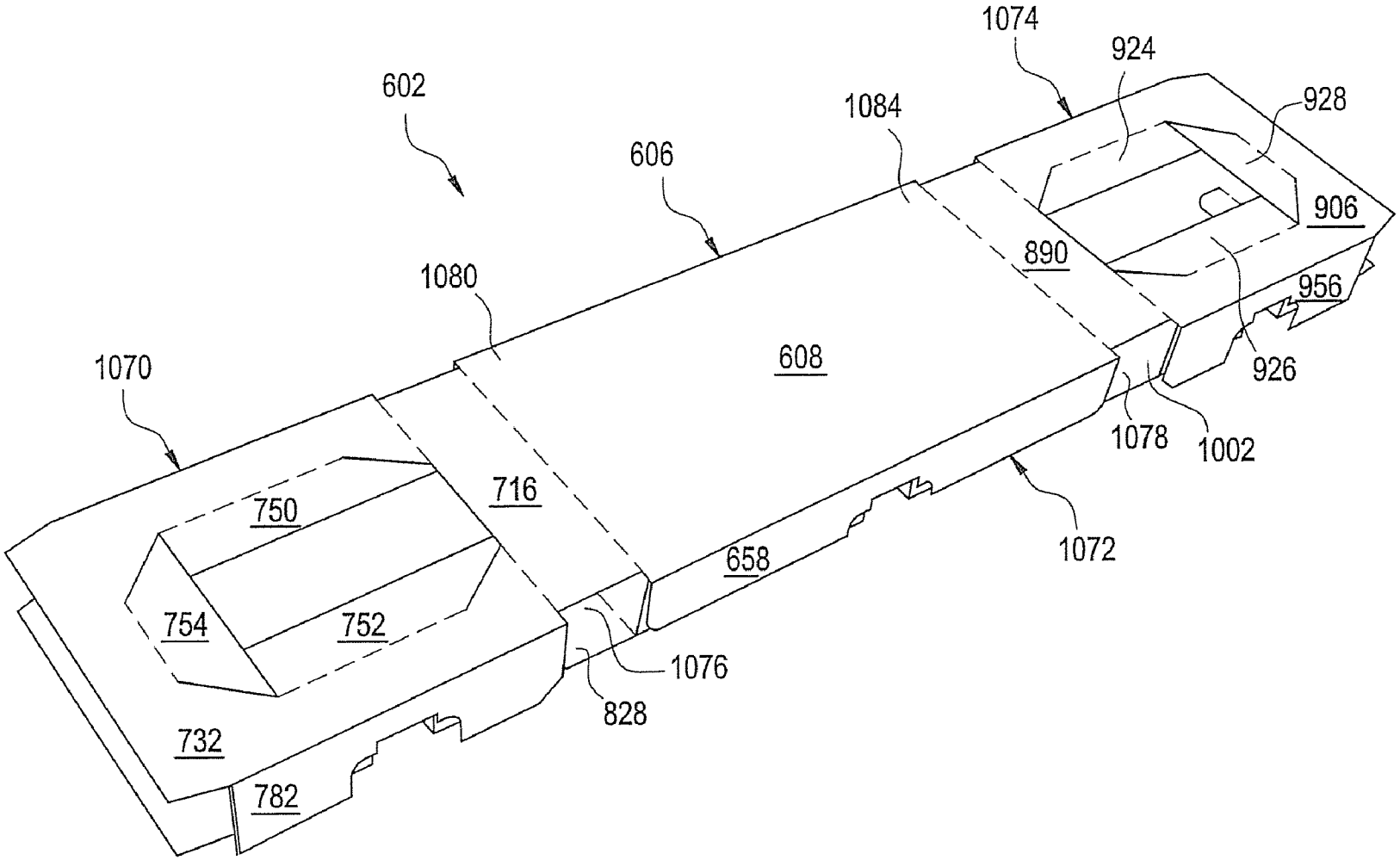

As illustrated in FIG. 18, the insert 602 is generally rotated ninety degrees such that the bottom surfaces 606 of the second and fourth side panels 828, 1002 and the second bottom panel 634 preferably face the working surface, and such that the edges 786, 960 of the first and third outer side panels 782, 956, respectively, and the cut lines 820, 994 of the first and second side intermediate connecting panels 812, 986, are preferably positioned against the working surface.

The first air cell 1070 is generally moved upwardly ninety degrees such that the first air cell 1070 is positioned above a first end 1080 of the second air cell 1072. As the first air cell 1070 is moved upwardly, the second side panel 828 is folded ninety degrees relative to the second bottom panel 634 along fold line 642 such that the second side panel 828 is positioned generally perpendicular to the first and second bottom panels 608, 634. The top surface 604 of the second side panel 828 thus generally faces, and preferably abuts against, the edge 700 of the second bottom outer panel 694 and the cut line 656 of the bottom intermediate connecting panel 652. The portion 1076 of the second side panel 828 thus generally closes off the first end 1080 of the second air cell 1072.

As the first air cell 1070 is moved upwardly, the first upper intermediate connecting panel 716 is folded one-hundred eighty degrees relative to the first bottom panel 608 along fold line 614 and is folded one-hundred eighty degrees relative to the first side panel 732 along fold lines 720, 728. Thus, the bottom surface 606 of the first upper intermediate connecting panel 716 faces, and preferably abuts against, the bottom surface 606 of the first bottom panel 608. The first upper intermediate connecting panel 716 thus generally closes off a lower end 1082 of the first air cell 1070.

The first air cell 1070 is thus generally positioned above the first end 1080 of the second air cell 1072 such that the first and second side panels 732, 828, the first and second outer side panels 782, 868, and the first side intermediate connecting panel 812 are generally perpendicular to the first bottom panel 608. The first air cell 1070 is thus further generally positioned above the first end 1080 of the second air cell 1072 such that the first outer side panel 782 is generally co-planar with the first bottom outer panel 658 and such that the first side intermediate connecting panel 812 is generally co-planar with the bottom intermediate connecting panel 652. The first outer side panel 782 and the first bottom outer panel 658 are allowed to be generally co-planar with one another, such that the first air cell 1070 is generally positioned above the first end 1080 of the second air cell 1072, because the edges 616, 730, 734 are provided for in the blank 600. The first side intermediate connecting panel 812 and the bottom intermediate connecting panel 652 are allowed to be generally co-planar with one another, such that the first air cell 1070 is generally positioned above the first end 1080 of the second air cell 1072, because the cut lines 612, 718, 746 are provided for in the blank 600.

Figure 19:
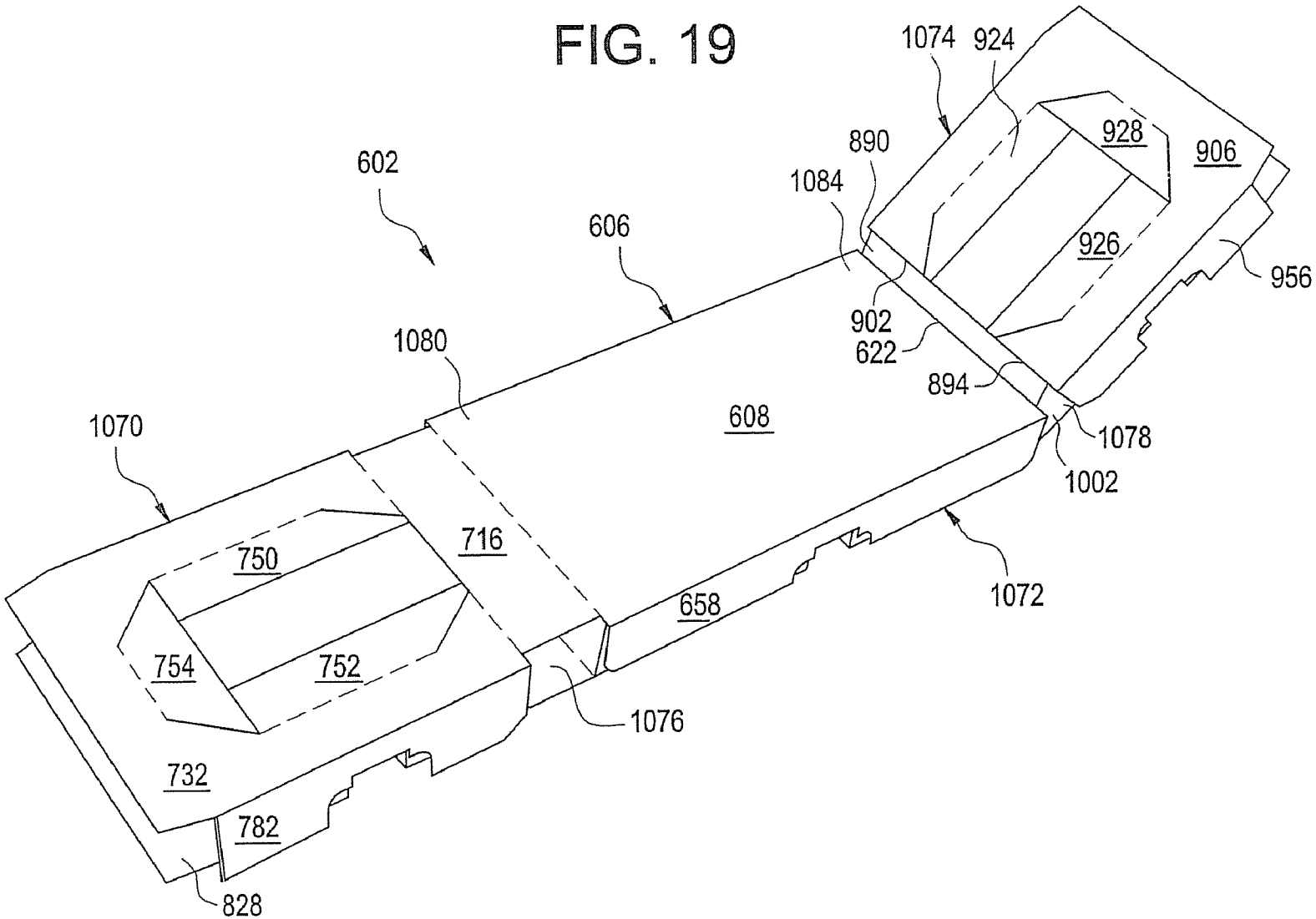

As illustrated in FIG. 19, the third air cell 1074 is generally moved upwardly ninety degrees such that the third air cell 1074 is positioned above a second end 1084 of the second air cell 1072. As the third air cell 1074 is moved upwardly, the fourth side panel 1002 is folded ninety degrees relative to the second bottom panel 634 along fold line 638 such that the fourth side panel 1002 is positioned generally perpendicular to the first and second bottom panels 608, 634. The top surface 604 of the fourth side panel 1002 thus generally faces, and preferably abuts against, the edge 696 of the second bottom outer panel 694 and the cut line 654 of the bottom intermediate connecting panel 652. The portion 1078 of the fourth side panel 1002 thus generally closes off the second end 1084 of the second air cell 1072.

As the third air cell 1074 is moved upwardly, the second upper intermediate connecting panel 890 is folded one-hundred eighty degrees relative to the first bottom panel 608 along fold line 622 and is folded one-hundred eighty degrees relative to the third side panel 906 along fold lines 894, 902. Thus, the bottom surface 606 of the second upper intermediate connecting panel 890 faces, and preferably abuts against, the bottom surface 606 of the first bottom panel 608. The second upper intermediate connecting panel 890 thus generally closes off a lower end 1086 of the third air cell 1074.

The third air cell 1074 is thus generally positioned above the second end 1084 of the second air cell 1072 such that the third and fourth side panels 906, 1002, the third and fourth outer side panels 956, 1040, and the second side intermediate connecting panel 986 are generally perpendicular to the first bottom panel 608. The third air cell 1074 is thus further generally positioned above the second end 1084 of the second air cell 1072 such that the third outer side panel 956 is generally co-planar with the first bottom outer panel 658 and such that the second side intermediate connecting panel 986 is generally co-planar with the bottom intermediate connecting panel 652. The third outer side panel 956 and the first bottom outer panel 658 are allowed to be generally co-planar with one another, such that the third air cell 1074 is generally positioned above the second end 1084 of the second air cell 1072, because the edges 620, 904, 908 are provided for in the blank 600. The second side intermediate connecting panel 986 and the bottom intermediate connecting panel 652 are allowed to be generally co-planar with one another, such that the third air cell 1074 is generally positioned above the second end 1084 of the second air cell 1072, because the cut lines 624, 892, 920 are provided for in the blank 600.

Figure 20:
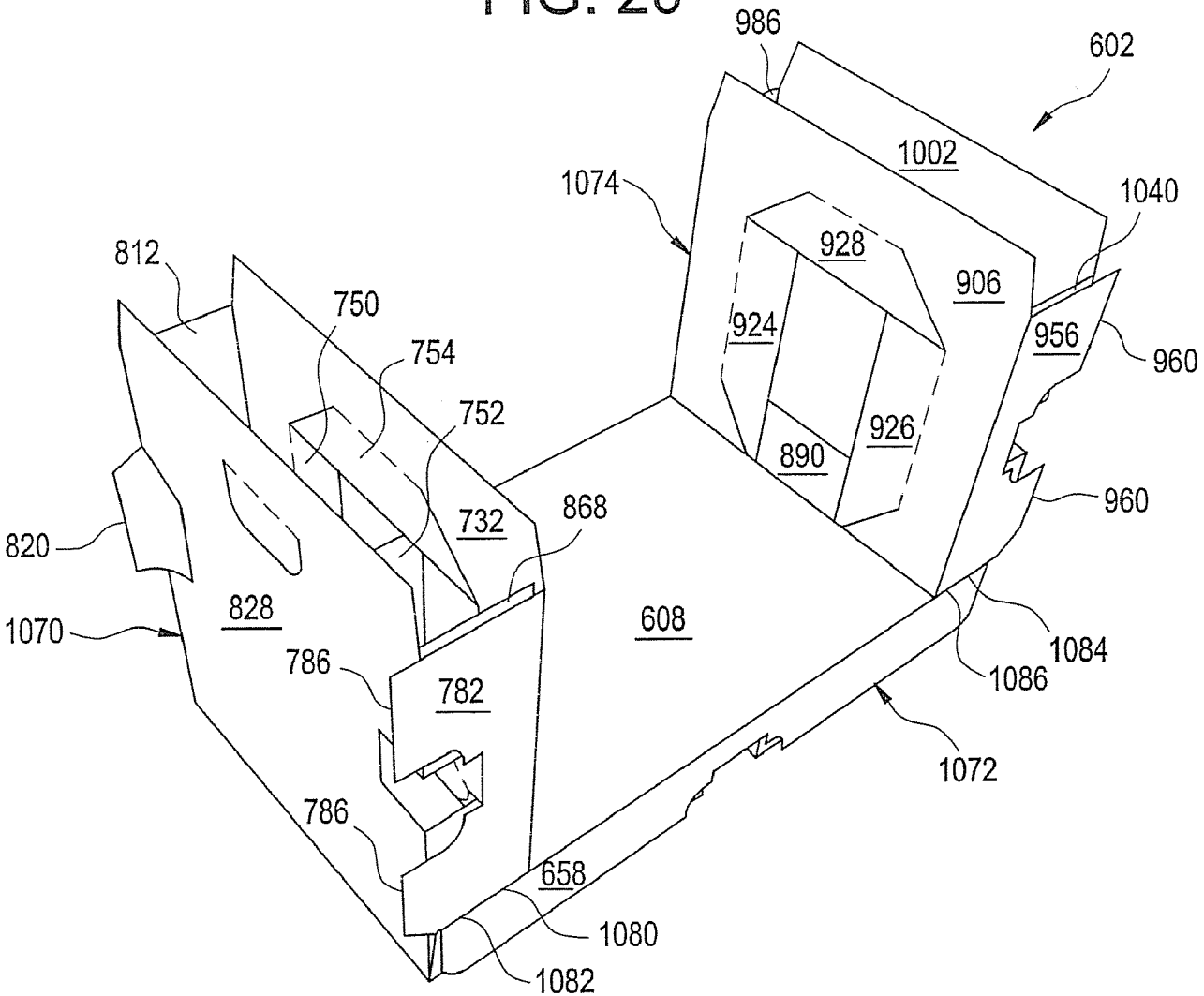
Figure 21:
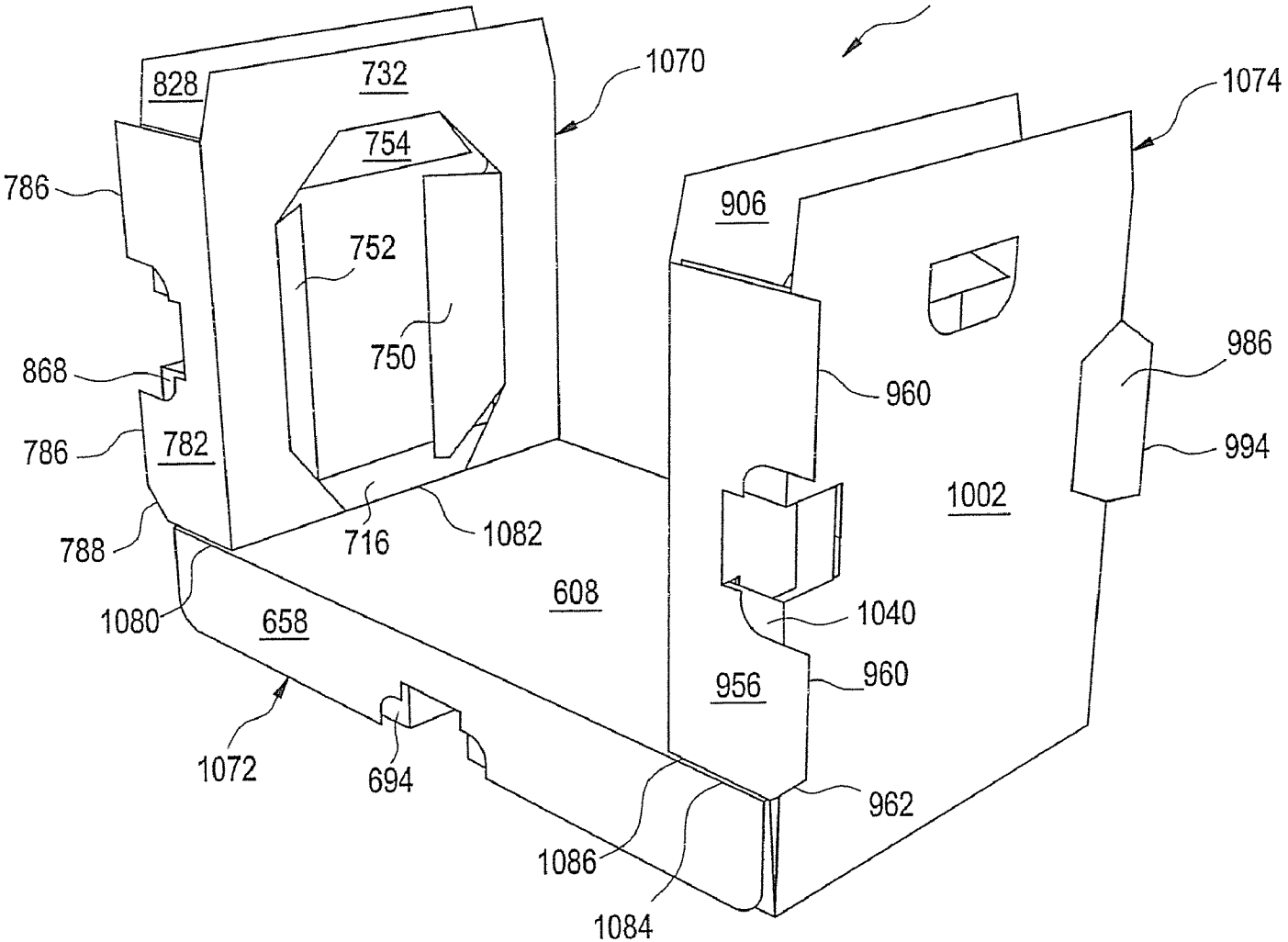
Figure 22:
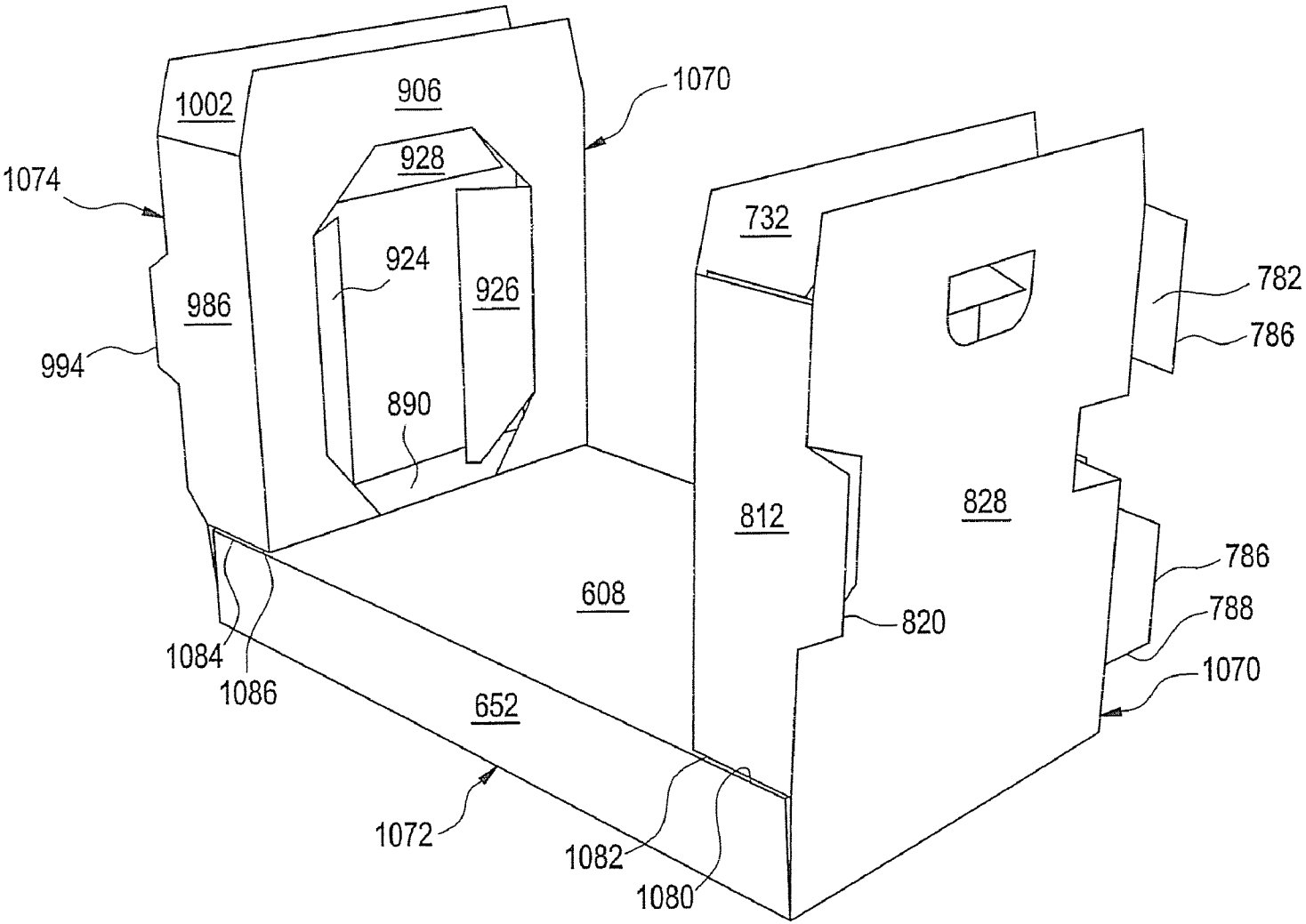

The insert 602 of the third embodiment of the invention is thus provided as illustrated in FIGS. 20-22 and is in a generally U-shaped structure when in its final form. The insert 602 thus has the first product anchor flap assembly 748 of the first side panel 732, now of the first air cell 1070, facing the second product anchor flap assembly 922 of the third side panel 906, now of the third air cell 1074.

The product anchor flaps 750, 752, 754 of the first product anchor flap assembly 748 are positioned opposite the product anchor flaps 924, 926, 928 of the second product anchor flap assembly 922. These product anchor flaps 750, 752, 754, 924, 926, 928 have irregular shapes in order to accommodate different end profiles of the product packaged in the insert 602. The product anchor flaps 750, 752, 754 are configured to be folded into the first air cell 1070, along fold lines 760, 768, 776, respectively, toward the second side panel 828. The product anchor flaps 924, 926, 928 are configured to be folded into the third air cell 1074, along fold lines 934, 942, 950, respectively, toward the fourth side panel 1002.

The product can then be positioned on the outer surface 606 of the first bottom panel 608 of the second air cell 1072 and the respective ends of the product can be inserted into the first and third air cells 1070, 1074 by folding in the anchor flaps 750, 752, 754; 924, 926, 928 of the first and second product anchor flap assemblies 748, 922, respectively, in order to hold the product in place relative to the insert 602. If desired, the product could be positioned on the outer surface 606 of the first bottom panel 608 of the second air cell 1072 prior to folding the first and third air cells 1070, 1074 upwardly to provide the insert 602 in the generally U-shaped form such that upon folding the first and third air cells 1070, 1074 upwardly, the ends of the product will come into contact with the first and second product anchor flap assemblies 748, 922.

The finger tab members 852, 1026 are provided on the outer sides of the first and third vertical air cells 1070, 1074 and can be pushed into the air cells 1070, 1074 in order to allow a user's fingers to be inserted therein for simplified handling of the insert 602.

As explained above, the edge 786, on either side of the tab member 792, and edge 820 extend beyond the second side panel 828 and, thus, beyond the first air cell 1070 such that the edges 786, 820 are configured to be positioned against the outer box when the insert 602 is positioned therein, thus distancing the first air cell 1070 from the outer box to create an additional air cell, but also stabilizing the first air cell 1070 within the outer box, in order to protect same. Also as explained above, the edge 960, on either side of the tab member 966, and edge 994 extend beyond the fourth side panel 1002 and, thus, beyond the third air cell 1074 such that the edges 960, 994 are configured to be positioned against the outer box when the insert 602 is positioned therein, thus distancing the third air cell 1074 from the outer box to create an additional air cell, but also stabilizing the third air cell 1074 within the outer box, in order to protect same.

Preferably, the toner cartridge is placed inside a plastic bag 130 when the packaging is complete. The assembled insert 602 and product is now ready to be slid or placed in an outer box or carton in the same manner described in connection with the insert of the first embodiment of the invention, and as illustrated in FIG. 8, and therefore this discussion will not be repeated and reillustrated for brevity purposes.

Figure 23:
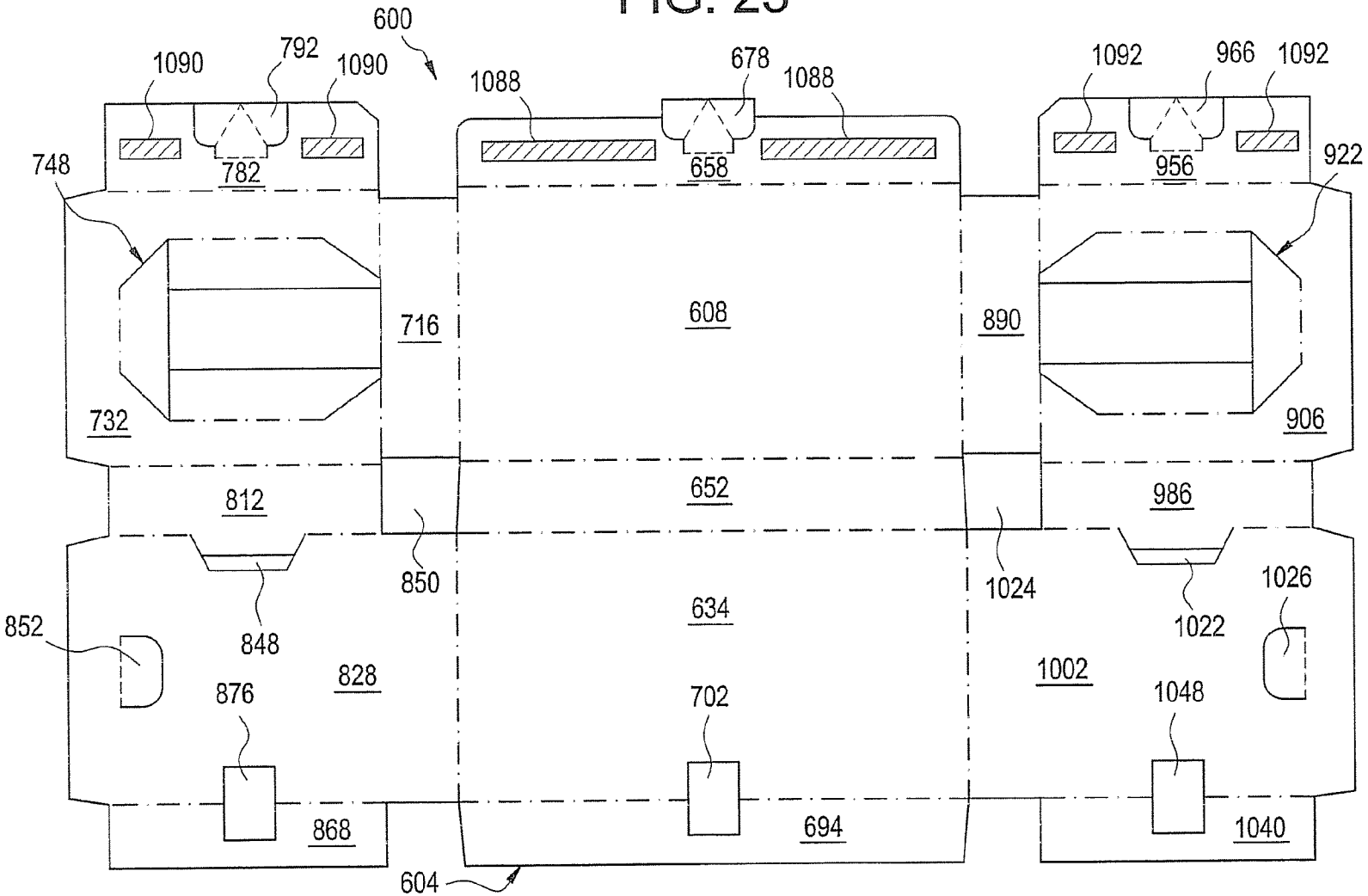
FIG. 23 is a top plan view of an alternative embodiment of the corrugated fibreboard blank illustrated in FIG. 11 having glue strips provided on a top surface of the corrugated fibreboard blank.

If desired, the blank 600 could also be provided, as illustrated in FIG. 23, rather than as illustrated in FIG. 11. FIG. 23 illustrates the blank 600 being provided with adhesive strips 1088 on the top surface 604 of the first bottom outer panel 658, adhesive strips 1090 on the top surface 604 of the first outer side panel 782, and adhesive strips 1092 on the top surface 604 of the third outer side panel 956. One or more of the adhesive strips 1088, 1090, 1092 could be provided on the first bottom outer panel 658, the first outer side panel 782, and the third outer side panel 956, respectively, as desired. The adhesive strips 1088, 1090, 1092 are preferably applied to the blank 600 using a well-known adhesive applicator and, therefore, the adhesive applicator and the process of applying adhesive will not be described in detail herein as they are both well-known in the art. The adhesive applied is preferably glue, but other types of adhesive could also be applied as desired. Also, the adhesive is preferably applied in strips, such as strips 1088, 1090, 1092, but could be applied in other manners as desired.

Figure 24:
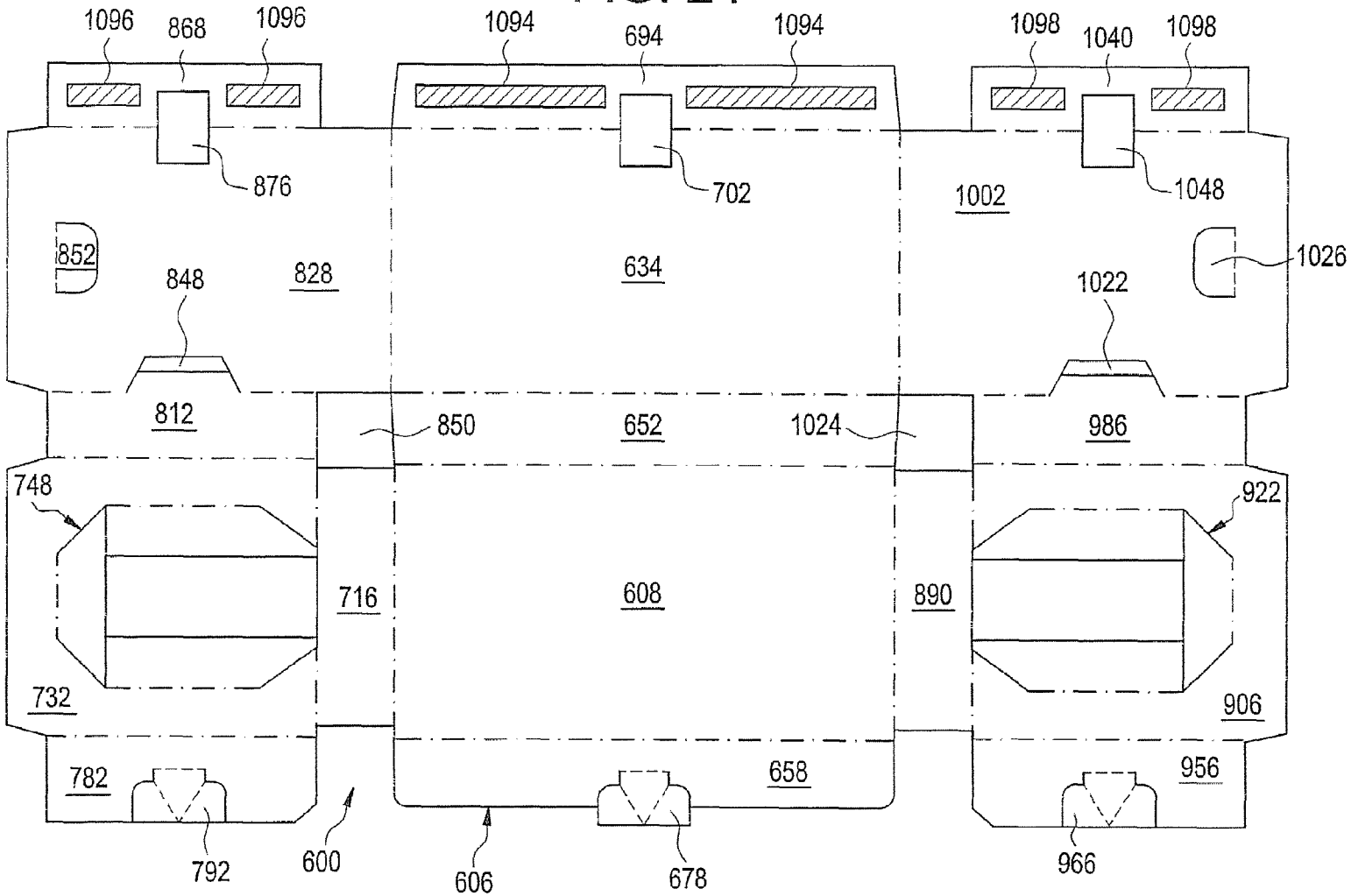
FIG. 24 is a bottom plan view of an alternative embodiment of the corrugated fibreboard blank illustrated in FIG. 12 having glue strips provided on a bottom surface of the corrugated fibreboard blank.

Also, if desired, the blank 600 could alternatively be provided, or in conjunction with the blank as illustrated in FIG. 23, as illustrated in FIG. 24, rather than in FIG. 12. FIG. 24 illustrates the blank 600 being provided with adhesive strips 1094 on the bottom surface 606 of the second bottom outer panel 694, adhesive strips 1096 on the bottom surface 606 of the second outer side panel 868, and adhesive strips 1098 on the bottom surface 606 of the fourth outer side panel 1040. One or more of the adhesive strips 1094, 1096, 1098 could be provided on the second bottom outer panel 694, the second outer side panel 868, and the fourth outer side panel 1040, respectively, as desired. The adhesive strips 1094, 1096, 1098 are preferably applied to the blank 600 using a well-known adhesive applicator and, therefore, the adhesive applicator and the process of applying adhesive will not be described in detail herein as they are both well-known in the art. The adhesive applied is preferably glue, but other types of adhesive could also be applied as desired. Also, the adhesive is preferably applied in strips, such as strips 1094, 1096, 1098, but could be applied in other manners as desired.

If the blank 600 as illustrated in FIG. 23 and/or FIG. 24 is utilized rather than the blank 600 as illustrated in FIG. 11 and/or FIG. 12, the assembly of the blank 600 into the insert 602 is identical, except for a few differences as discussed hereinbelow.

With regard to FIG. 16, if the blank 600, as illustrated in FIGS. 23 and/or 24, is/are utilized, rather than the blank 600, as illustrated in FIGS. 11 and/or 12, when the first bottom outer panel 658, the first outer side panel 782, and the third outer side panel 956 are folded downwardly along fold lines 618, 736, 910, respectively, the adhesive strips 1088, 1090, 1092 and/or the adhesive strips 1094, 1096, 1098 will secure the first bottom outer panel 658, the first outer side panel 782, and the third outer side panel 956, respectively, to the second bottom outer panel 694, the second outer side panel 828, and the fourth outer side panel 1040, respectively, thus forming the generally tubular structure of the insert 602 and the first, second and third air cells 1070, 1072, 1074. The assembly of the blank 600 into the insert 602 would then not require the steps discussed with regard to FIG. 17, namely, the inserting of the tab members 678, 782, 966 into the apertures 702, 876, 1048, respectively, in order to form the generally tubular structure of the insert 602 and the first, second and third air cells 1070, 1072, 1074. If desired, though, while not necessary, any one of the tab members 678, 782, 966 may still be inserted into the apertures 702, 876, 1048 to further secure the insert into the form of the generally tubular structure of the insert 602 and the first, second and third air cells 1070, 1072, 1074, thus further ensuring the structural integrity of the insert 602. Further assembly of the insert 602 is then identical to that as previously described.

It should be noted that while the blank 600 has been described hereinabove as having certain dimensions, that these dimensions should be understood to be only one preferred embodiment of the blank 600 and are used herein for exemplary purposes only; the dimensions may be changed or adjusted as desired while keeping within the spirit of the invention such that the insert 602 formed from the blank 600 can receive and secure different size products 100 and such that the insert 602 can be positioned within different size cartons or boxes.

All of the blanks 20, 220, 420, 600 have a number of features and advantages. For instance, the blanks 20, 220, 420, 600 allow for fast and easy assembly and handling, they provide for space-saving as they ship and store flat, they are inexpensive as they are formed of corrugated fibreboard, they are versatile as each insert formed from the blanks 20, 220, 420, 600 can secure up to five different cartridges, they are environmentally friendly as they are formed of recyclable material, and they replace molded insert products, which are typically in foam and plastic.

The blank 600 and the insert 602 formed therefrom provide a number of other benefits as well. For example, during the folding of the blank 600, the overlap of the panels to form the generally tubular structure is provided in connection with the narrower panels, namely panels 658, 694, 782, 868, 956, 1040, of the blank 600, rather than in connection with the wider panels, for example, panels 608, 634, 732, 828, 906, 1002, of the blank 600, such that a lesser amount of material is necessary to form the blank 600. Also, the blank 600 is required to have only three (3) tab members, namely 678, 792, 966, provided thereon for locking the blank 600 into the generally tubular structure configuration as illustrated in FIG. 17. Further, the blank 600 is provided with a full, tubular second or central air cell 1072 such that the second air cell 1072 is structurally sound and sturdy. The second air cell 1072 runs the full length of the insert 602, such that its ends 1080, 1084 are generally closed off by an inside wall 828, 1002 of the first and third or vertical air cells 1070, 1074. The first and third air cells 1070, 1074 are thus joined to the second central air cell 1072 by more material such that there is less of a tendency for the connection between the air cells 1070,-1072, 1074 to tear or weaken. Thus, the insert 602 increases the structural integrity between the connection of the first and second air cells 1070, 1072 and between the connection of the second and third air cells 1072, 1074. The first and third or vertical air cells 1070, 1074 also are now configured such that they rest on top of the second central air cell 1072 to again provide more structural integrity to the insert 602. The first and second upper intermediate connecting panels 716, 890 which form the bases of the first and third air cells 1070, 1074, respectively, further provide another layer of material upon which the product would rest on in order to further protect the product within the insert 602. Finally, upon upwardly folding the first and third air cells 1070, 1074 onto the second air cell 1072 to form the insert 602 into the generally U-shaped configuration, the first and third air cells 1070, 1074 tend to remain in the vertical position, sitting on top of the second air cell 1072, even when the insert 602 is not securing the product therein or when the insert 602 is not positioned within the outer box, such that securement of the product within the insert 602 and installation of the insert 602 into the outer box is simplified.

Should the blank 600 as illustrated in FIGS. 23 and/or 24 be utilized as opposed to the blank 600 as illustrated in FIGS. 11 and/or 12, the blank 600 would also lend itself to being at least partially formed by automation as opposed to manual operation. Each of the steps in the assembly of the blank 600 into the insert 602, in its generally tubular configuration may be performed automatically using an appropriately configured machine (not shown). One such machine could have a mandrel, appropriately sized, which could be moved onto the top surface 604 of the blank 600 on the bottom intermediate connecting panel 652 and the first and second side intermediate connecting panels 812, 986. The machine could then further have structure which would fold the blank 600 as described in connection with FIGS. 14-16. As explained above, the folding of the first bottom outer panel 658 and the first and third outer side panels 782, 956 onto the second bottom outer panel 694 and the second and fourth outer side panels 868, 1040, respectively, would secure these panels together because of the adhesive strips 1088, 1090, 1092 and/or 1094, 1096, 1098, thus forming the generally tubular structure of the insert 602. The mandrel could then be removed from the insert 602 and the remainder of the necessary folding of the insert 602 would be performed manually, thus saving the operators valuable time and money in the assembly of the insert 602.

While preferred embodiments of the present invention are shown and described, it is envisioned that those skilled in the art may devise various modifications of the present invention without departing from the spirit and scope of the appended claims.

The invention is claimed as follows:

1. An insert for receiving and protecting a product, said insert comprising:

a bottom air cell formed from a blank which is configured to be positioned below the product and further configured such that said bottom air cell cannot receive a portion of the product therein;

a first side air cell formed from said blank having first means for receiving a first end of the product therein when the product comes into contact with said first side air cell, said first side air cell having a lower end which is configured to be positioned above said bottom air cell proximate to a first end of said bottom air cell; and a second side air cell formed from said blank having second means for receiving a second end of the product therein when the product comes into contact with said second side air cell, said second side air cell having a lower end which is configured to be positioned above said bottom air cell proximate to a second end of said bottom air cell.

2. An insert as defined in claim 1, wherein each of said air cells of said insert are formed by folding said blank into a generally tubular configuration and by securing a first portion of said blank to a second portion of said blank.

3. An insert as defined in claim 2, wherein said first portion of said blank is secured to said second portion of said blank by an adhesive.

4. An insert as defined in claim 2, wherein said first portion of said blank is secured to said second portion of said blank by inserting at least one tab member of said blank into at least one aperture of said blank.

5. An insert as defined in claim 1, wherein said first and second side air cells are generally perpendicular to said bottom air cell such that said insert is a generally U-shaped structure.

6. An insert as defined in claim 5, wherein said first and second side air cells remain generally perpendicular to said bottom air cell without assistance from either the product engaging said first and second side air cells or a box in which said insert is positioned.

7. An insert as defined in claim 1, wherein said insert has a predefined length and wherein said bottom air cell generally extends said entire predefined length of said insert.

8. An insert for receiving and protecting a product, said insert comprising:

a bottom air cell formed from a blank which is configured to be positioned below the product, said bottom air cell is formed from said blank by first and second bottom panels, an intermediate bottom panel which connects said first and second bottom panels to one another, a first outer bottom panel which is connected to said first bottom panel opposite said connection of said first bottom panel with said intermediate bottom panel, and a second outer bottom panel which is connected to said second bottom panel opposite said connection of said second bottom panel with said intermediate bottom panel, said first and second outer bottom panels configured to overlap one another and be secured to one another;

a first side air cell formed from said blank having first means for receiving a first end of the product therein when the product comes into contact with said first side air cell, said first side air cell having a lower end which is configured to be positioned above said bottom air cell proximate to a first end of said bottom air cell; and a second side air cell formed from said blank having second means for receiving a second end of the product therein when the product comes into contact with said second side air cell, said second side air cell having a lower end which is configured to be positioned above said bottom air cell proximate to a second end of said bottom air cell;

wherein each of said air cells of said insert are formed by folding said blank into a generally tubular configuration and by securing a first portion of said blank to a second portion of said blank.

9. An insert as defined in claim 8, wherein said first side air cell is formed from said blank by first and second side panels, an intermediate side panel which connects said first and second side panels to one another, a first outer side panel which is connected to said first side panel opposite said connection of said first side panel with said intermediate side panel, and a second outer side panel which is connected to said second side panel opposite said connection of said second side panel with said intermediate side panel, said first and second outer side panels configured to overlap one another and be secured to one another, said first receiving means being associated with said first side panel.

10. An insert as defined in claim 9, wherein said first side panel is connected to said first bottom panel by a connecting panel of said blank, and wherein said second side panel is connected to said second bottom panel.

11. An insert as defined in claim 10, wherein said connecting panel closes off said lower end of said first side air cell and is positioned between said first side air cell and said bottom air cell proximate to said first end of said bottom air cell, and wherein a portion of said second side panel closes off said first end of said bottom air cell.

12. An insert as defined in claim 10, wherein said connecting panel has a width which is smaller than a width of said first bottom panel and which is smaller than a width of said first side panel.

13. An insert as defined in claim 12, wherein said connecting panel does not extend to said connection of said first bottom panel with either said first outer bottom panel or said intermediate bottom panel, and wherein said connecting panel does not extend to said connection of said first side panel with either said first outer side panel or said intermediate side panel.

14. An insert as defined in claim 8, wherein said second side air cell is formed from said blank by first and second side panels, an intermediate side panel which connects said first and second side panels to one another, a first outer side panel which is connected to said first side panel opposite said connection of said first side panel with said intermediate side panel, and a second outer side panel which is connected to said second side panel opposite said connection of said second side panel with said intermediate side panel, said first and second outer side panels configured to overlap one another and be secured to one another, said second receiving means being associated with said first side panel.

15. An insert as defined in claim 14, wherein said first side panel is connected to said first bottom panel by a connecting panel of said blank, and wherein said second side panel is connected to said second bottom panel.

16. An insert as defined in claim 15, wherein said connecting panel closes off said lower end of said second side air cell and is positioned between said second side air cell and said bottom air cell proximate to said second end of said bottom air cell, and wherein a portion of said second side panel closes off said second end of said bottom air cell.

17. An insert as defined in claim 15, wherein said connecting panel has a width which is smaller than a width of said first bottom panel and which is smaller than a width of said first side panel.

18. An insert as defined in claim 17, wherein said connecting panel does not extend to said connection of said first bottom panel with either said first outer bottom panel or said intermediate bottom panel, and wherein said connecting panel does not extend to said connection of said first side panel with either said first outer side panel or said intermediate side panel.

19. An insert for receiving and protecting a product, said insert comprising:

a bottom air cell formed from a blank which is configured to be positioned below the product;

a first side air cell formed from said blank having first means for receiving a first end of the product therein when the product comes into contact with said first side air cell, said first side air cell having a lower end which is configured to be positioned above said bottom air cell proximate to a first end of said bottom air cell;

a second side air cell formed from said blank having second means for receiving a second end of the product therein when the product comes into contact with said second side air cell, said second side air cell having a lower end which is configured to be positioned above said bottom air cell proximate to a second end of said bottom air cell; and at least one spacer tab formed from said blank extending outwardly from at least one of said first and second side air cells, each said spacer tab configured to provide protection to said first and second side air cells when said insert is packed inside of a box.

20. A method of forming an insert for receiving and protecting a product, said method comprising the steps of:

providing a blank having anchoring tabs;

folding a first portion of said blank over onto a second portion of said blank;

securing said first portion of said blank to said second portion of said blank to form said blank into a generally tubular structure which is separated into a first air cell, a second air cell, and a third air cell, said second air cell being positioned between said first and third air cells;

folding said first air cell relative to said second air cell such that a lower end of said first air cell is configured to be positioned above said second air cell proximate to a first end of said second air cell, at least one of said anchoring tabs of said blank being associated with said first air cell; and folding said third air cell relative to said second air cell such that a lower end of said third air cell is configured to be positioned above said second air cell proximate to a second end of said second air cell, at least one of said anchoring tabs of said blank being associated with said third air cell.

21. A method as defined in claim 20, further comprising the steps of:

providing said blank with an adhesive on said first portion thereof; and securing said first portion of said blank to said second portion of said blank with said adhesive.

22. A method as defined in claim 20, further comprising the steps of:

providing said blank with at least one tab member and at least one aperture for receiving said at least one tab member; and inserting said at least one tab member into said at least one aperture in order to secure said first portion of said blank to said second portion of said blank.

23. A method as defined in claim 20, wherein at least one of the steps of said method are performed automatically.

24. An insert for receiving and protecting a product, said insert comprising:

a bottom air cell formed from a blank which is configured to be positioned below the product;

a first side air cell formed from said blank having first means for receiving a first end of the product therein when the product comes into contact with said first side air cell, said first side air cell having a lower end which is configured to be positioned above said bottom air cell proximate to a first end of said bottom air cell, said first side air cell being separated from said bottom air cell such that said first side air cell is not in communication with said bottom air cell; and a second side air cell formed from said blank having second means for receiving a second end of the product therein when the product comes into contact with said second side air cell, said second side air cell having a lower end which is configured to be positioned above said bottom air cell proximate to a second end of said bottom air cell.

25. The insert as defined in claim 24, wherein said second side air cell is separated from said bottom air cell such that said second side air cell is not in communication with said bottom air cell.

* * * * *